US010995481B2

(12) United States Patent
Veros et al.

(10) Patent No.: US 10,995,481 B2
(45) **Date of Patent: *May 4, 2021**

(54) TOILET WITH OVERFLOW PROTECTION

(71) Applicant: Delta Faucet Company, Indianapolis, IN (US)

(72) Inventors: Michael J. Veros, Carmel, IN (US); Kurt Judson Thomas, Indianapolis, IN (US); Robert W. Rodenbeck, Indianapolis, IN (US); Garry Robin Marty, Fishers, IN (US); Derek Allen Brown, Lizton, IN (US)

(73) Assignee: Delta Faucet Company, Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/289,701

(22) Filed: Mar. 1, 2019

(65) Prior Publication Data

US 2019/0264434 A1 Aug. 29, 2019

Related U.S. Application Data

(63) Continuation of application No. 15/818,887, filed on Nov. 21, 2017, now Pat. No. 10,221,554, which is a continuation of application No. 14/384,923, filed as application No. PCT/US2013/030952 on Mar. 13, 2013, now Pat. No. 9,834,918.

(60) Provisional application No. 61/610,205, filed on Mar. 13, 2012, provisional application No. 61/722,074, filed on Nov. 2, 2012.

(51) Int. Cl.

| | |
|---|---|
| ***E03D 5/10*** | (2006.01) |
| ***E03D 1/00*** | (2006.01) |
| ***E03D 5/02*** | (2006.01) |

(52) U.S. Cl.
CPC ..... *E03D 5/105* (2013.01); *E03D 1/00* (2013.01); *E03D 5/026* (2013.01)

(58) Field of Classification Search
CPC E03D 5/026; E03D 5/09; E03D 5/092; E03D 5/094; E03D 5/10; E03D 5/105; E03D 1/141; E03D 1/142; E03D 1/144; E03D 1/145
See application file for complete search history.

(56) References Cited

U.S. PATENT DOCUMENTS

| | | | |
|---|---|---|---|
| 1,956,087 | A | 4/1934 | Tracy |
| 2,297,935 | A | 10/1942 | Baither |

(Continued)

OTHER PUBLICATIONS

International Search Report and Written Opinion dated May 21, 2013, from the International Search Authority in priority application No. PCT/US2013/030952.

*Primary Examiner* — Janie M Loeppke
(74) *Attorney, Agent, or Firm* — Bose McKinney & Evans LLP

(57) ABSTRACT

A flush toilet includes a bowl, a tank coupled to the bowl, a flush valve positioned within the tank, and a flush device configured to initiate a flush cycle. The automatic toilet further comprises an electronic sensing assembly having a sensing member positioned on the bowl for detecting an overflow condition of the bowl, an overflow device operably coupled to the flush device, and a controller in electronic communication with the electronic sensing assembly and the overflow device for controlling the flush device in response to a condition of the toilet.

18 Claims, 65 Drawing Sheets

(56) References Cited

U.S. PATENT DOCUMENTS

| | | | | |
|---|---|---|---|---|
| 3,063,059 | A | 11/1962 | Ulicni | |
| 3,763,505 | A | 10/1973 | Zimmerman | |
| 3,817,279 | A | 6/1974 | Larson | |
| 3,817,489 | A | 6/1974 | Caron et al. | |
| 4,230,145 | A | 10/1980 | Badders | |
| 4,756,031 | A | 7/1988 | Barrett | |
| 4,832,310 | A | 5/1989 | Nestich | |
| 5,319,809 | A | 6/1994 | Testa | |
| 6,016,577 | A | 1/2000 | Cooley | |
| 6,278,173 | B1 | 8/2001 | Kobayashi et al. | |
| 6,694,534 | B2 | 2/2004 | Stone | |
| 6,983,491 | B2 | 1/2006 | Curtis et al. | |
| 7,275,271 | B1 | 10/2007 | Smith | |
| 7,636,959 | B2 | 12/2009 | Bowcutt | |
| 7,757,708 | B1 * | 7/2010 | Canfield | E03D 11/00 137/389 |
| 7,823,227 | B2 | 11/2010 | Damianoe et al. | |
| 8,332,969 | B2 | 12/2012 | Spadola et al. | |
| 8,510,872 | B2 | 8/2013 | Muhlhausen et al. | |
| 8,555,427 | B2 | 10/2013 | Stauber et al. | |
| 9,834,918 | B2 | 12/2017 | Veros et al. | |
| 10,221,554 | B2 | 3/2019 | Veros et al. | |
| 2003/0196258 | A1 | 10/2003 | Pham et al. | |
| 2004/0007264 | A1 | 1/2004 | Bootka | |
| 2005/0133754 | A1 | 6/2005 | Parsons et al. | |
| 2006/0010592 | A1 | 1/2006 | Matsui | |
| 2006/0244466 | A1 | 11/2006 | Call et al. | |
| 2009/0077730 | A1 | 3/2009 | Funari | |
| 2010/0205727 | A1 | 8/2010 | Muhlhausen et al. | |
| 2010/0205728 | A1 | 8/2010 | Muhlhausen et al. | |
| 2010/0205729 | A1 | 8/2010 | Muhlhausen et al. | |
| 2010/0205730 | A1 | 8/2010 | Muhlhausen et al. | |
| 2010/0205731 | A1 | 8/2010 | Muhlhausen et al. | |
| 2010/0242160 | A1 | 9/2010 | Canfield et al. | |
| 2011/0209287 | A1 | 9/2011 | Call et al. | |
| 2012/0055557 | A1 | 3/2012 | Belz et al. | |
| 2013/0061381 | A1 | 3/2013 | Parsons et al. | |
| 2013/0133131 | A1 | 5/2013 | Peng et al. | |
| 2014/0047629 | A1 | 2/2014 | Stauber et al. | |
| 2014/0123378 | A1 | 5/2014 | Luettgen et al. | |

* cited by examiner

TOILET WITH OVERFLOW PROTECTION

CROSS-REFERENCE TO RELATED APPLICATIONS

The present application is a continuation of U.S. patent application Ser. No. 15/818,887, filed Nov. 21, 2017, now U.S. Pat. No. 10,221,554, which is a continuation of U.S. patent application Ser. No. 14/384,923, filed Sep. 12, 2014, now U.S. Pat. No. 9,834,918, which is a 371 national phase filing of International Patent Application No. PCT/US2013/030952, filed Mar. 13, 2013, which claims the benefit of U.S. Provisional Patent Application Ser. No. 61/610,205, filed on Mar. 13, 2012, and U.S. Provisional Patent Application Ser. No. 61/722,074, filed on Nov. 2, 2012, the complete disclosures of which are expressly incorporated by reference herein.

BACKGROUND AND SUMMARY OF THE INVENTION

The present invention relates generally to an automatic flush toilet and, more particularly, to a hands-free toilet with overflow prevention.

Conventional toilets include a flush lever on the outside of the tank to activate the flush mechanism of the toilet. More particularly, conventional toilets may require the user to depress, or otherwise move, the flush lever in order to initiate the flush mechanism. However, some users may be concerned about germs and, therefore, may feel uncomfortable touching the flush lever.

Additionally, the handles on conventional toilets may allow a user to successively flush the toilet. However, during certain conditions of the toilet, such as an overflow condition (e.g., a blockage in the trapway), it may not be desirable to flush the toilet.

It is also known that pressure in water supply lines may vary between installations. For example, the water pressure from a municipality water source may be greater than the water pressure from a well water source. Additionally, when multiple water devices (e.g., washing machines, showers, or sprinklers) are simultaneously operating at the same location, the water pressure available to any of these water devices may decrease. When the water pressure decreases, it may be difficult and time-consuming to operate certain water devices. Conversely, if the water pressure increases significantly, there may be damage to the water devices.

According to an illustrative embodiment of the present disclosure, an automatic flush toilet comprises a bowl, a tank coupled to the bowl, a flush valve positioned within the tank, and a flush actuator operably coupled to the flush valve. The flush actuator includes a piston and a cylinder. The automatic toilet further comprises an electronic sensing assembly in communication with the flush actuator, an overflow device in communication with the flush actuator, and a controller in electronic communication with the electronic sensing assembly and the overflow device for controlling the flush actuator.

According to a further illustrative embodiment of the present disclosure, an automatic flush toilet comprises a bowl, a tank positioned above the bowl, and a flush actuator assembly positioned within the tank. The flush actuator assembly is in fluid communication with a water supply and is configured to receive a flow of water from the water supply. The toilet also comprises a flush valve assembly operably coupled to the flush actuator assembly and an overflow assembly operably coupled to the flush actuator assembly. The overflow assembly is configured to engage the flush actuator assembly when a water level in the bowl is above a predetermined level. The flush actuation assembly is configured to engage the flush valve assembly to initiate a flush cycle of the toilet when the water level in the bowl is below the predetermined level. The flush actuator assembly is activated by a water pressure during the engagement with the flush valve assembly, and the pressure activating the flush actuator assembly is constant and independent of a water pressure in the water supply.

According to another illustrative embodiment of the present disclosure, an automatic flush toilet comprises a bowl, a tank coupled to the bowl, and a flush actuator positioned within the tank. The automatic toilet further comprises a waterway assembly in fluid communication with the flush actuator, and at least one electrically operable valve assembly in fluid communication with the waterway assembly. Additionally, the automatic toilet includes a flush actuation sensor operably coupled to the at least one electrically operable valve assembly, and an overflow device in communication with the at least one electrically operable valve assembly.

According to yet another illustrative embodiment of the present disclosure, an automatic flush toilet comprises a bowl, a tank coupled to the bowl, and a flush valve having a pivotable lever arm positioned within the tank. The automatic toilet further comprises a flush actuator having a piston, a cylinder, and a diaphragm. The flush actuator may be operably coupled to the flush valve. Additionally, the automatic toilet comprises a waterway assembly in fluid communication with the flush actuator. The waterway assembly includes an inlet and at least one outlet. The automatic toilet of the present disclosure also comprises an electrically operable valve in fluid communication with the waterway assembly. The electrically operable valve may be configured to control a flow of water from the inlet of the waterway assembly to the flush actuator. The flush actuator is operable by pressure from the flow of water. Additionally, the automatic toilet comprises a capacitive sensor in electronic communication with the electrically operable valve and is configured for hands-free operation of the toilet. Also, the automatic toilet may comprise an electronic overflow sensor configured to detect an overflow condition.

According to an illustrative embodiment of the present disclosure, a flush toilet comprises a bowl, a tank coupled to the bowl, a flush valve positioned within the tank, and a flush device configured to initiate a flush cycle. The toilet further comprises an electronic sensing assembly having a sensing member positioned on the bowl for detecting an overflow condition of the bowl, an overflow device operably coupled to the flush device, and a controller in electronic communication with the electronic sensing assembly and the overflow device for controlling the flush device in response to a condition of the toilet.

According to another illustrative embodiment of the present disclosure, an automatic flush toilet comprises a bowl, a tank coupled to the bowl, a flush actuator positioned within the tank, and a water supply in fluid communication with the flush actuator. The automatic toilet further comprises at least one electrically-operable valve assembly in fluid communication with the water supply, a housing for supporting the at least one electrically-operable valve assembly, and a sensor operably coupled to the at least one electrically operable valve assembly. Additionally, the automatic toilet comprises an overflow device in communication with the at least one electrically operable valve assembly, wherein the at least one electrically-operable valve assembly is integral with the housing.

According to yet another illustrative embodiment of the present disclosure, an automatic flush toilet comprises a bowl, a tank coupled to the bowl, and a flush actuator positioned within the tank. The toilet further comprises at least one electrically-operable valve assembly in fluid communication with the water supply, and a chainless flush valve assembly in fluid communication with the electrically-operable valve assembly. The chainless flush valve assembly has a manual member configured for manually flushing the toilet. Additionally, the toilet comprises an overflow device in communication with the electrically operable valve assembly to control the flush actuator in response to a condition of the toilet.

An automatic flush toilet comprising a bowl, a tank coupled to the bowl and supporting a quantity of water, and a fill valve assembly positioned in the tank and including at least one electrically-operable valve assembly. The toilet further comprising a flush actuator fluidly coupled to the fill valve assembly and a water supply in fluid communication with the flush actuator. The toilet also comprises a flush valve assembly having a flapper operably coupled to the flush actuator to move the flapper between an open position and a closed position. Water flows into the bowl from the tank in the open position and water remains in the tank in the closed position. Additionally, the toilet comprises an overflow device in communication with the at least one electrically operable valve assembly. The overflow device is configured to prevent water from the water supply from entering the tank, and the overflow device is configured to retain the flapper in the closed position.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying Figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention. Although the disclosure is described in connection with water, it should be understood that additional types of fluids may be used.

Figure 1:
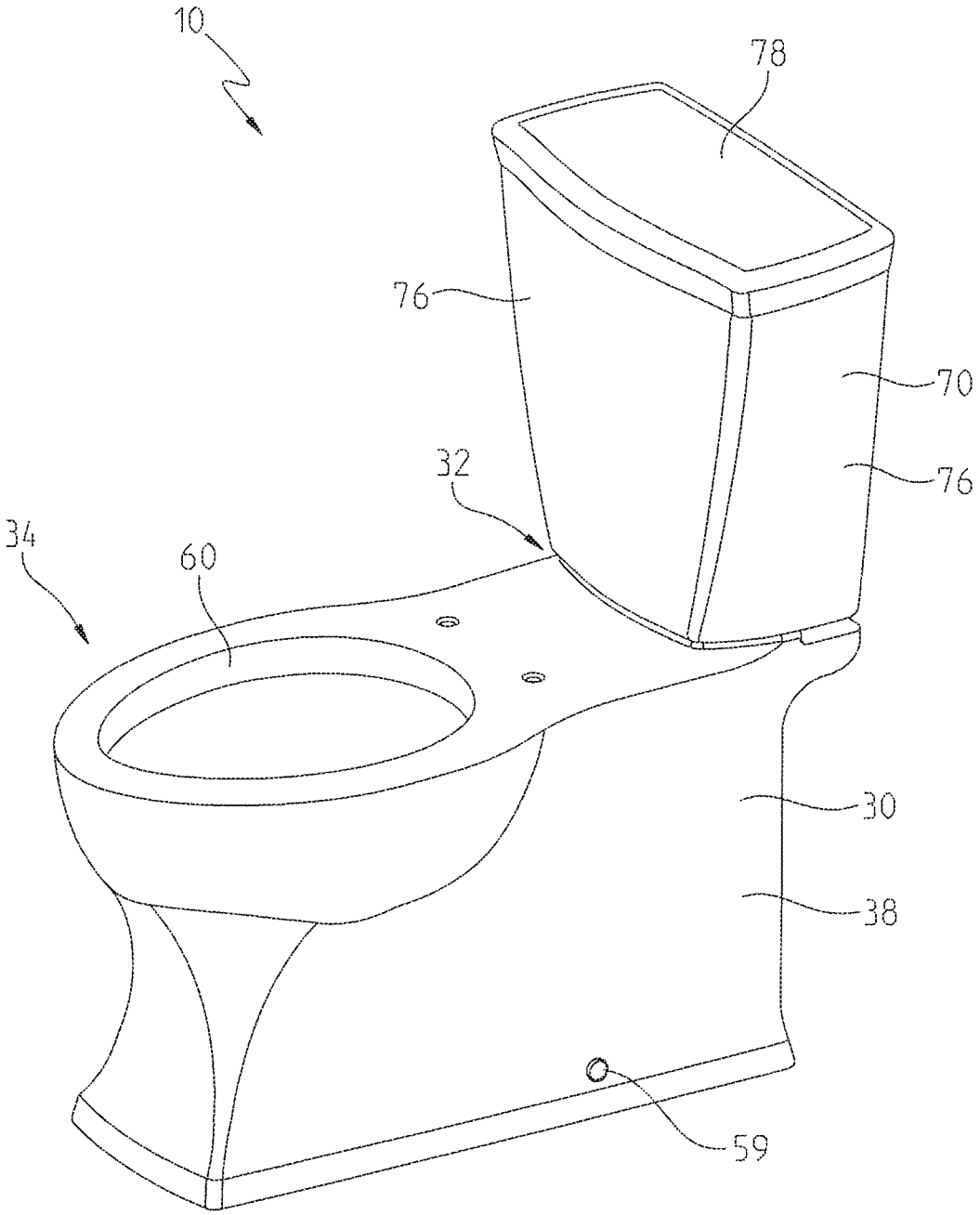
FIG. 1 is a side perspective view of an illustrative embodiment toilet of the present disclosure.
Figure 2:
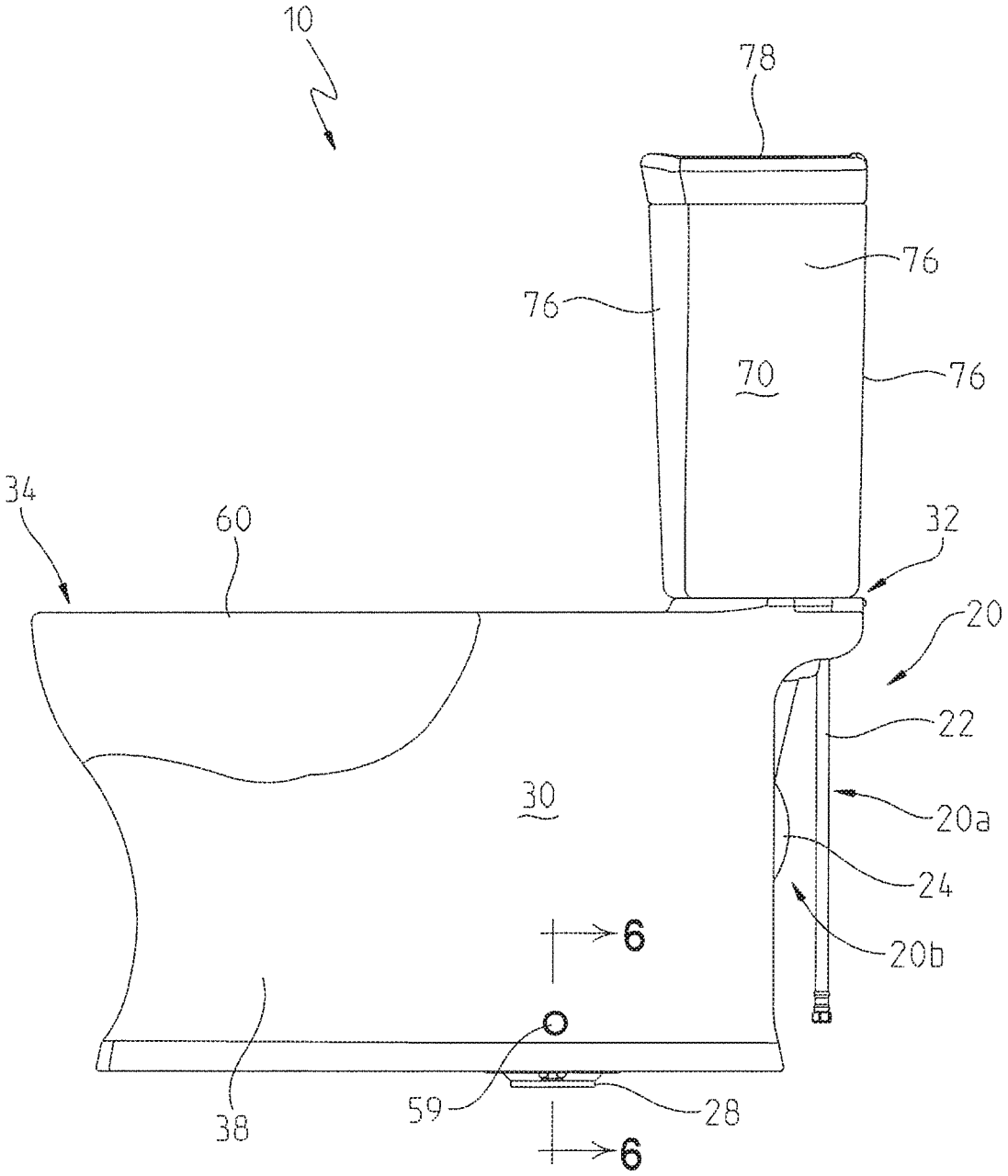
FIG. 2 is a side elevational view of the toilet of FIG. 1.
Figure 3:
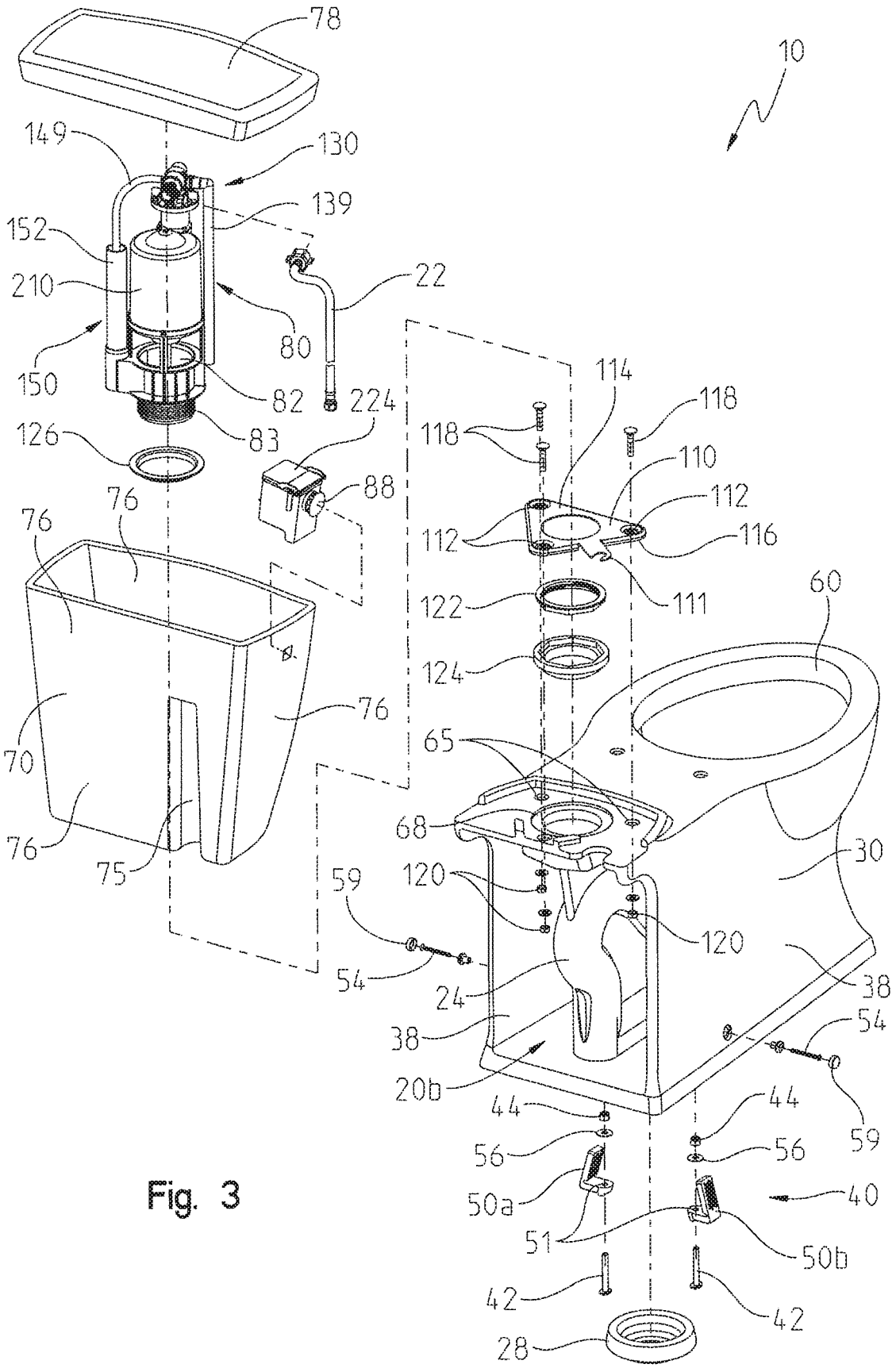
FIG. 3 is an exploded perspective view of the toilet of FIG. 1.

Referring to FIGS. 1-3, an illustrative embodiment toilet 10 is shown including a waterway assembly 20, a mounting base 30, a mounting assembly 40, a bowl 60, a tank 70, a flush valve assembly 80, a fill valve assembly 130, and an overflow assembly 150. Illustratively, toilet 10 is a tank-type, gravity-fed toilet. Alternatively, other embodiments of toilet 10 may be contemplated. In operation, water from tank 70 flows into bowl 60 in order to flush toilet 10 and remove the contents of bowl 60.

Figure 4:
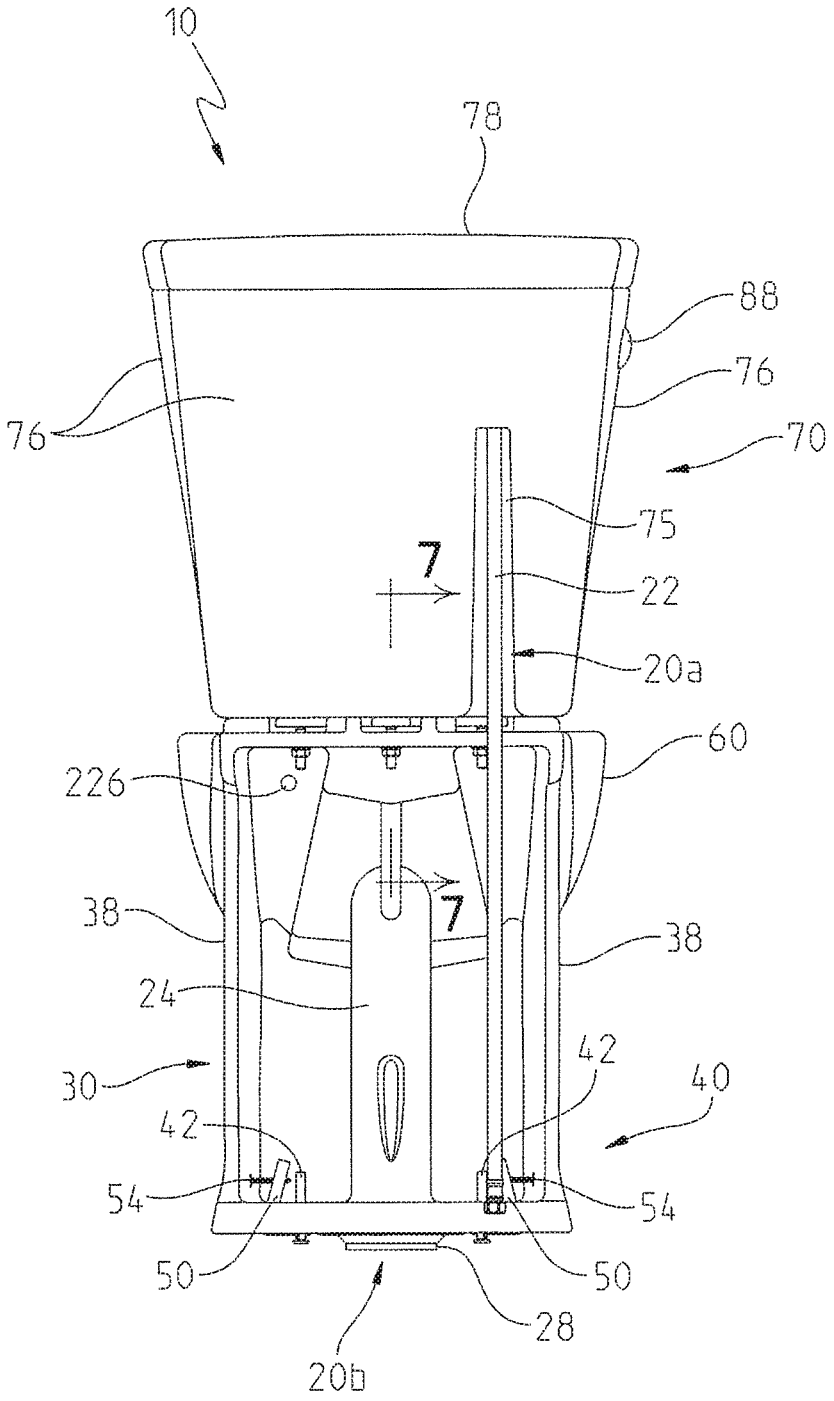
FIG. 4 is a rear view of the toilet of FIG. 1.
Figure 6:
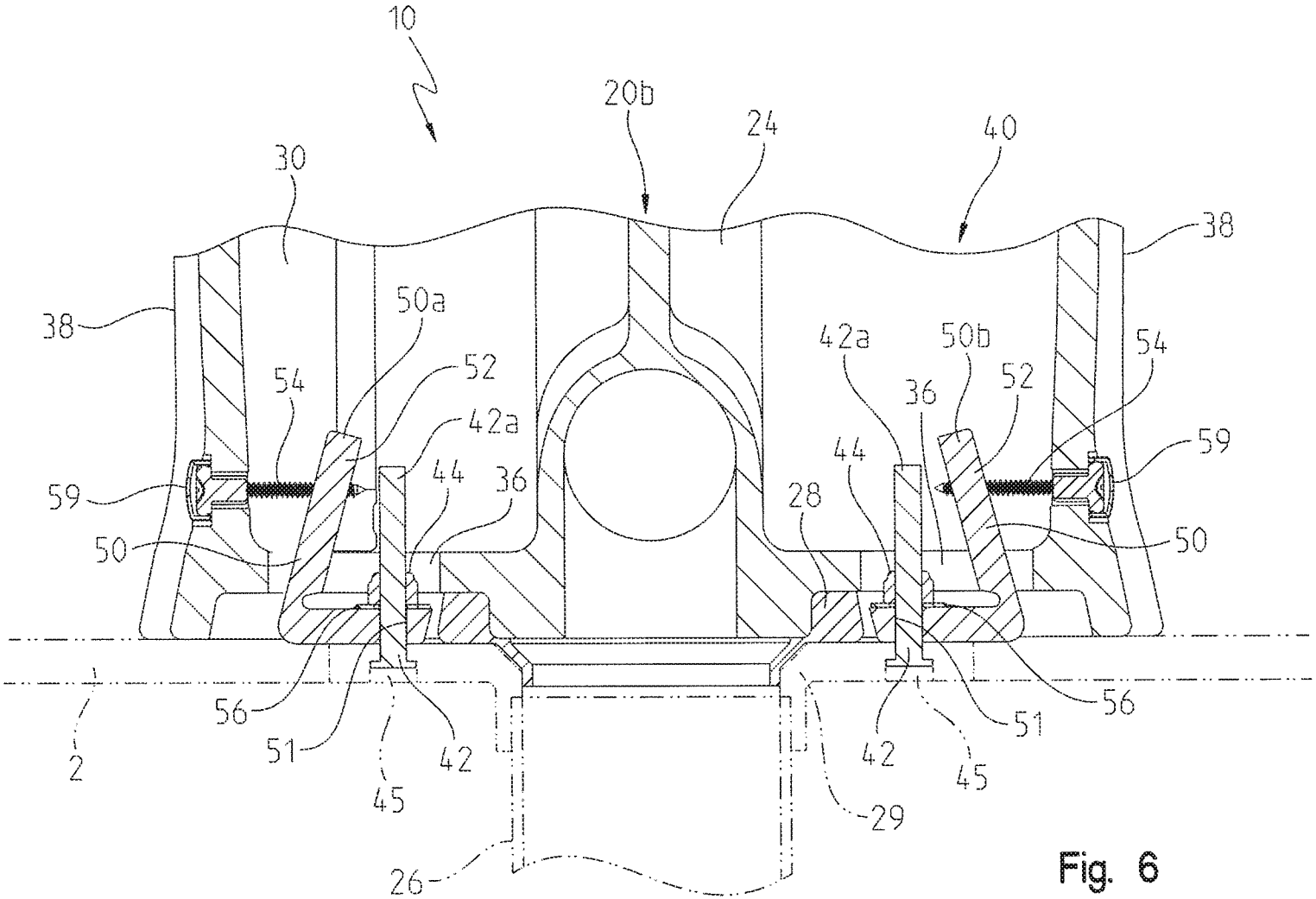
FIG. 6 is a rear cross-sectional view of the base and mounting assembly coupled to a drain, taken along line 6-6 of FIG. 2.

As shown in FIGS. 3 and 4, waterway assembly 20 includes an inlet waterway 20*a* and an outlet waterway 20*b*. In particular, inlet waterway 20*a* may include a supply tube 22, and outlet waterway 20*b* may include an outlet tube, illustratively a siphon tube or trapway 24, a drain tube 26 (FIG. 6), at least one seal 28, and a drain flange 29 (FIG. 6). Outlet waterway 20*b* may be of conventional design. Waterway assembly 20 may also include additional sealing members (not shown) and additional mounting hardware (not shown). To limit contact between the water in toilet 10 and metallic components, waterway assembly 20 may be formed of a non-metallic material, such as a polymer, illustratively a cross-linkable polymer. Alternatively, waterway assembly 20 may be lined with a non-metallic material. As such, waterway assembly 20 is illustratively electrically non-conductive.

Figure 9:
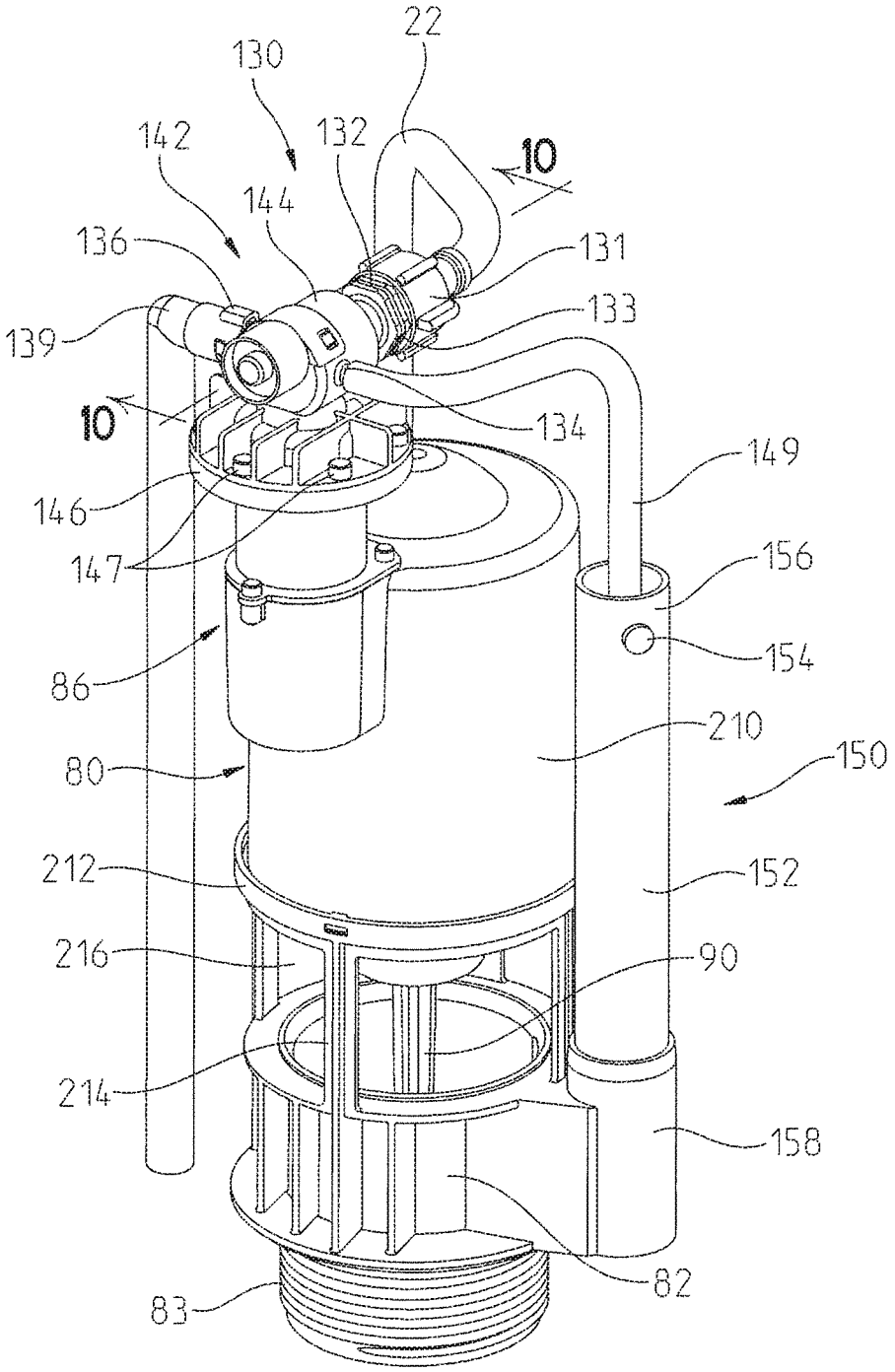
FIG. 9 is a perspective view of the fill valve assembly, the flush valve assembly, and an overflow assembly of the present disclosure.

As shown in FIG. 9, supply tube 22 of inlet waterway assembly 20*a* may be in fluid communication with flush valve assembly 80 and overflow assembly 150 through fill valve assembly 130. In particular, supply tube 22 is fluidly coupled to a water supply (not shown) in order to flow water into fill valve assembly 130, as is further detailed herein.

Referring to FIGS. 3 and 6, trapway 24 of outlet waterway assembly 20*b* is illustratively curved and is coupled to bowl 60 and drain tube 26 (FIG. 6). More particularly, trapway 24 is intermediate bowl 60 and drain tube 26, such that the contents of bowl 60 flow through trapway 24 and into drain tube 26. Drain tube 26 connects trapway 24 to a main sewer line (not shown) to carry away the contents of bowl 60.

As shown in FIG. 6, drain tube 26 of outlet waterway supply 20*b* may be coupled to trapway 24 and floor 2 through a drain flange 29 and seal 28. Drain flange 29 is positioned on an upper surface of floor 2 and is intermediate floor 2 and base 30. Drain flange 29 receives drain tube 26 and an adhesive, epoxy, or other similar material may be used to couple to drain tube 26 to drain flange 29. Seal 28 is positioned between drain tube 26 and base 30 to prevent water leakage. At least a portion of seal 28 is in sealing engagement with drain flange 29. Illustratively, seal 28 may extend along the top surface of drain flange 29. Seal 28 may be comprised of a polymeric or wax material, for example beeswax, rubber, and other similar materials.

The illustrative mounting base 30 of toilet 10 is a pedestal-type configured to rest atop floor 2. Mounting base 30 supports tank 70 and bowl 60 above floor 2. As shown in FIG. 2, tank 70 is supported by a rear portion 32 of base 30 and bowl 60 is supported by a front portion 34 of base 30. In the illustrative embodiment, base 30 integrally supports trapway 24 of waterway assembly 20. Illustratively, base 30 is a concealed-trapway type in that trapway 24 is hidden from view by sidewalls 38 of base 30 (FIG. 3). Base 30 may be comprised of a ceramic, metal, or polymeric material. For example, base 30 may be comprised of porcelain, stainless steel, or plastic composite materials.

Figure 5:
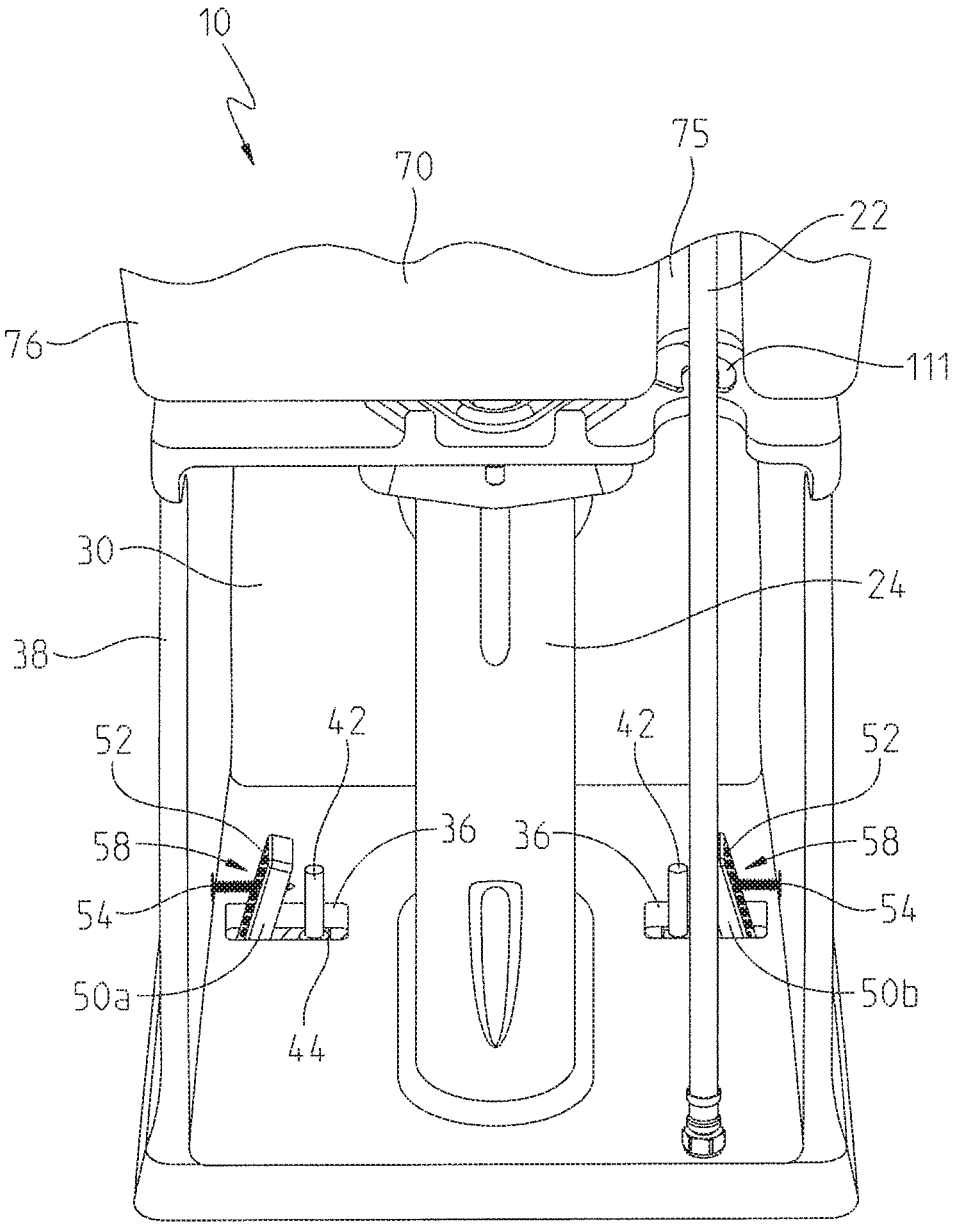
FIG. 5 is a rear view of a base of the toilet and an illustrative mounting assembly of the present disclosure.

Referring to FIGS. 4-6, mounting assembly 40 couples base 30 to drain tube 26. In particular, mounting assembly 40 couples base 30 to drain flange 29 with fasteners, illustratively bolts 42 and nuts 44. Bolts 42 extend through apertures 45 in drain flange 29 to couple base 30 thereto. Illustratively, a threaded end 42*a* of each bolt 42 extends upwardly from below drain flange 29 in order to receive nuts 44 (FIG. 6). It may be appreciate that bolts 42 and nuts 44 are not visible to a user because base 30 is a concealed-trapway type.

Still referring to FIGS. 4-6, mounting assembly 40 also may couple base 30 to drain tube 26 with brackets 50. More particularly, brackets 50 may be positioned within slots 36 of base 30 and positioned above drain flange 29. Illustratively, brackets 50 include a first bracket 50*a* and a second bracket 50*b*. Brackets 50*a*, 50*b* are generally opposite each other such that trapway 24 is intermediate brackets 50*a*, 50*b*. Brackets 50*a*, 50*b* each may include angled or inclined portions 52 having a plurality of apertures 58 (FIG. 5). As shown in FIG. 3, brackets 50*a*, 50*b* may be L-shaped.

Brackets 50*a*, 50*b* also may be coupled to drain flange 29 with bolts 42. For example, bolts 42 extend through apertures 45 in drain flange 29 and through apertures 51 in brackets 50*a*, 50*b* in order to secure base 30 to drain flange 29. Washers 56 may be positioned between brackets 50*a*, 50*b* and nuts 44.

In addition to being coupled to drain flange 29, brackets 50*a*, 50*b* also may be coupled to base 30. As shown in FIGS. 4-6, inclined portions 52 generally extend upwardly and inwardly toward bowl 60. In particular, inclined portions 52 may be angled inwardly and away from the bottom of base 30. Apertures 58 of inclined portions 52 illustratively arranged in two columns. Apertures 58 may be internally threaded in order to receive a screw 54 from outside of base 30, thereby coupling base 30 to brackets 50*a*, 50*b*. The position of screw 54 is sufficiently aligned with one of apertures 58 in base 30 in order to receive screw 54 therethrough. Additional mounting hardware, such as end caps 59, also may be included with mounting assembly 40 in order to conceal screws 54.

Referring to FIGS. 1-3, illustrative bowl 60 is integrally supported by base 30 and is generally positioned above and forward of concealed trapway 24. Bowl 60 may be comprised of a ceramic, metal, or polymeric material. For example, bowl 60 may be comprised of porcelain, stainless steel, or plastic composite materials. Bowl 60 has a generally elliptical shape and, more particularly, has a circular shape. A bottom portion of bowl 60 is fluidly coupled to trapway 24 in a known manner.

Figure 7:
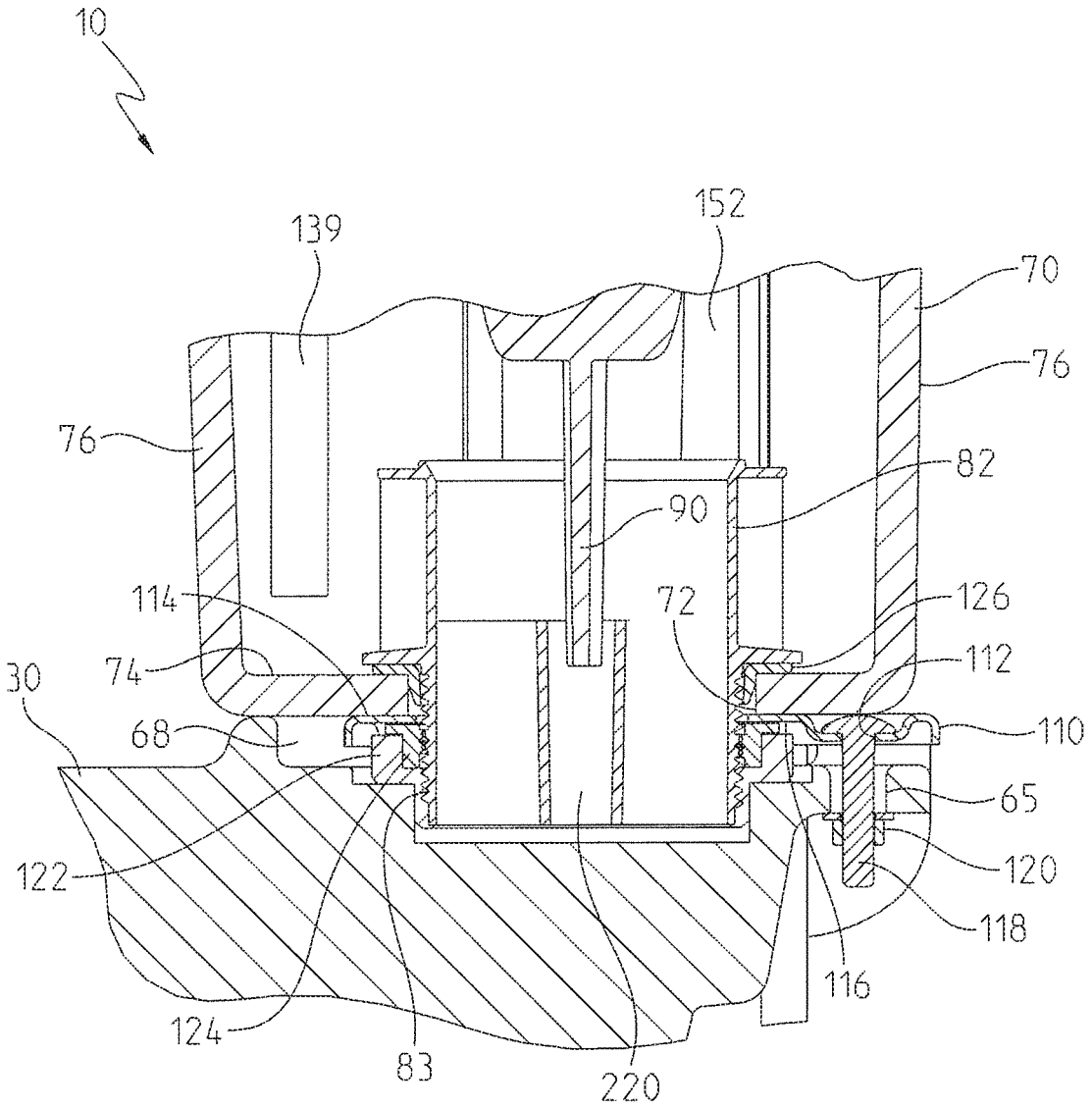
FIG. 7 is a side cross-sectional view of a toilet bowl coupled to a tank with an illustrative mounting bracket of the present disclosure, taken along line 7-7 of FIG. 4.

As shown in FIGS. 3 and 7, bowl 60 may be mounted to tank 70 with a mounting bracket 110. Mounting bracket 110 may be comprised of a metallic or polymeric material. Illustratively, mounting bracket 110 has a generally triangular shape, although mounting bracket 110 may have other shapes (e.g., circular, rectangular). Additionally, mounting bracket 110 may include a coupling member, illustratively a hook 111, that engages with supply tube 22 and extends substantially around supply tube 22 in order to secure supply tube 22 to tank 70 (FIG. 5). Mounting bracket 110 may be positioned below tank 70 and at least partially within a recessed inlet 68 of bowl 60. Mounting bracket 110 has a first or upper side 114 that engages tank 70 and a second or lower side 116 that engages base 30. Mounting bracket 110 also may include apertures 112 that extend from first side 114 to second side 116 of mounting bracket 110 in order to couple mounting bracket 110 to bowl 60.

In order to couple mounting bracket 110 to bowl 60, apertures 112 of mounting bracket 110 align with apertures 65 of rear portion 32 of base 30. Conventional fasteners, such as bolts 118 extend through apertures 112 of mounting bracket 110 and apertures 65 of base 30, and may threadedly couple with additional fasteners, such as nuts 120, in order to secure mounting bracket 110 to base 30. Illustratively, apertures 112 are square, and bolts 118 may be of the carriage-type, which include a square feature below the head of bolts 118, in order to prevent rotation of bolts 118 during assembly with nuts 120. Mounting bracket 110 also may be coupled to tank 70 through a threaded connection with a flush tube 82 of flush valve assembly 80. Illustratively, flush tube 82 has a threaded outer surface that engages with a coupler or other fastener, such as a nut 122, along second side 116 of mounting bracket 110.

Nut 122 may engage a sealing member 124 to prevent water leakage between tank 70 and base 30. Additionally, a seal 126 may be positioned within tank 70 to also prevent water leakage therefrom. More particularly, seal 126 may bend around an inner surface of tank 70 to extend at least partially through an outlet aperture 72 of tank 70. Alternatively, mounting bracket 110 may be overmolded to form a unitary bracket that sealingly engages both base 30 and tank 70. More particularly, first side 114 of mounting bracket 110 may be integrally formed with seal 126 and second side 116 may be integrally formed with seal 124 for base 30. Other alternative embodiments of the present disclosure may integrally couple flush tube 82 with mounting bracket 110 and seals 124, 126.

Referring to FIGS. 1-4, tank 70 may have a generally rectangular cross-section, or may be defined by other shapes in cross-section. Illustratively, tank 70 includes a bottom wall 74 and side walls 76 extending upwardly therefrom. Bottom wall 74 includes outlet aperture 72 which receives flush tube 82. Additionally, a lid 78 may rest atop walls 76. As with bowl 60 and base 30, tank 70 may be comprised of a ceramic, metal, or polymeric material. For example, tank 70 may be comprised of porcelain, stainless steel, or plastic composite materials.

Tank 70 may include a recessed portion 75 projecting inwardly from one of sides 76 (FIGS. 3 and 4). Recessed portion 75 is configured to receive supply tube 22 between the water supply and fill valve assembly 130. Tank 70 further supports flush valve assembly 80, fill valve assembly 130, and overflow assembly 150 therein.

Figure 8:
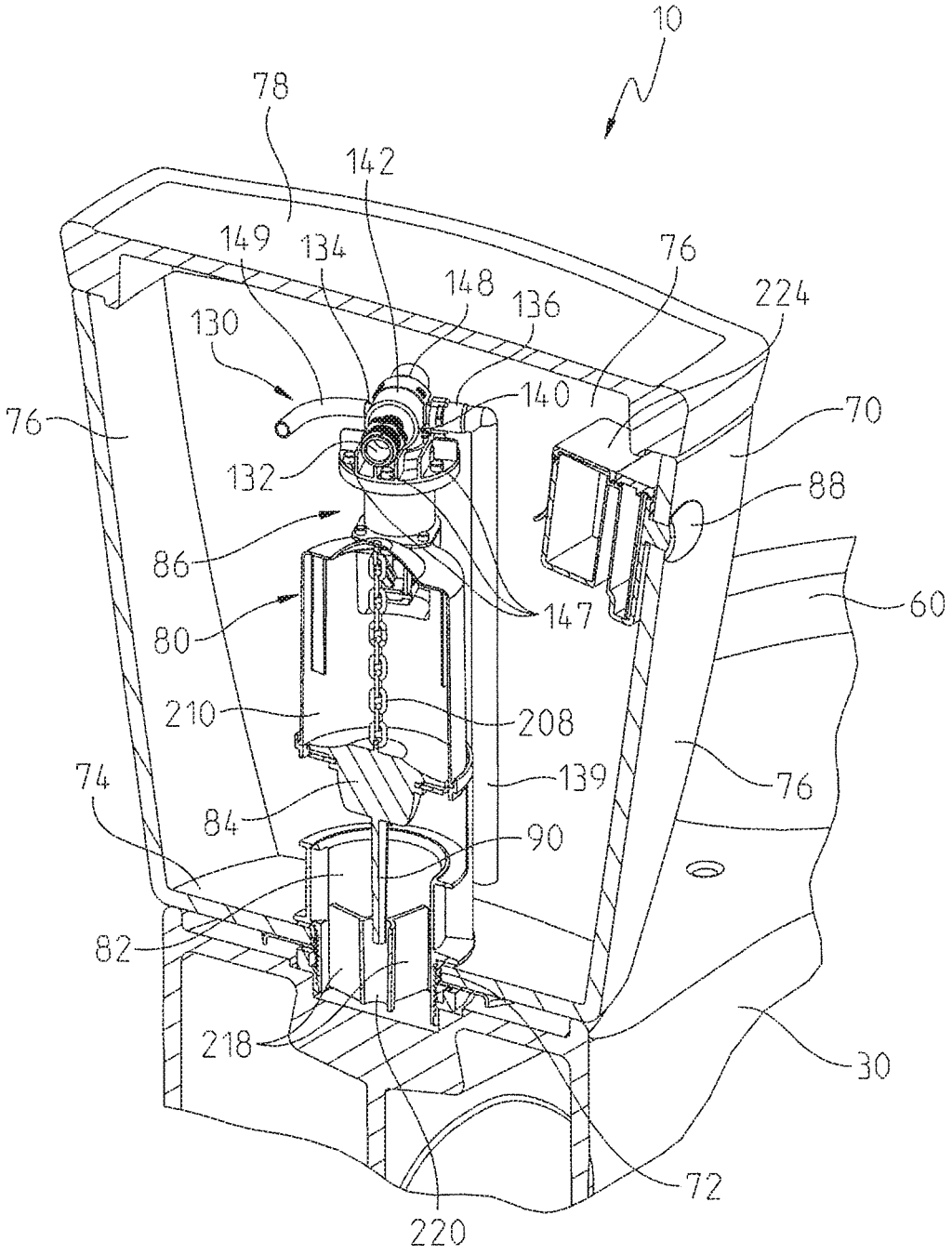
FIG. 8 is a rear perspective view, in cross-section, of the tank of the toilet, illustrating a fill valve assembly and flush valve assembly positioned within the tank.

As shown in FIGS. 8 and 9, fill valve assembly 130 includes an inlet 132, a bowl refill outlet 134, a tank refill outlet 136, a flush actuator outlet 138 (FIG. 10), a valve assembly 140, a housing 142, and a bowl overflow sensor 226 (FIG. 4). Illustratively, bowl overflow sensor 226 is coupled to base 30 with adhesive or other similar materials, which may eliminate the need for invasive fasteners, such as bolts or screws, which would penetrate base 30 and form a potential leakage point. Bowl overflow sensor 226 is configured to detect an overflow condition, such as when the water level in bowl 60 rises above a predetermined, critical level, in order to prevent bowl 60 from overflowing. In particular, bowl overflow sensor 226 may prevent operation of valve assembly 140 when an overflow condition is detected. Alternatively, when an overflow condition is not signaled by bowl overflow sensor 226, a controller 230 (FIG. 19) may be used to send a signal to valve assembly 140 to initiate a flush cycle, as is further detailed herein. Bowl overflow sensor 226 may be a piezoelectric element, an infrared sensor, a radio frequency ("RF") device, or a capacitive sensor, for example.

Housing 142 may include an upper portion 144 and a lower portion 146. Illustratively, upper portion 144 supports inlet 132, outlets 134, 136, 138, and valve assembly 140. Lower portion 146 may be coupled to flush valve assembly 80 with fasteners 147, such as screws or bolts. Fill valve assembly 130 may be comprised of a polymeric material to limit contact between the water and metallic components. Alternatively, fill valve assembly 130 may be lined with a non-metallic material. As such, fill valve assembly 130 is illustratively electrically non-conductive.

Inlet 132 is fluidly coupled with supply tube 22. More particularly, inlet 132 may include external threads 133 that couple with a nut 131 to join supply tube 22 thereto. One of side walls 76 of tank 70 may include an internal support member or bracket (not shown) to support the connection between supply tube 22 and inlet 132. In particular, the connection between supply tube 22 and inlet 132 may occur within tank 70.

Valve assembly 140 is positioned within housing 142 and is in fluid communication with inlet 132, bowl refill outlet 134, tank refill outlet 136, and flush actuator outlet 138. Valve assembly 140 may be an electrically operable valve, for example an electromechanical valve, and illustratively is a solenoid valve of the latching-type having a valve seat 160, a diaphragm 162, a shaped portion 164, illustratively a V-shaped groove, a pilot hole 166, a seal 168, o-rings 170, a magnet 172, a pole 174, an armature 176, and a spring 178, as shown in FIGS. 18A and 18B.

Figure 19:
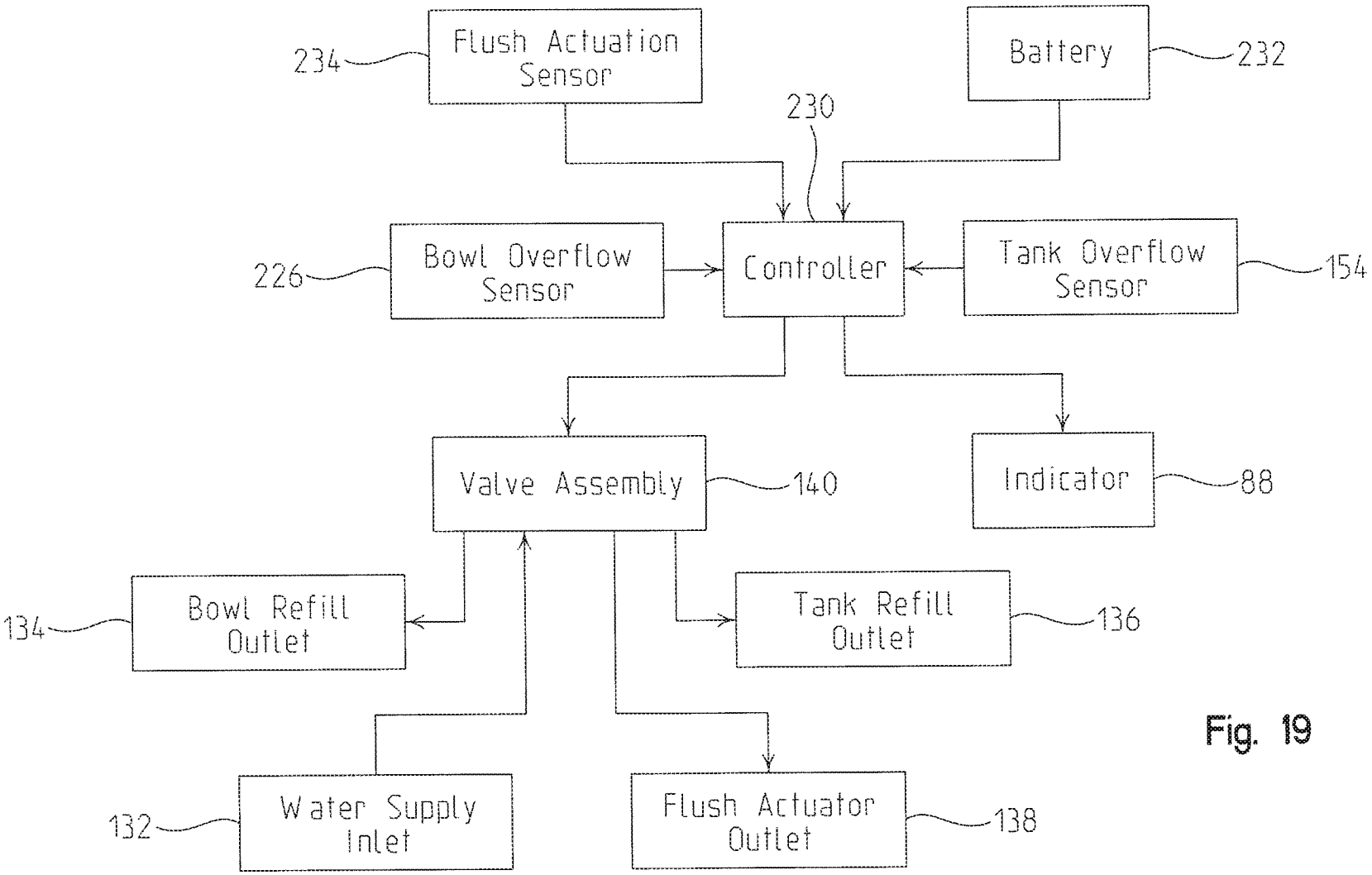
FIG. 19 is a diagrammatic view of various operating components of the toilet of FIG. 1, illustrating a plurality of inputs and outputs relative to a controller.

Valve assembly 140 is in electrical communication with controller 230 (FIG. 19). During operation of toilet 10, valve assembly 140 receives signals from controller 230 in order to control the flow of water from inlet 132 to bowl refill outlet 134, tank refill outlet 136, and flush actuator outlet 138, as further detailed herein. More particularly, valve assembly 140 may be actuated by controller 230 to magnetically attract armature 176 to pole 174, thereby allowing water from inlet 132 to flow between valve seat 160 and diaphragm 162, and into outlets 134, 136, 138. Valve assembly 140 may be comprised of polymeric or other electrically nonconductive materials.

Figure 18A:
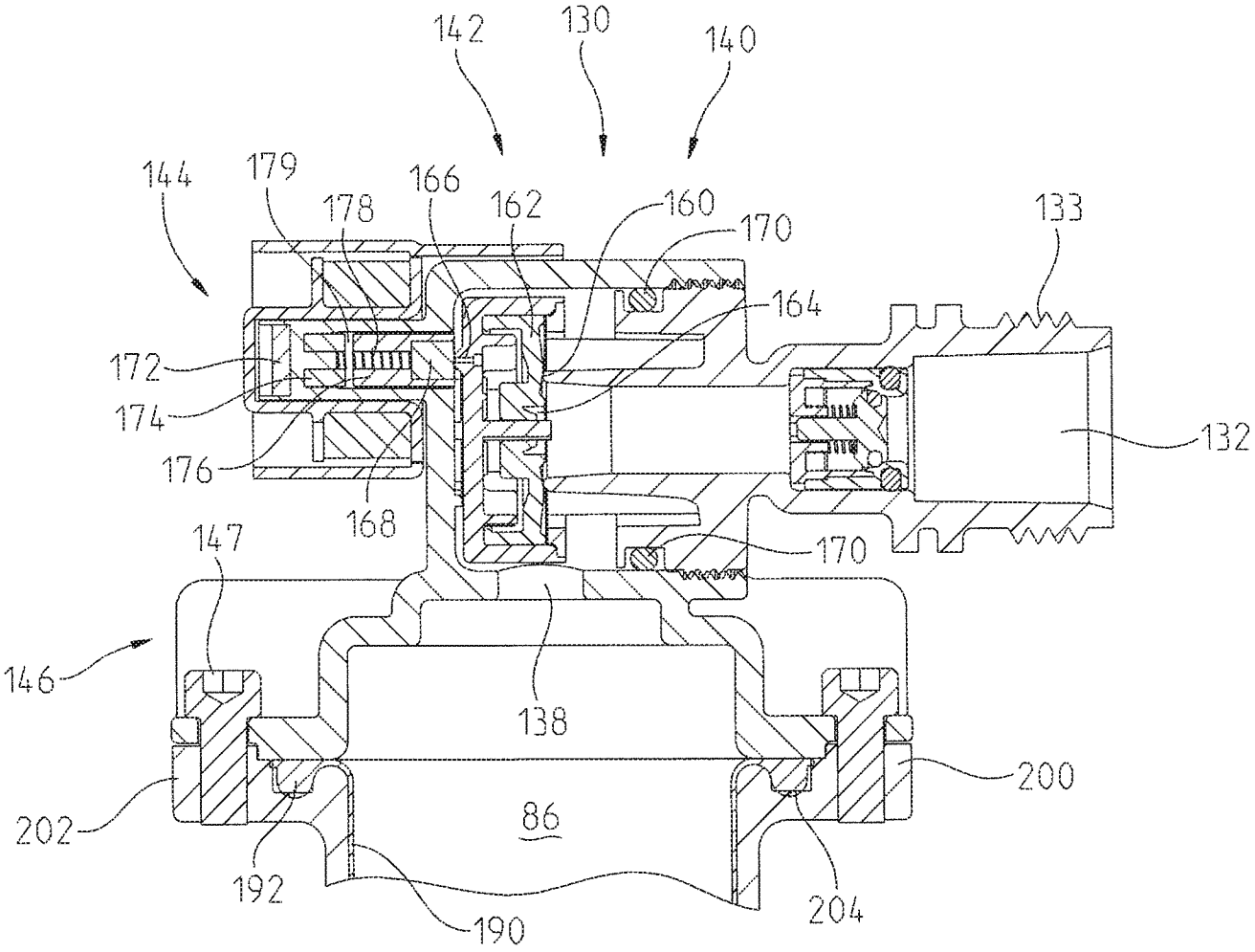
FIG. 18A is a cross-sectional view of an electrically operable valve assembly in a closed position.
Figure 18B:
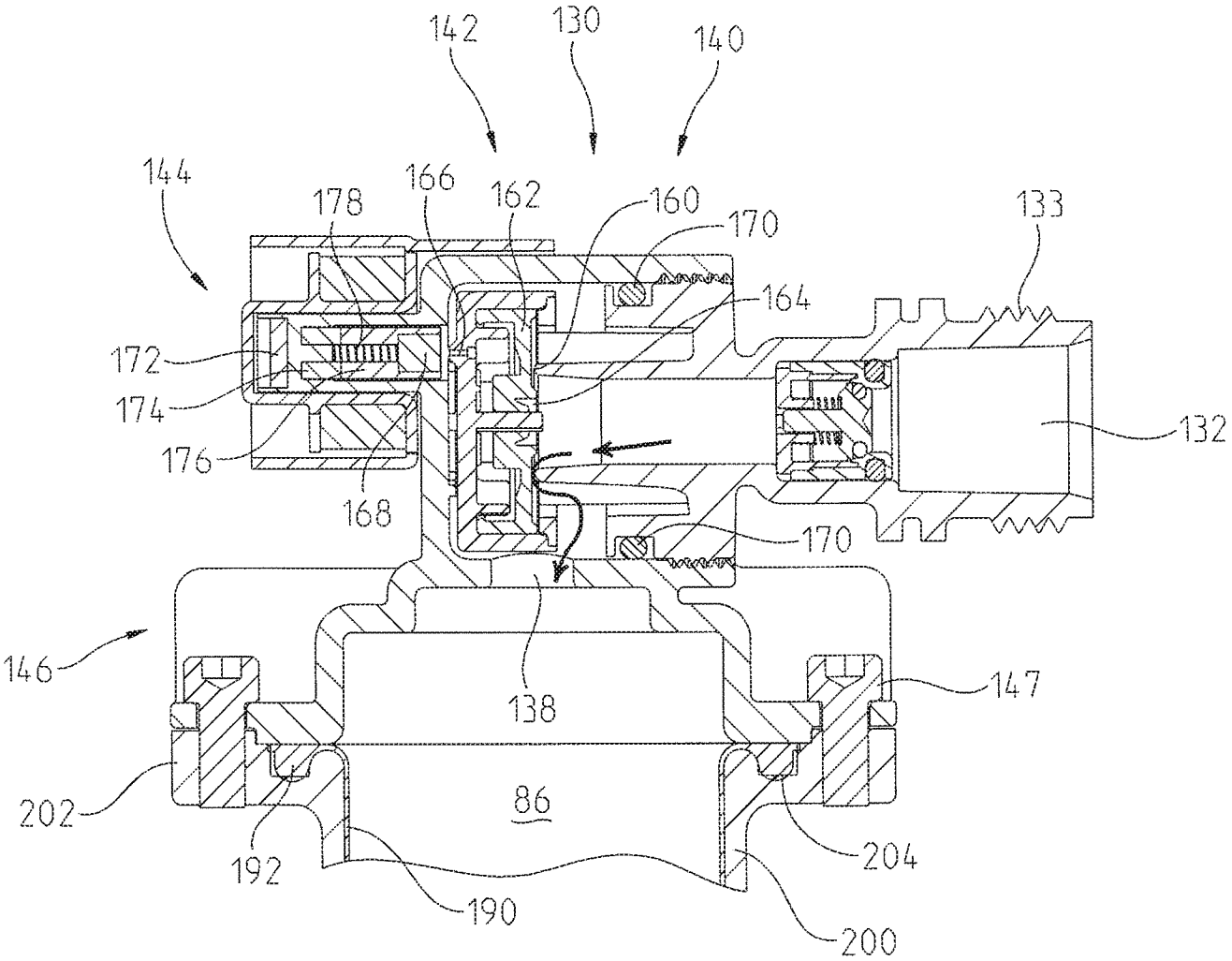
FIG. 18B is a cross-sectional view of the electrically operable valve assembly in an open position.

As shown in FIG. 18A, when valve assembly 140 is in the closed position, diaphragm 162 engages valve seat 160 due to the force behind diaphragm 162. More particularly, the force behind diaphragm 162 is sufficient to overcome the force at the front of diaphragm 162. The resulting force behind diaphragm 162 is due to water pressure at opposing front and rear surfaces of diaphragm 162 in combination with surface area differences between the front and rear of diaphragm 162. While the pressure at the front and rear of diaphragm 162 may be equalized (due to water flow through shaped portions 164), the greater surface at the rear of diaphragm 162 creates a greater force behind diaphragm 162. As such, diaphragm 162 engages with valve seat 160 such that water may not pass between diaphragm 162 and valve seat 160, thereby preventing water from flowing into outlets 134, 136, 138.

The force behind diaphragm 162 may be created when armature 176 is spaced apart from pole 174. A gap 179 may be defined by the space between armature 176 and pole 174 when valve assembly 140 is in the closed position. In particular, spring 178 biases armature 176 away from pole 174 in order to position seal 168 against pilot hole 166. When pilot hole 166 is sealed, a force is maintained behind diaphragm 162 to sealingly engage diaphragm 162 with valve seat 160.

However, as shown in FIG. 18B, when valve assembly 140 has been actuated by controller 230, a short electrical pulse is provided in order to move armature 176 toward pole 174. When the electrical pulse is discontinued, armature 176 will remain latched to, or otherwise in contact with, pole 174 due to a magnetic attraction to magnet 172. This magnetic force is sufficient to overcome the bias in spring 178 to allow armature 176 to move toward pole 174 and close gap 179. When armature 176 contacts pole 174, seal 168 moves with armature 176 and is pulled away from pilot hole 166, which creates a pressure and force differential in valve assembly 140. In particular, the pressure behind diaphragm 162 is reduced because pilot hole 166 is no longer sealed. As such, diaphragm 162 may flex, bend, or otherwise move in response to the force from the water at inlet 132. As such, water may flow between diaphragm 162 and valve seat 160 in order to flow into outlets 134, 136, 138.

When it is necessary to close valve assembly 140, a short electrical pulse is provided in order to generate a magnetic force opposite that of magnet 172. The opposing magnetic force unlatches armature 176 from pole 174 in order to move armature 176 toward seal 168. Spring 178 facilitates the movement of armature 176 toward seal 168 because the electrical pulse has a short duration, for example 25 milliseconds.

The illustrative embodiment of fill valve assembly 130 includes outlets 134, 136, 138, however, any number of outlets may be included to accommodate particular applications of fill valve assembly 130. Bowl refill outlet 134 may be integrally formed with housing 142 and extend from housing 142. Illustratively, bowl refill outlet 134 may be generally positioned within housing 142 adjacent inlet 132. Additionally, bowl refill outlet 134 may be fluidly coupled to a bowl refill tube 149, which illustratively extends from bowl refill outlet 134 to an overflow tube 152 of overflow assembly 150. Bowl refill tube 149 may be smaller in diameter than overflow tube 152 such that it is conventionally received therein.

As shown in FIGS. 8 and 9, tank refill outlet 136 may be positioned within housing 142 adjacent inlet 132, and generally opposite bowl refill outlet 134. In particular, tank refill outlet 136 may be integrally formed with housing 142 to extend outwardly from housing 142. Tank refill outlet 136 is fluidly coupled a tank refill tube 139. Tank refill tube 139 extends downwardly from tank refill outlet 136 and may be positioned near bottom wall 74 of tank 70. As such, the position of tank refill tube 139 may prevent water splashing and a user from hearing the water from tank refill tube 139 contacting bottom wall 74 of tank 70 when tank 70 is being refilled.

Flush actuator outlet 138 may be a conduit extending from housing 142 to flush valve assembly 80. In this way, fill valve assembly 130 is fluidly coupled to flush valve assembly 80 through flush actuator outlet 138.

Figure 10:
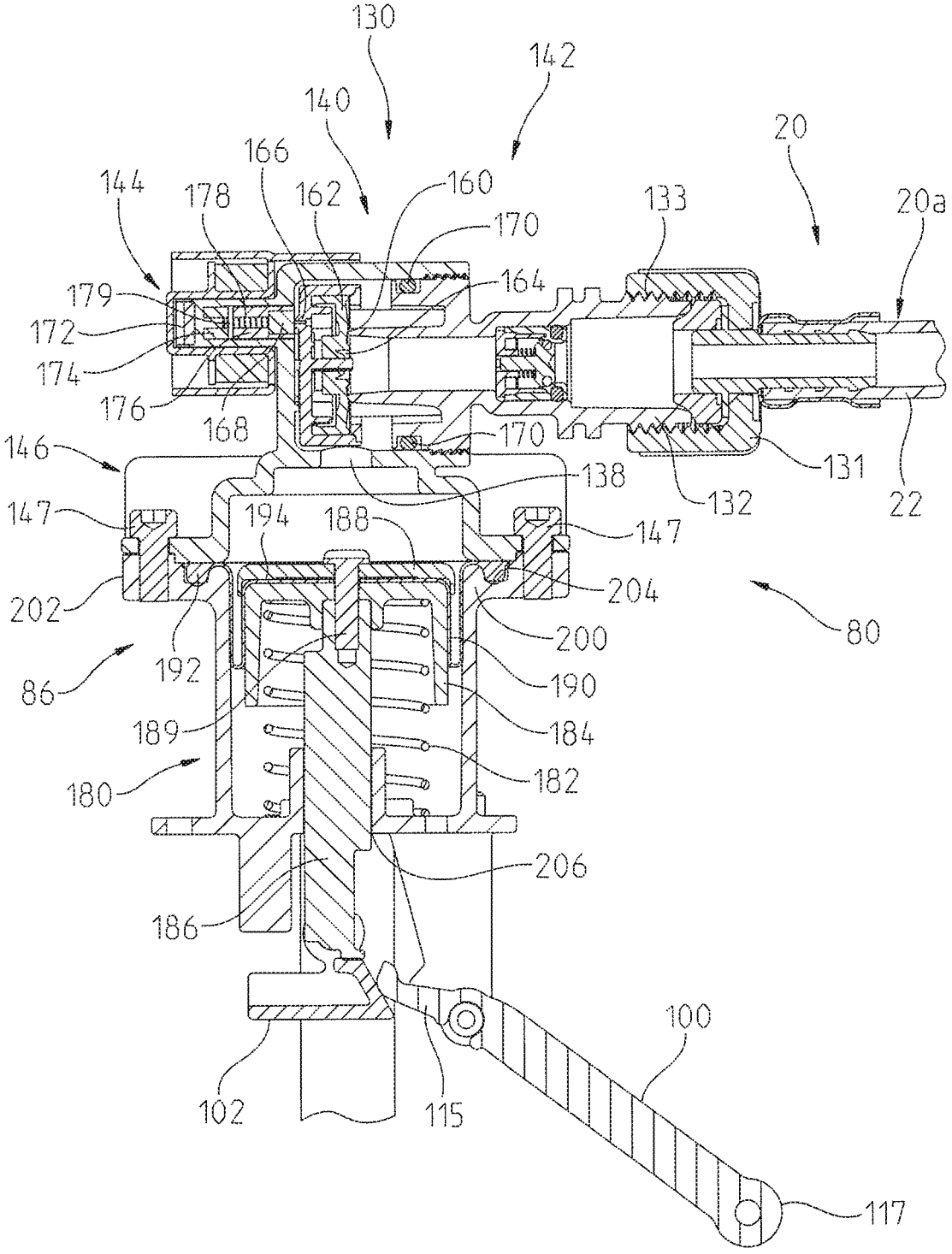
FIG. 10 is a cross-sectional view of the fill valve assembly and a portion of the flush valve assembly, taken along line 10-10 of FIG. 9.

Referring to FIGS. 8-10, flush valve assembly 80 includes flush tube 82, flush valve flapper 84, a flush actuator assembly 86, an indicator 88, and a flush actuation sensor 234 (FIG. 19). Flush actuation sensor 234 cooperates with indicator 88 (FIG. 8) and controller 230 (FIG. 19) in order to initiate a flush cycle. Indicator 88 may be coupled to tank 70 and extend therefrom, as shown in FIG. 8. More particularly, indicator 88 and controller 230 may be coupled to the same side wall 76 of tank 70 such that side wall 76 of tank 70 is intermediate flush indicator 88 and controller 230. Illustratively, controller 230 may be positioned within a waterproof box or casing 224 in tank 70 (FIG. 8). Casing 224 may also house at least one battery 232 (FIG. 19) in order to supply power to controller 230. Additionally, other electronic components may be housed within casing 230. Alternatively, indicator 88 may include a sensor electrically coupled to controller 230.

Flush actuation sensor 234 may be a piezoelectric element, an infrared sensor, a radio frequency ("RF") device, a mechanical latching switch, or a capacitive sensor, for example. Flush actuation sensor 234 is configured to receive a user input and is in electronic communication with controller 230 (FIG. 19). In one illustrative embodiment, flush actuation sensor 234 may be a capacitive sensor, using touch or hands-free proximity sensing. By incorporating capacitive sensing into toilet 10, a single microchip may be used to electrically communicate with flush actuation sensor 234, bowl overflow sensor 226, and a tank fill sensor 154 (FIG. 9). Additionally, capacitive sensing may allow bowl overflow sensor (FIG. 4) to sense through base 30 without adding holes to base 30. Furthermore, as is known, capacitive sensing provides for robust electrical communication and may be less expensive than other sensing mechanisms.

As shown in FIG. 10, flush actuator assembly 86 may include a piston assembly 180 coupled to a diaphragm 190 within a cylinder 200. Cylinder 200 includes an upper shoulder 202 that couples with lower portion 146 of housing 142 through fasteners 147. Shoulder 202 illustratively includes a channel 204 which receives a lip 192 of diaphragm 190. As such, lip 192 of diaphragm 190 is positioned within channel 204 between shoulder 202 and lower portion 146 of housing 142. A sealing end 194 of diaphragm 190 may be coupled to piston assembly 180 with a screw 189. As such, sealing end 194 of diaphragm 190 may form a seal between piston assembly 180 and lower portion 146 of housing 142. Illustratively, diaphragm 190 is a rolling diaphragm and may move with piston assembly 180, as further detailed herein. Diaphragm 190 may be comprised of a flexible elastomeric material.

Piston assembly 180 illustratively includes a spring 182, piston 184, a piston rod 186, and a retainer plate 188 coupled to the top of piston 184 with screw 189 or other fastener. Piston 184 is coupled to sealing end 194 of diaphragm 190 via retainer plate 188 and screw 189. As such, retainer plate 188 also fluidly seals piston assembly 180 from housing 142. In operation, water pressure may be used to engage flush actuator 86. Additionally, a lower surface of cylinder 200 may include apertures 203 for releasing or exhausting air from cylinder 200 during operation of flush actuator assembly 86.

Piston 184 may have a generally round shape that is substantially hollow (e.g., inverted cup shape). At least a portion of spring 182 and piston rod 186 are illustratively positioned within piston 184. Piston rod 186 may be coupled to piston 184 via screw 189. Piston rod 186 extends downwardly from piston 184 and through an aperture 206 in cylinder 200 to extend below cylinder 200. As shown in FIG. 10, piston rod 186 may be selectively coupled to lever arm 100 through a piston lever 102. Piston lever 102 may be pivotably coupled to piston rod 186 and is configured to selectively engage lever arm 100.

Lever arm 100 includes a first end 115 and an opposing second end 117. First end 115 is adjacent piston lever 102 and may be in contact with piston lever 102 during a flush cycle of toilet 10. Second end 117 is illustratively coupled to flapper 84 through a chain 208. Chain 208 is positioned within a cylindrical housing 210 and raises and lowers flapper 84 with the movement of lever arm 100 during the flush cycle.

Referring to FIG. 9, flapper 84 of flush valve assembly 80 is positioned within a frame 212 coupled to housing 210. More particularly, housing 210 is illustratively coupled to the top of frame 212. Housing 210 may be configured for rotation relative to frame 212 in order to accommodate various sizes and spatial arrangements of tank 70 and waterway assembly 20. Frame 212 includes frame members or uprights 214 that are circumferentially spaced apart from each to define radial apertures 216. Frame 212 may be coupled to flush tube 82 below apertures 216 and frame members 214 in order to provide an outlet for flush valve assembly 80. Illustratively, frame 212 is integrally coupled to flush tube 82, although alternative embodiments of frame 212 and flush tube 82 may be removably coupled to each other using conventional fasteners.

As shown in FIGS. 7-9, flush tube 82 may be a cylindrical, or tubular, structure. Flush tube 82 is fluidly coupled to inlet 68 of bowl 60. An outer surface of flush tube 82 may include external threads 83 in order to receive nut 122 when coupling base 30 to tank 70. Flush tube 82 may include support members 218 (FIG. 8) extending inwardly to define a channel 220 for a guide rod 90 of flapper 84. Additionally, flush tube 82 may be fluidly coupled to overflow assembly 150.

Figure 11:
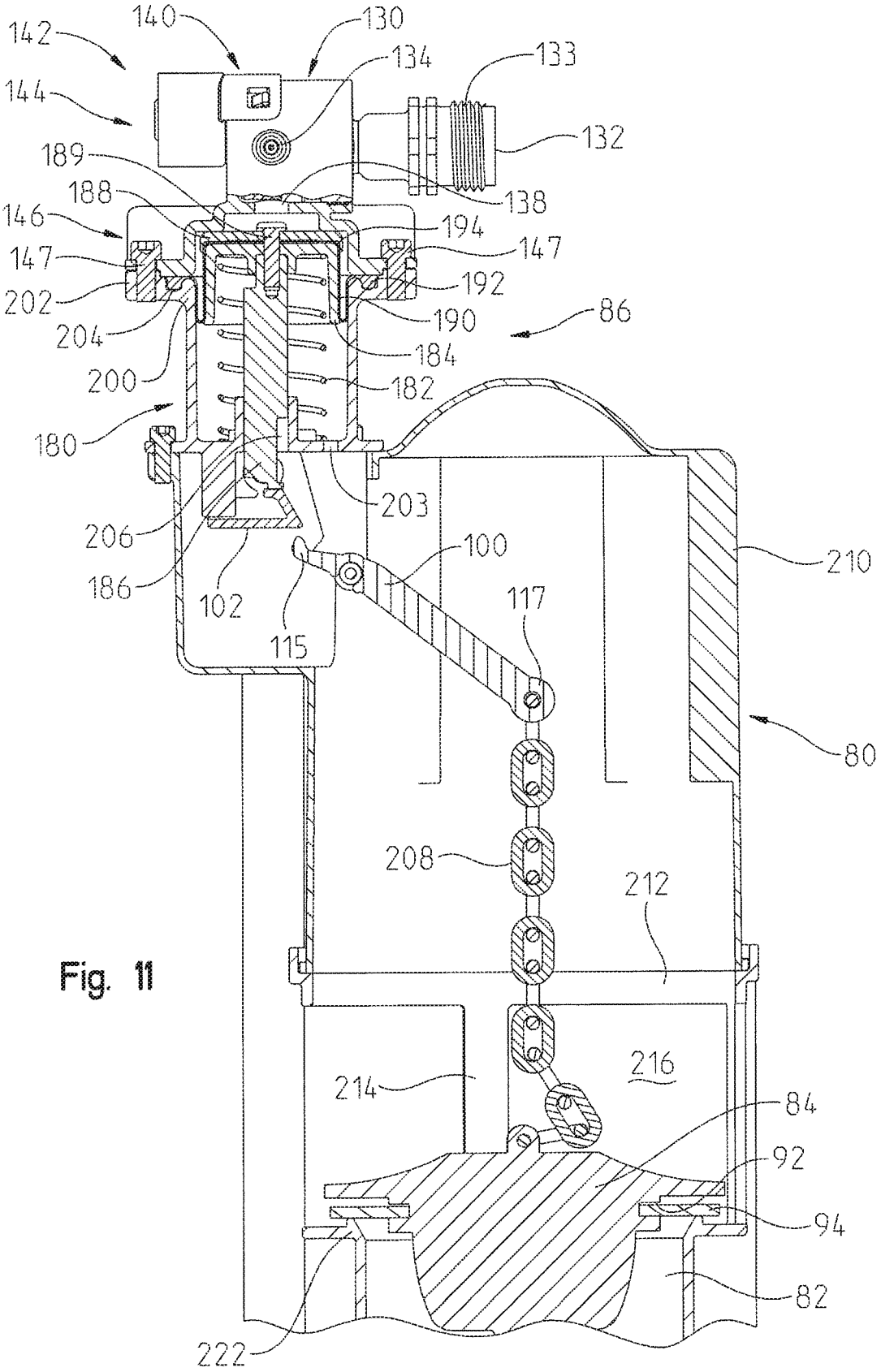
FIG. 11 is a cross-sectional view of the flush valve assembly in a closed position illustrating an initial stage of a flush cycle of the toilet of the present disclosure.

As shown in FIG. 11, flapper 84 may include a channel 92 that receives a seal 94. Flapper 84 is configured for axial movement within frame 212 and flush tube 82. Seal 94 also may move with flapper 84. Additionally, guide rod 90 facilitates the axial movement of flapper 84 and seal 94. Guide rod 90 is positioned within channel 220 of flush tube 82 in order to properly position flapper 84 within frame 212 during axial movement (FIG. 8).

With particular reference to FIG. 11, when flush valve assembly 80 is closed, flapper 84 engages a shoulder 222 of frame 212. As such, when flush valve assembly 80 is in the closed position, seal 94 and flapper 84 prevent water from flowing through flush tube 82 and into bowl 60. In contrast, when flush valve assembly 80 is in an open position, as shown in FIGS. 12-15, chain 208 axially pulls flapper 84 and seal 94 away from shoulder 222. More particularly, flapper 84 is held above shoulder 222 such that water may enter flush tube 82 during a flush cycle.

Referring further to FIG. 9, overflow assembly 150 includes overflow tube 152 and tank fill sensor 154 coupled thereto. Overflow tube 152 is a cylindrical tube that is open at an upper end 156 and a lower end 158 thereof. Upper end 156 of overflow tube 152 is in fluid communication with bowl refill tube 149 and illustratively has a larger diameter than bowl refill tube 149 such that bowl refill tube 149 is concentrically received within overflow tube 152. Furthermore, lower end 158 of overflow tube 152 is in fluid communication with flush tube 82 of flush valve assembly 80. As such, water entering upper end 156 of overflow tube 152 flows down overflow tube 152, through lower end 158 and flush tube 82, and into bowl 60. More particularly, if the water level in tank 70 rises above upper end 156 of overflow tube 152, the water above upper end 156 is directed into bowl 60 through overflow tube 152 and flush tube 82. As such, the height or position of upper end 156 of overflow tube 152 may prevent the water in tank 70 from overflowing. Furthermore, it may be appreciated that lower end 158 is positioned below flapper 84, which allows water to flow from overflow tube 152, into flush tube 82, and into bowl 60 when flush valve assembly 80 is in both the open position and the closed position.

Tank fill sensor 154 may be coupled to the outer surface of overflow tube 152. Additionally, tank fill sensor 154 is in electronic communication with controller 230 (FIG. 19). For example, overflow sensor may be a piezoelectric element, an infrared sensor, a radio frequency ("RF") device, a mechanical latching switch, or a capacitive sensor, in wired or wireless communication with controller 230. Tank fill sensor 154 may detect an overflow condition, such as when a water level in tank 70 rises above a predetermined water level. As such, tank fill sensor 154, controller 230, and fill valve assembly 130 operate together to prevent water from overflowing from tank 70, as further detailed herein.

In use, toilet 10 may be operated by initiating the flush cycle, as shown in FIGS. 11-18. More particularly, and referring to FIG. 11, when a user desires to flush toilet 10, the user activates flush sensor 234 (FIG. 19). For example, a user's hand may be placed in proximity to (e.g., placed in front of) indicator 88 in order to trigger the flush cycle. Flush actuation sensor 234 receives the user input and sends a signal to controller 230, which may initiate operation of flush valve assembly 80 and fill valve assembly 130. Before initiating the flush cycle, controller 230 (FIG. 19) receives signals from bowl overflow sensor 226 to determine if the water level in bowl 60 is below the predetermined critical water level. If the water level in bowl 60 is below the critical level, then controller 230 will initiate the flush cycle. Conversely, if bowl overflow sensor 226 signals to controller 230 that the water level in bowl 60 is above the critical level, controller 230 will not initiate a flush cycle.

In response to the signal from flush actuation sensor 234, controller 230 sends a signal to fill valve assembly 130, which initiates the flush cycle (FIG. 19). In particular, when valve assembly 140 is actuated, armature 176 of valve assembly 140 moves toward pole 174 to close gap 179 and unseal pilot hole 166, thereby allowing a portion of diaphragm 162 to flex away from valve seat 160 (FIG. 18B). Water from supply tube 22 may flow between valve seat 160 and diaphragm 162 to provide fluid communication between inlet 132 and bowl refill outlet 134, tank refill outlet 136, and flush actuator outlet 138.

Figure 12:
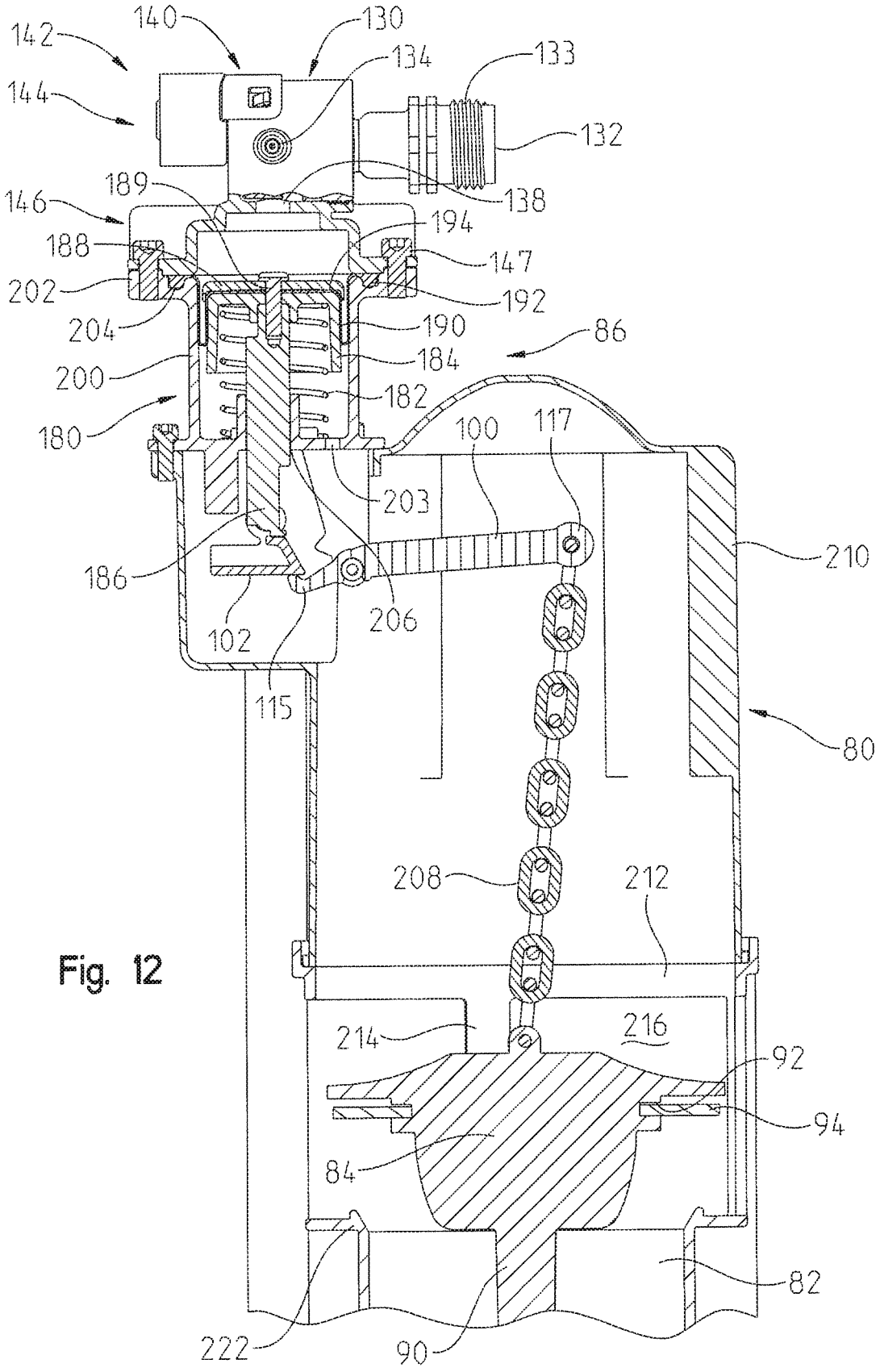
FIG. 12 is a cross-sectional view of the flush valve assembly in an initial open position, illustrating the flush cycle after the flush valve assembly has been open opened.

Water flows from supply tube 22, through inlet 132, into valve assembly 140, through flush actuator outlet 138, and into flush actuator assembly 86. The incoming water pressurizes flush actuator assembly 86 and, more particularly, depresses diaphragm 190, thereby causing piston 184 to move axially downward in cylinder 200, as shown in FIG. 12. The water pressure is sufficient to overcome the bias in spring 182 in order to lower piston 184 and compress spring 182. For example, the pressure in flush actuator assembly 86 may be 10-15 psi in order to overcome the bias of spring 182 and initiate movement of diaphragm 190.

The downward movement of piston 184 causes piston rod 186 to also move downwardly. At the initiation of the flush cycle, piston rod 186 and piston lever 102 are spaced apart from lever arm 100 (FIG. 11). However, as piston rod 186 is pushed further downward by the water pressure applied to diaphragm 190 and piston 184, piston lever 102 contacts first end 115 of lever arm 100 (FIG. 12). In response, lever arm 100 pivots upwardly in housing 210. More particularly, second end 117 of lever arm 100 moves upwardly, thereby pulling chain 208 upwardly in tension.

Figure 13:
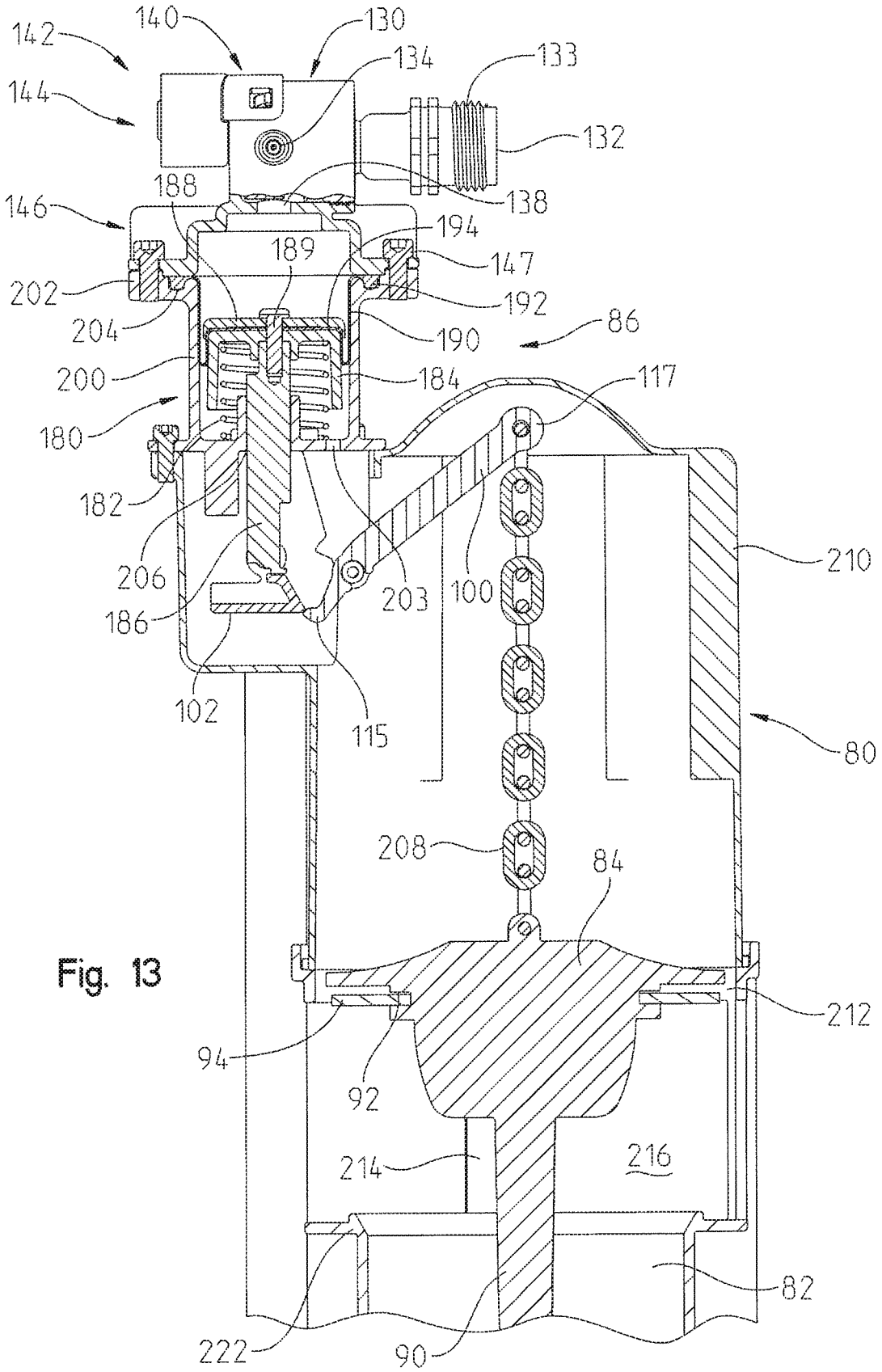
FIG. 13 is an additional cross-sectional view of the flush valve assembly in the open position, illustrating a later stage of the flush cycle.

Referring to FIGS. 12 and 13, the upward movement of chain 208 causes flush valve assembly 80 to open. Illustratively, flush valve assembly 80 opens when flapper 84 moves away from flush tube 82 in response to the upward movement of chain 208 and second end 117 of lever arm 100. As flush valve assembly 80 opens, water from tank 70 flows through apertures 216 and into flush tube 82 in order to enter bowl 60 via inlet 68. As such, substantially all of the water in tank 70 may flow into bowl 60 when flush valve assembly 80 is open. The sudden increase in water in bowl 60 creates a siphon effect in trapway 24, whereby fluid and other contents of bowl 60 are pulled or suctioned out of bowl 60 and into trapway 24 and drain 26.

Figure 14:
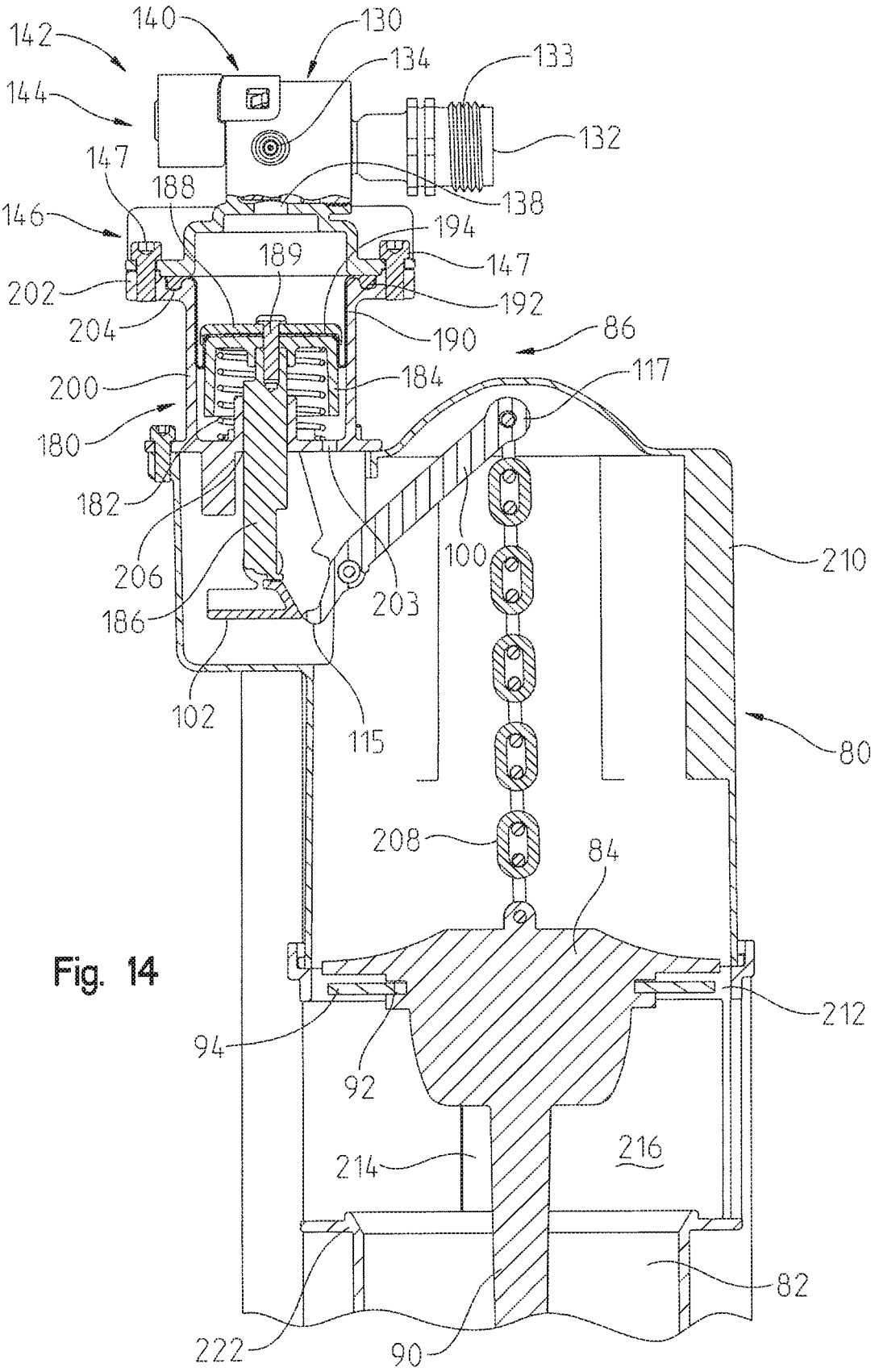
FIG. 14 is a cross-sectional view of the flush valve assembly in the open position, illustrating a lever arm at full travel during the flush cycle.
Figure 15:
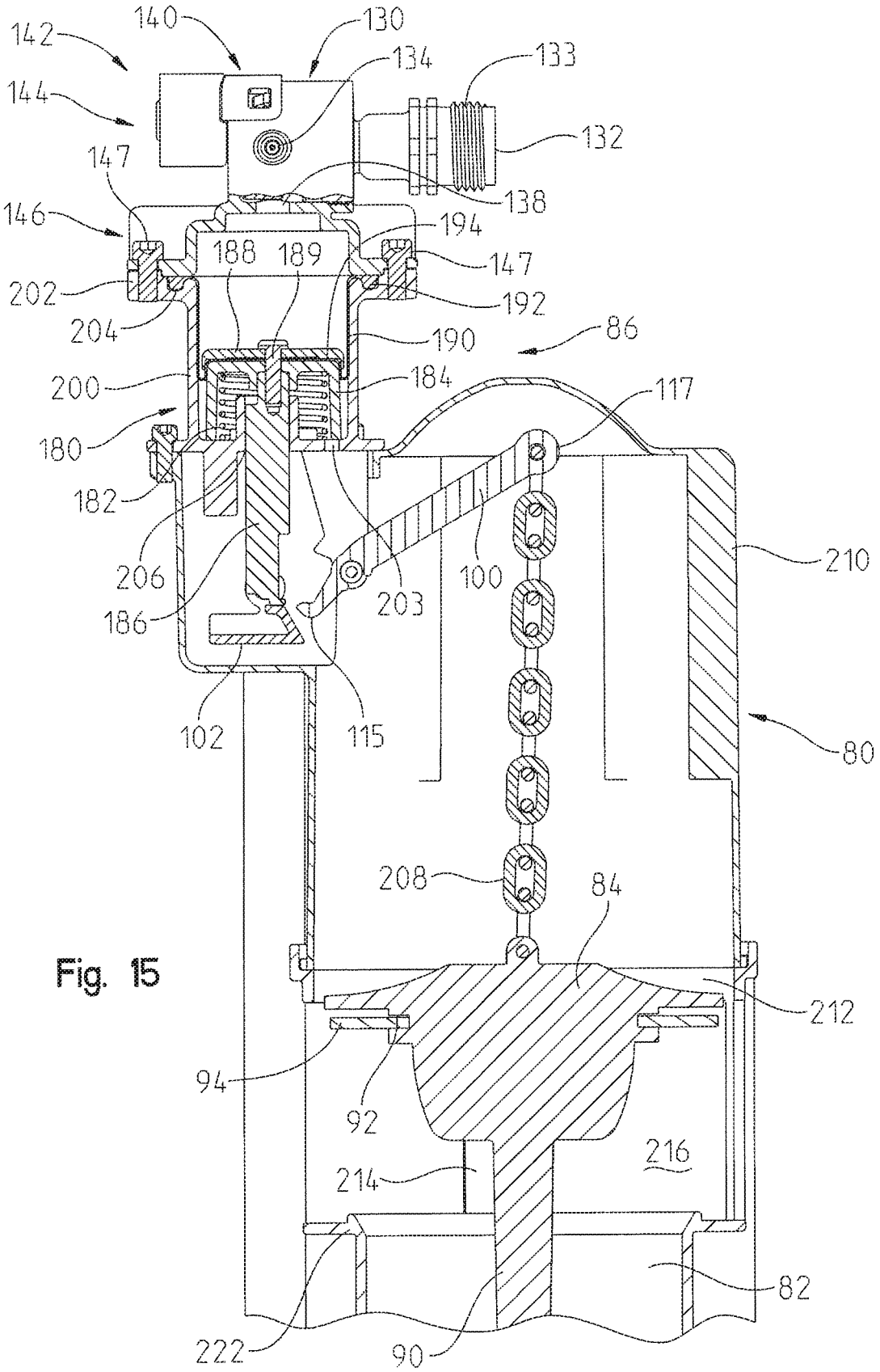
FIG. 15 is a cross-sectional view of the flush valve assembly, illustrating the lever arm pivoting downwardly to close the flush valve assembly.
Figure 16:
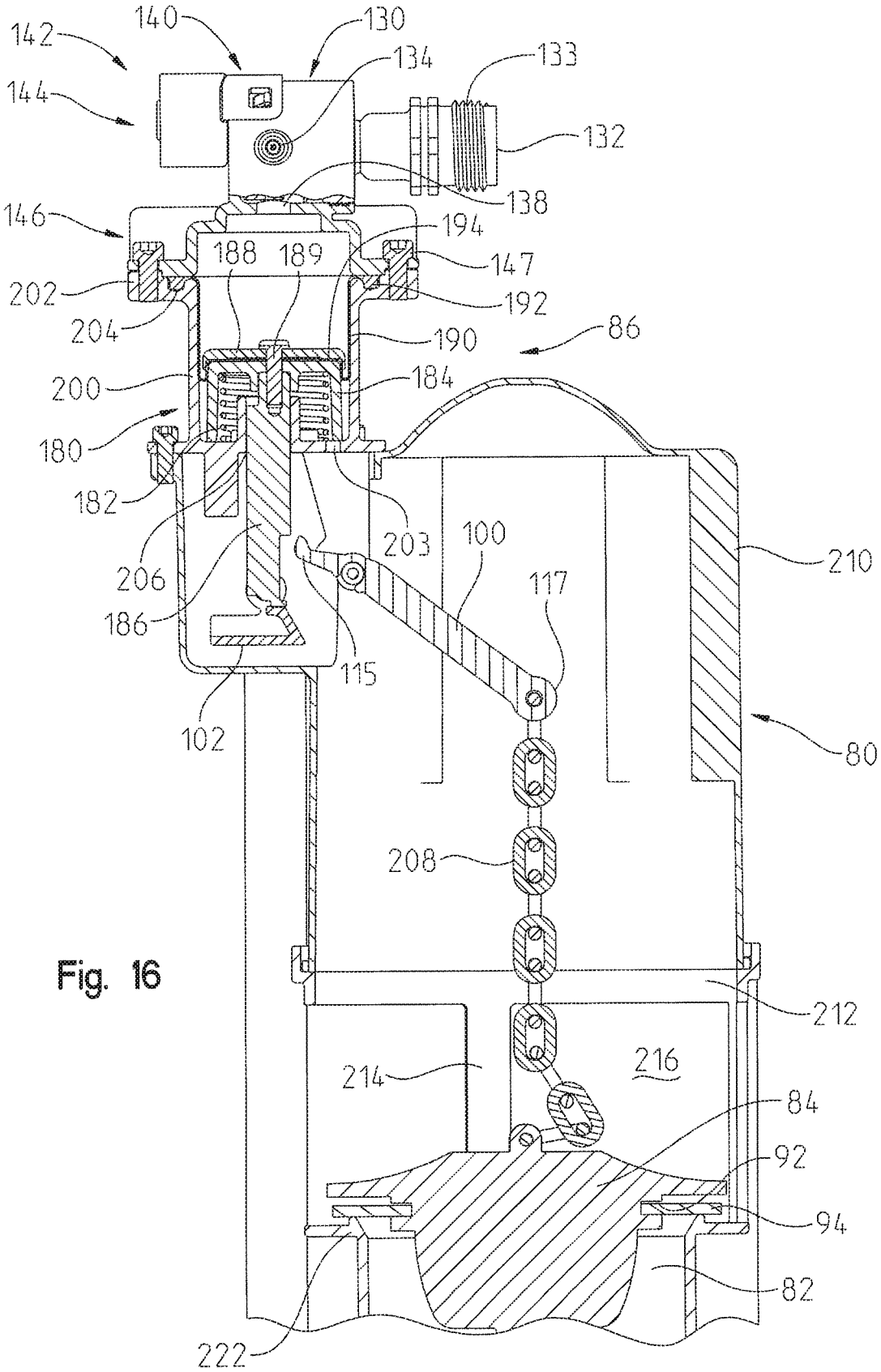
FIG. 16 is a cross-sectional view of the flush valve assembly in the closed position at a further stage of the flush cycle.

As shown in FIGS. 14 and 15, at full travel, first end 115 of lever arm 100 slips past piston lever 102. As such, piston lever 102 is clear of lever arm 100 and may no longer be in contact therewith. Second end 117 of lever arm 100 pivots downwardly to its original position due to its weight and the weight of chain 208 (FIG. 16). The downward movement of lever arm 100 simultaneously releases the tension on chain 208, however, flapper 84 may remain in an open position while water is in tank 70. More particularly, due to buoyancy, flapper 84 may initially remain open when water is in tank 70. However, as the water level in tank 70 decreases, flapper 84 may close due to a loss of buoyancy and a decrease in the velocity of the water flowing from tank 70 into bowl 60. For example, flapper 84 may include a plurality of holes (not shown) which allow water to flow into flapper 84, thereby decreasing its buoyancy. As such, flapper 84 may move downwardly through the water in tank 70 and close while water is still in tank 70. The holes in flapper 84 may be arranged according to predetermined conditions of the flush cycle, such as flush volume (e.g., 1.28 gallons/flush) and the desired duration of the flush cycle. Valve assembly 80 is closed when flapper 84 is seated on shoulder 222 of frame 212 in order to retain water in tank 70.

After flush valve assembly 80 closes, tank 70 and bowl 60 may be refilled with water. In order to refill tank 70 and bowl 60 after toilet 10 has been flushed, valve assembly 140 remains in the open position such that bowl refill outlet 134, tank refill outlet 136, and flush actuator outlet 138 remain open. Water from supply tube 22 flows through bowl refill outlet 134 and into bowl refill tube 149 in order to flow through overflow tube 152 and into bowl 60 via flush tube 82. As detailed herein, lower end 158 of overflow tube 152 is fluidly coupled to flush tube 82 below flapper 84 such that water from overflow tube 152 may flow into bowl 60 when flush valve assembly 80 is closed.

While bowl 60 is being refilled, water from supply tube 22 also may flow through tank refill outlet 136 and into tank refill tube 139 in order to replenish the water in tank 70. With flush valve assembly 80 in the closed position, the water flowing from tank refill tube 139 remains in tank 70. Tank refill sensor 154 may be used to indicate to controller 230 when tank 70 has been sufficiently replenished with water. Fill valve assembly 130 may be calibrated such that bowl 60 and tank 70 are sufficiently replenished with water at approximately the same time. Any excess water in tank 70 may flow into overflow tube 152, through flush tube 82, and into bowl 60 in order to spill over into trapway 24. However, under normal or correct operation of tank refill sensor 154, there is no excess water in tank 70.

Flush actuator assembly 86 may remain pressurized when inlet 132 and outlets 134, 136, 138 are open, such that diaphragm 190, piston 184, and piston rod 186 remain depressed. In order to relieve the pressure in flush actuator assembly 86, valve assembly 140 moves to the closed position. With particular reference to FIG. 18A, a magnetic force is no longer generated and the bias of spring 178 pushes armature 176 away from pole 174. As such, pilot hole 166 is sealed, thereby pressurizing diaphragm 162 and preventing water flow between valve seat 160 and diaphragm 162. More particularly, the force behind diaphragm 162 overcomes the force at the front of diaphragm 162 (i.e., the force created by the water at inlet 132) such that diaphragm 162 does not flex in response thereto.

Figure 17:
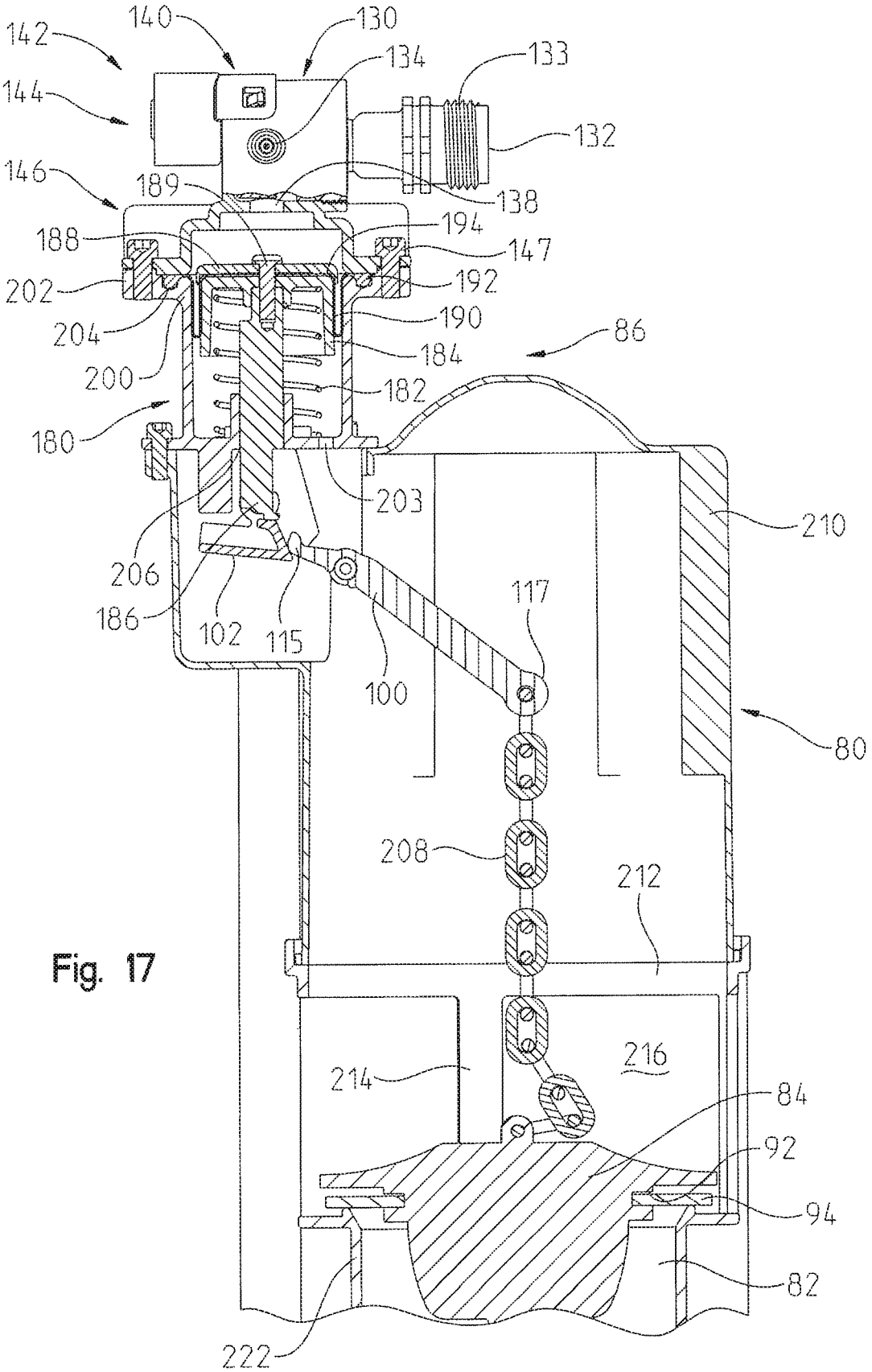
FIG. 17 is a cross-sectional view of the flush valve assembly at the end of the flush cycle.

With inlet 132 sealed, the water depressing diaphragm 190 may flow upward through flush actuator outlet 138 in order to be released through outlets 134, 136 while tank 70 and bowl 60 are being refilled. Alternatively, fill valve assembly 130 may include a separate bleed hole (not shown) to release the water in flush actuator assembly 86. By reducing the water pressure in flush actuator assembly 86, diaphragm 190, piston 184, spring 182, and piston rod 184 move upwardly due to the bias of spring 182, as shown in FIG. 17. This upward movement allows piston lever 102 to rotate over first end 115 of lever arm 100 and return to its original position (FIG. 11).

Piston lever 102 may not be in contact with lever arm 100 at the end of the flush cycle and, as such, it may be necessary for a user to wait until the pressure in flush actuator assembly 86 has been relieved before another flush cycle may be initiated. Alternative embodiments of controller 230 may be configured to send a signal to valve assembly 140 in order to initiate an additional flush cycle before tank 70 and bowl 60 have been fully refilled.

Alternative embodiments of indicator 88 may include a lens in order to be illuminated with a light source (e.g., a light-emitting diode ("LED")) or other device. As such, at least a portion of indicator 88 may be illuminated according to certain applications of the system. For example, controller 230 may illuminate indicator 88 during certain hours, such as at night, or when the lavatory is dark. For example, indicator 88 may include a photo sensor to detect the absence of light. Additionally, controller 230 may illuminate indicator 88 when it is time to change battery 232 (FIG. 19). Alternatively, indicator 88 may be illuminated with a red color to indicate that battery 232 should be changed, and a green color to indicate that battery 232 is sufficiently supplying power.

Figure 20:
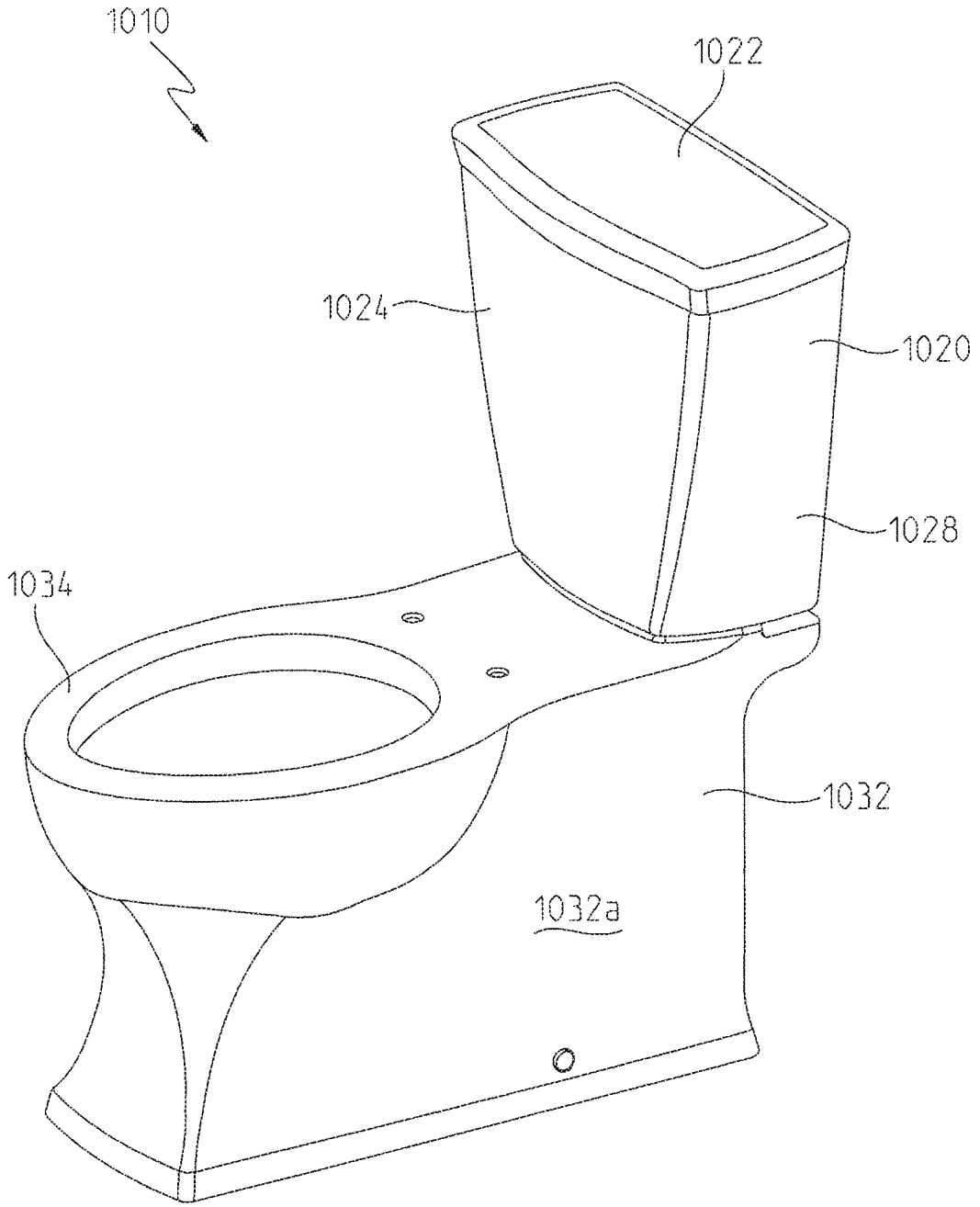
FIG. 20 is a front perspective view of an illustrative alternative embodiment toilet of the present disclosure.
Figure 21:
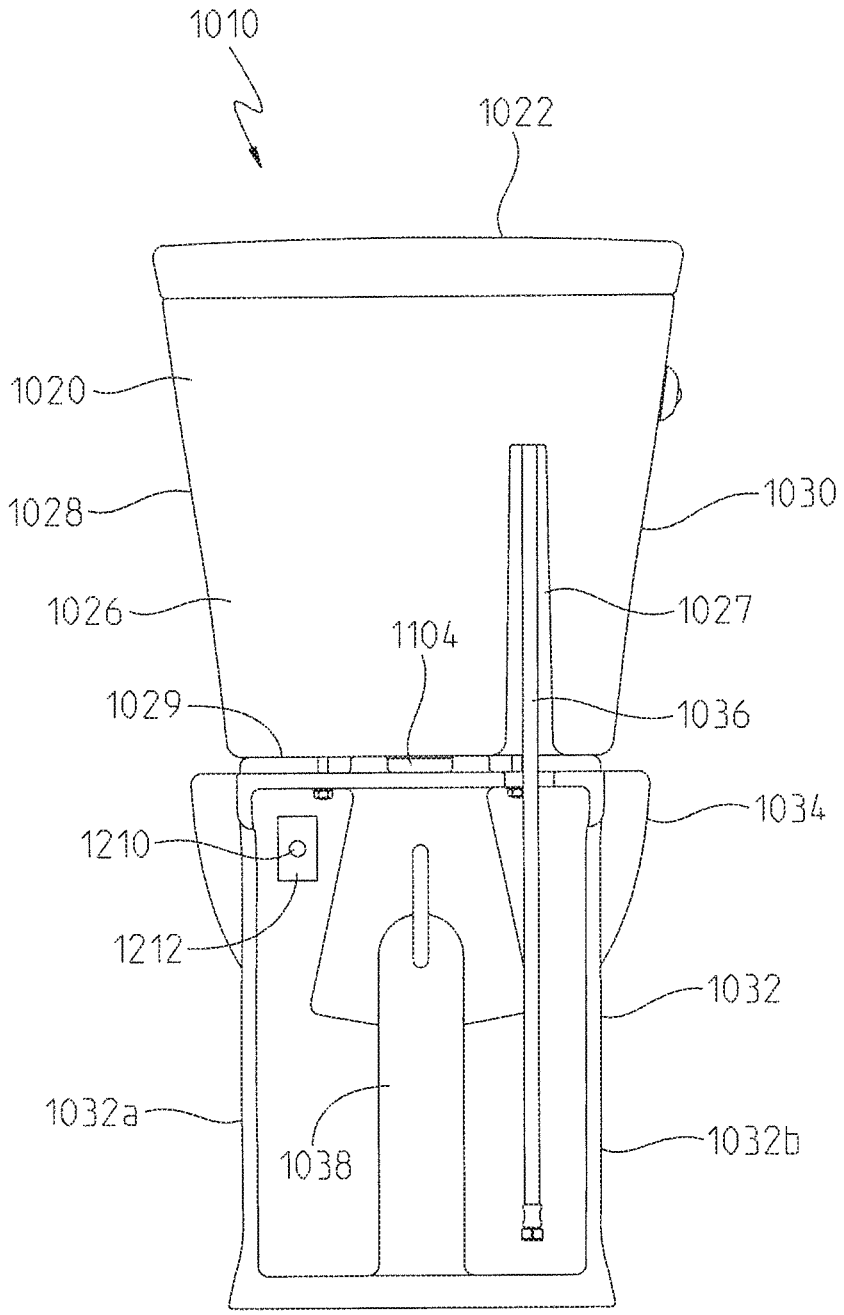
FIG. 21 is a rear view of the toilet of FIG. 20.
Figure 22:
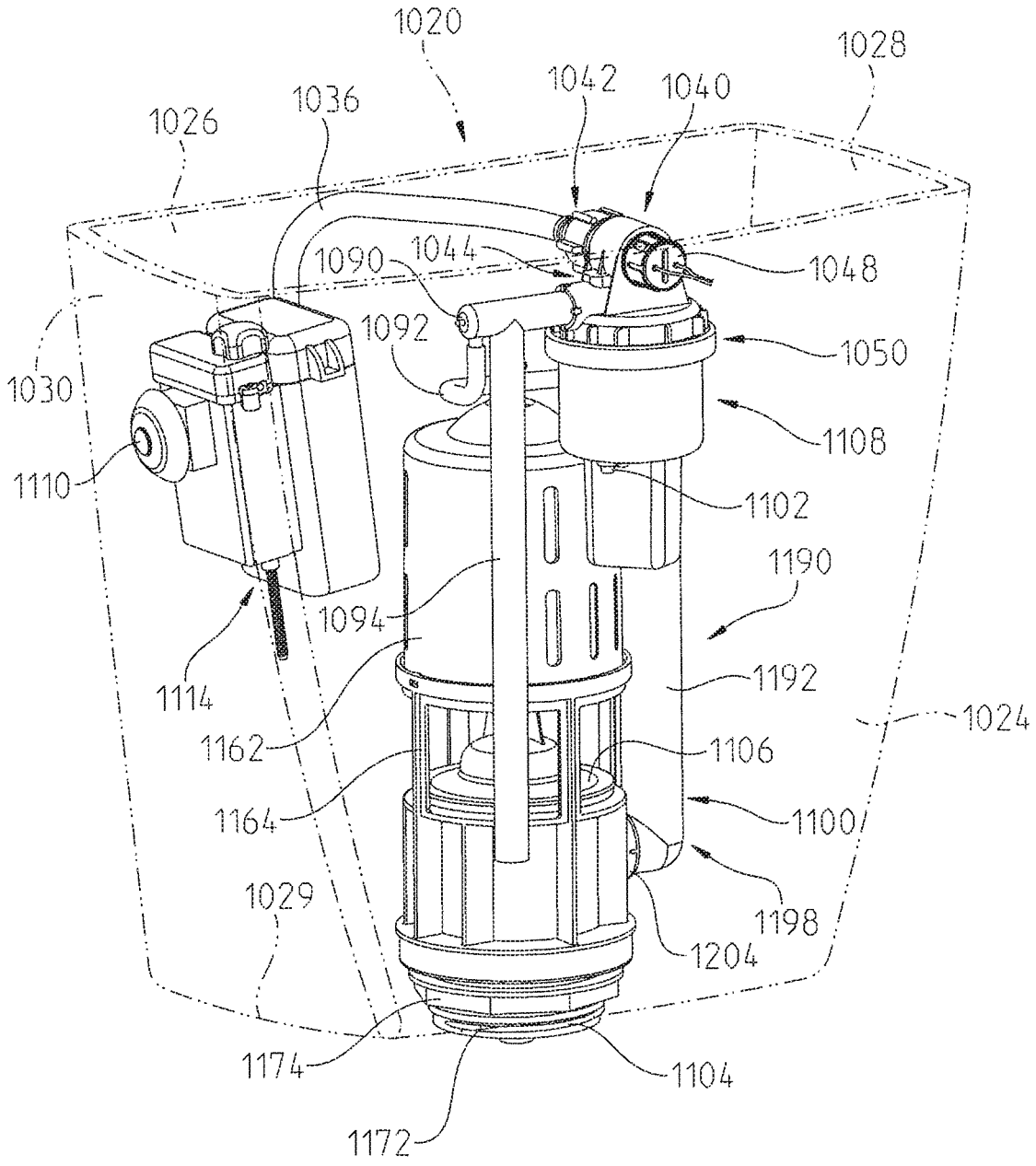
FIG. 22 is a front perspective view of a fill valve assembly, a flush valve assembly, an overflow assembly, and a housing for electrical components supported by a tank of the toilet of FIG. 20.

Referring to FIGS. 20-22, an alternative illustrative embodiment toilet 1010 is shown including a tank 1020, a base 1032, a bowl 1034, an inlet tube, illustratively a water supply tube 1036, an outlet tube, illustratively a trapway 1038, a fill valve assembly 1040, a flush valve assembly 1100, and an overflow assembly 1190. Illustratively, toilet 1010 is a tank-type, gravity-fed toilet. Additionally, illustrative toilet 1010 does not include an external handle for flushing toilet 1010, but rather, toilet 1010 is an automatic and hands-free toilet using an electronic sensor to initiate a flush cycle. Alternatively, other embodiments of toilet 1010 may be contemplated. In operation, water from tank 1020 flows into bowl 1034 in order to flush toilet 1010 and remove the contents of bowl 1034 through trapway 1038. A sealing member (not shown) may be provided between trapway 1038 and a floor (not shown) to prevent water leakage onto the floor.

Figure 24:
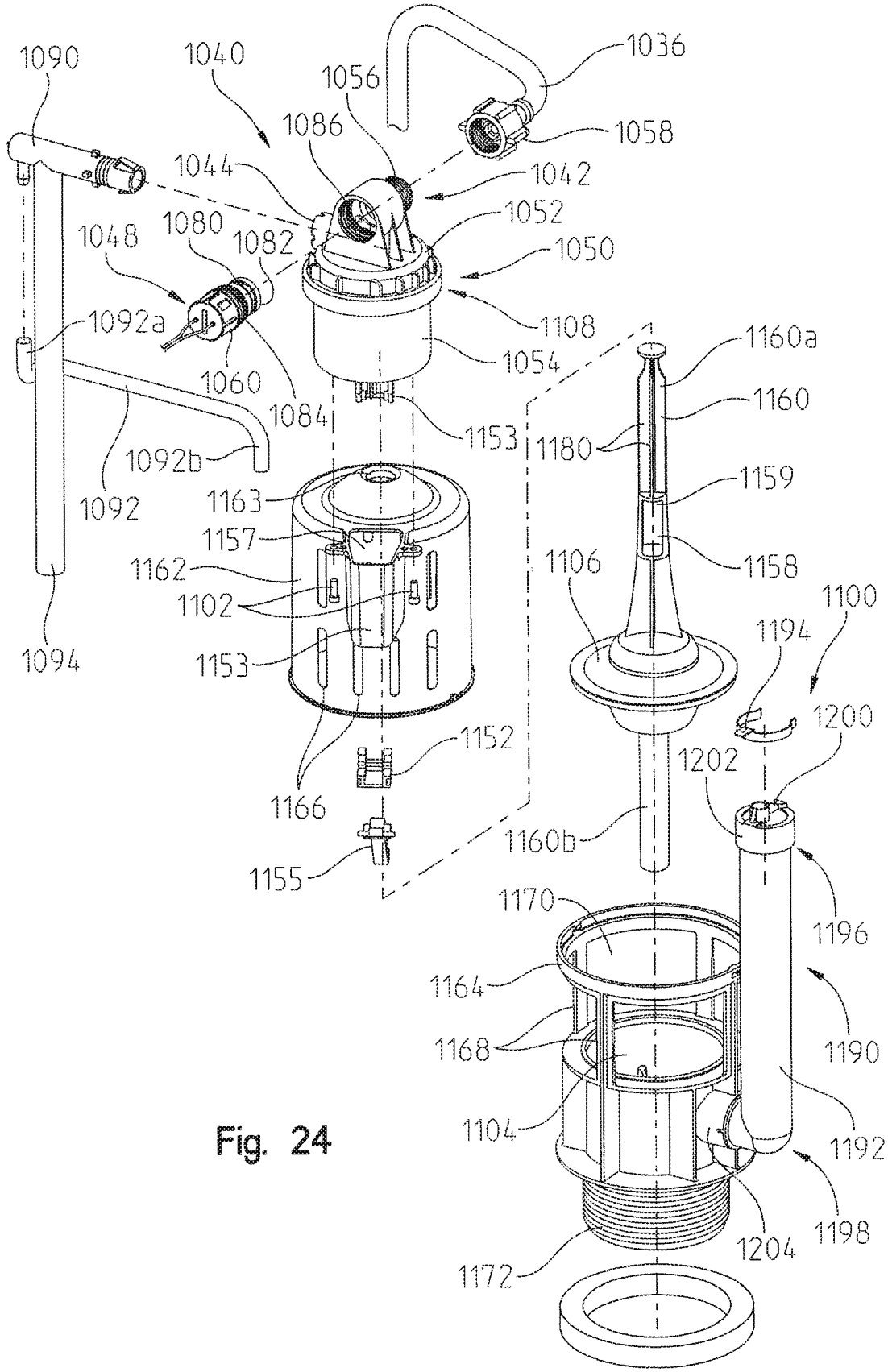
FIG. 24 is an exploded view of the fill valve assembly, the flush valve assembly, and the overflow assembly of FIG. 23.

Tank 1020 includes a lid 1022, a bottom surface 1029 generally opposite lid 1022, a front surface 1024, a rear surface 1026 generally opposing front surface 1024, a first side 1028 intermediate front surface 1024 and rear surface 1026, and a second side 1030 generally opposing first side 1028 and positioned intermediate front surface 1024 and rear surface 1026. Tank 1020 may be comprised of a ceramic, metallic, or polymeric material, for example porcelain, stainless steel, or plastic composite materials. Rear surface 1026 includes an external recessed channel 1027 which guides supply tube 1036 into tank 1020 above the water level in tank 1020 and allows tank 1020 to be positioned closer to the wall because supply tube 1036 does not extend outwardly from tank 1020. As shown in FIG. 24, supply tube 1036 is in fluid communication with flush valve assembly 1100 and overflow assembly 1190 through fill valve assembly 1040. In particular, supply tube 1036 is fluidly coupled to a water supply (not shown) in order to flow water into fill valve assembly 1040, as is further detailed herein.

Base 1032 of toilet 1010 is a pedestal-type configured to rest atop the floor. Brackets or other mounting assemblies (not shown) may be used to couple base 1032 to the floor and/or to tank 1020, as disclosed in U.S. Provisional Patent Application No. 61/610,205, filed on Mar. 13, 2012, the complete disclosure of which is expressly incorporated by reference herein. Base 1032 supports tank 1020 and bowl 1034 above the floor. In the illustrative embodiment, base 1032 integrally supports trapway 1038 and is a concealed-trapway type. More particularly, trapway 1038 is hidden from view by sidewalls 1032*a*, 1032*b* of base 1032 (FIG. 21). Base 1032 may be comprised of a ceramic, metallic, or polymeric material. For example, base 1032 may be comprised of porcelain, stainless steel, or plastic composite materials. Referring to FIG. 21, trapway 1038 is illustratively curved and is coupled to bowl 1034 and a drain tube (not shown). The drain tube connects trapway 1038 to a main sewer line (not shown) to carry away the contents of bowl 1034.

To limit contact between the water in toilet 1010 and metallic components, supply tube 1036 and/or trapway 1038 may be formed of a non-metallic material, such as a polymeric material (e.g., a cross-linkable polymer) and/or a ceramic material. Alternatively, supply tube 1036 and/or trapway 1038 may be lined with a non-metallic material. As such, supply tube 1036 and trapway 1038 are electrically non-conductive.

Figure 23:
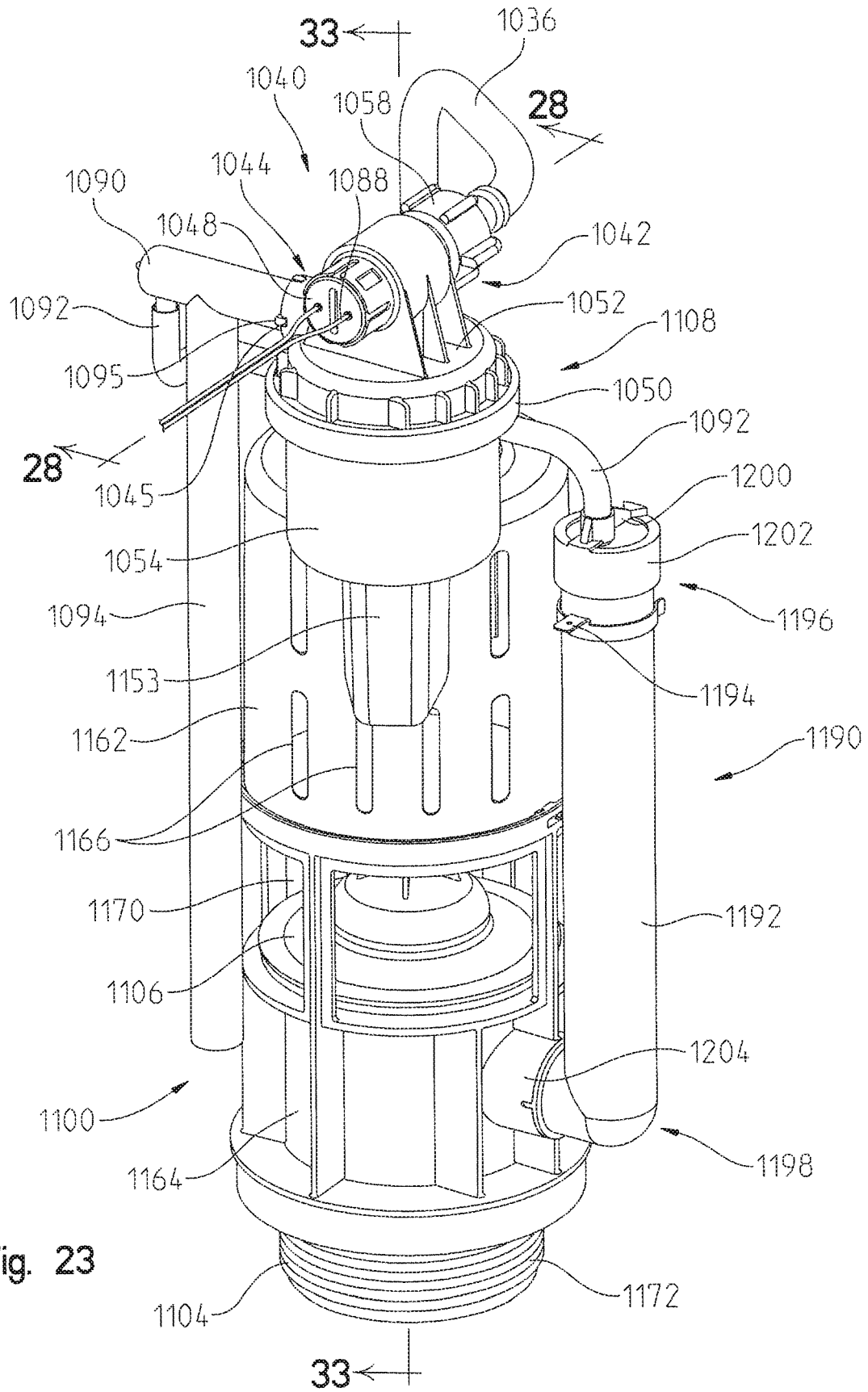
FIG. 23 is a perspective view of the fill valve assembly, the flush valve assembly, and the overflow assembly of FIG. 22.

As shown in FIGS. 22-28, a housing 1050 supports both a flush actuator assembly 1108 and fill valve assembly 1040. Fill valve assembly 1040 includes an inlet 1042, a refill outlet 1044, a flush actuator outlet 1046 (FIG. 28), and an electrically-operable valve assembly 1048 (FIG. 24). Referring to FIGS. 23 and 24, housing 1050 may include an upper portion 1052 and a lower portion 1054. Illustratively, upper portion 1052 is integral with lower portion 1054, however, upper portion 1052 may be coupled to lower portion 1054 through a threaded or friction connection or with conventional fasteners, as disclosed in U.S. Provisional Patent Application No. 61/610,205, filed on Mar. 13, 2012, the complete disclosure of which is expressly incorporated by reference herein. Upper portion 1052 supports inlet 1042, outlets 1044, 1046, and electrically-operable valve assembly 1048. Lower portion 1054 may be coupled to flush valve assembly 1100 with fasteners 1102, such as screws or bolts, and also may support flush actuator assembly 1108. Fill valve assembly 1040 may be comprised of a polymeric material to limit contact between the water and metallic components. Alternatively, fill valve assembly 1040 may be lined with a non-metallic material. As such, fill valve assembly 1040 is illustratively electrically non-conductive.

Inlet 1042 is fluidly coupled with supply tube 1036. More particularly, inlet 1042 may include external threads 1056 that threadedly couple with an internally-threaded nut 1058 to join supply tube 1036 thereto. Rear surface 1026, first side 1028, or second side 1030 of tank 1020 may include an internal support member or bracket (not shown) to support the connection between supply tube 1036 and inlet 1042. In particular, the connection between supply tube 1036 and inlet 1042 may occur within tank 1020.

Electrically-operable valve assembly 1048 is positioned within housing 1050 and is in fluid communication with inlet 1042, refill outlet 1044, and flush actuator outlet 1046. Electrically-operable valve assembly 1048 is threadedly coupled to upper portion 1052 of housing 1050 through external threads 1084 and internal threads 1086 (FIG. 24). As such, electrically-operable valve assembly 1048 is integral with housing 1050 because a portion of electrically-operable valve assembly 1048 forms the connection point for coupling electrically-operable valve assembly 1048 with upper portion 1052 of housing 1050.

Figure 28:
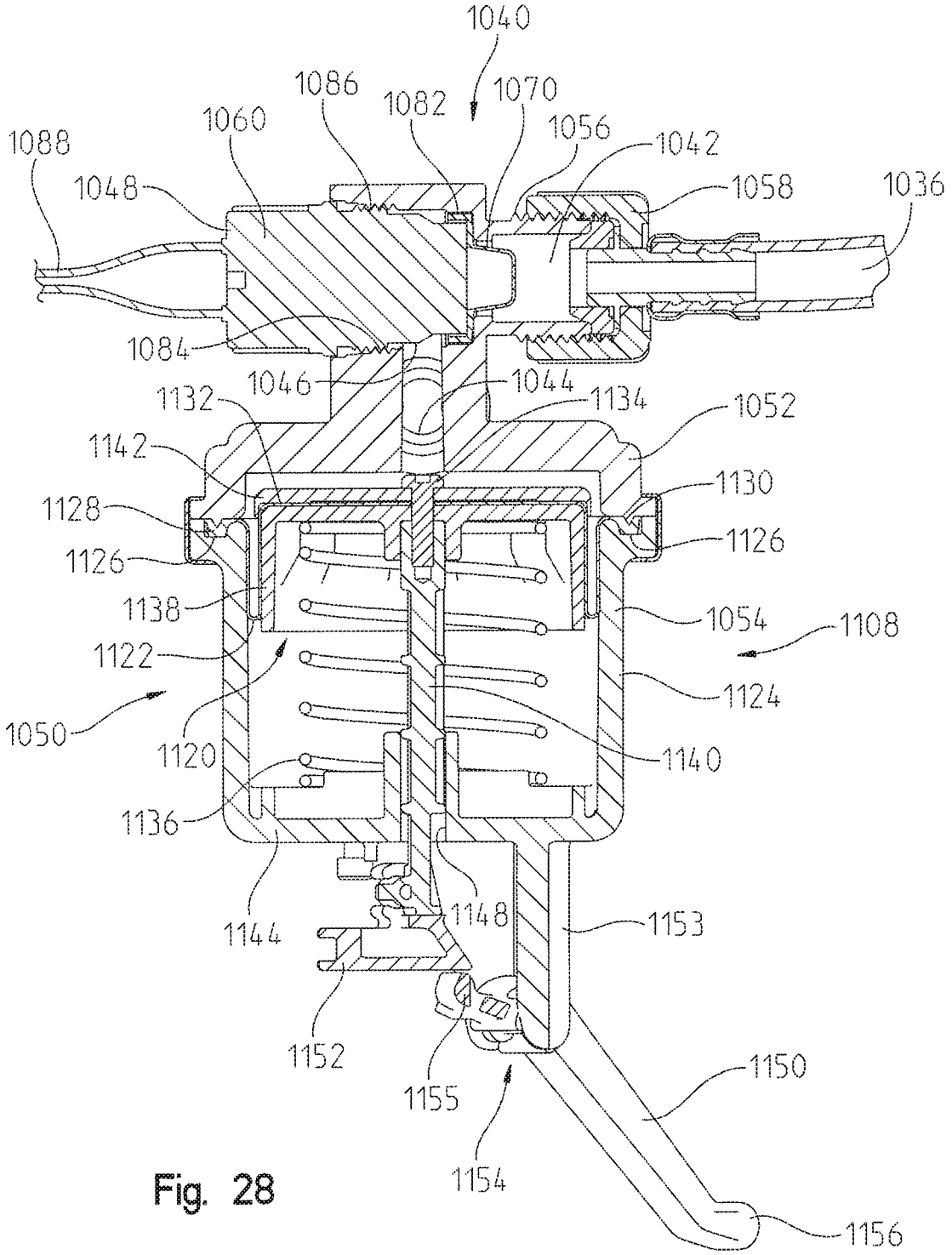
FIG. 28 is a cross-sectional view of the fill valve assembly of FIG. 23 and a flush actuator assembly, taken along line 28-28 of FIG. 23.

Referring to FIGS. 24 and 28, electrically-operable valve assembly 1048 may be, for example, an electromechanical valve, and more particularly, may be a solenoid valve of the latching-type. Exemplary electrically-operable valve assembly 1048 may include a filter 1070, slots 1080, a seal 1082, and a body portion 1060 supporting a valve seat 1061, a diaphragm 1062, a shaped portion 1064, illustratively a V-shaped groove, a pilot hole 1066, a seal 1068, a magnet 1072, a pole 1074, an armature 1076, and a spring 1078. As shown in FIG. 24, illustrative slots 1080 are rearward of seal 1082 and filter 1070, and are forward of body portion 1060. Electrically-operable valve assembly 1048 further includes electrical wires 1088 extending from body portion 1060 to supply power thereto.

Figure 40:
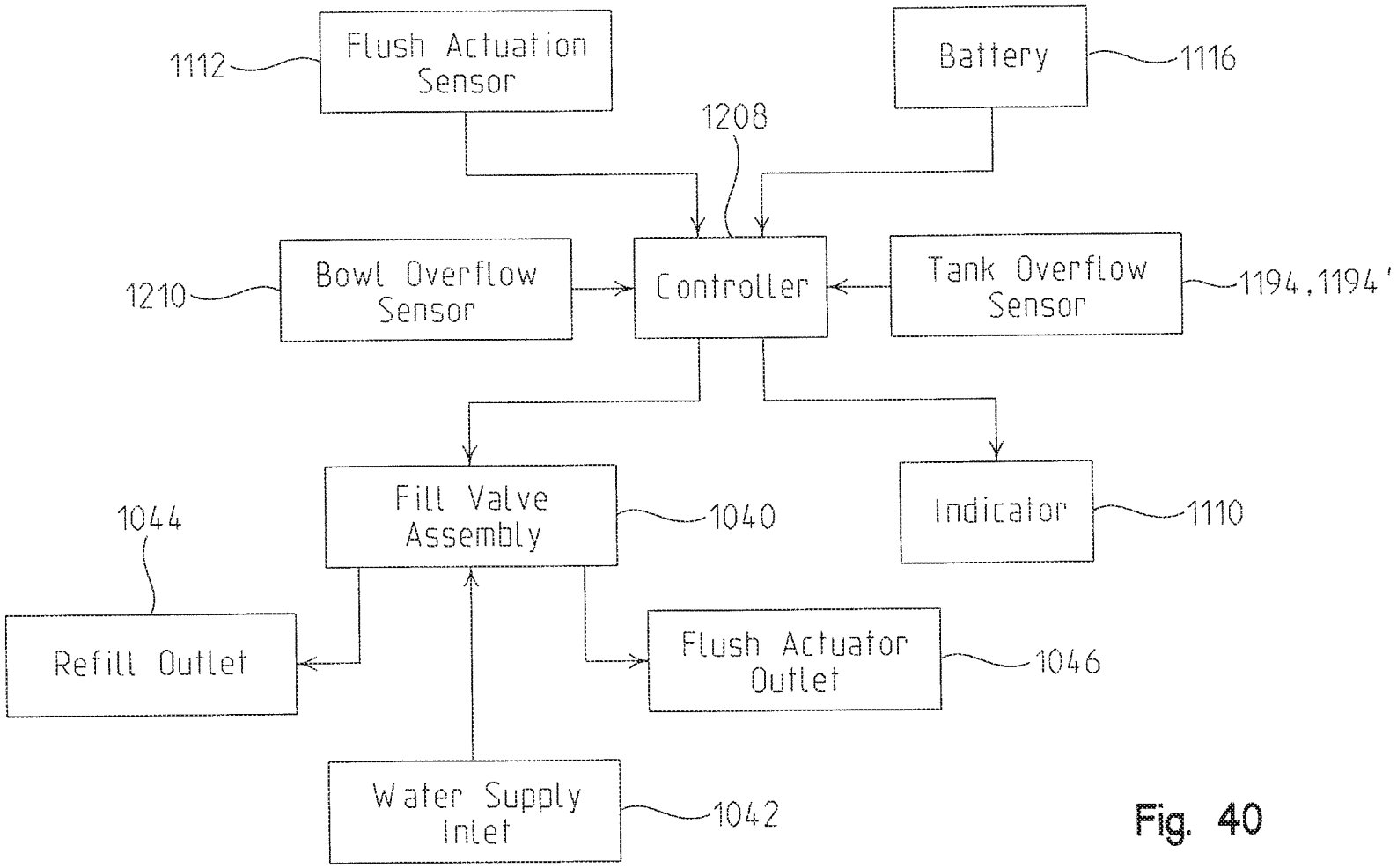
FIG. 40 is a diagrammatic view of various operating components of the toilet of FIG. 20, illustrating a plurality of inputs and outputs relative to a controller.

Electrically-operable valve assembly 1048 is in electrical communication with controller 1208 (FIG. 40). During operation of toilet 1010, electrically-operable valve assembly 1048 receives signals from controller 1208 to control the flow of water from inlet 1042 to refill outlet 1044 and flush actuator outlet 1046, as further detailed herein and in U.S. Provisional Patent Application No. 61/610,205, filed on Mar. 13, 2012, the complete disclosure of which is expressly incorporated by reference herein. For example, electrically-operable valve assembly 1048 may be actuated by controller 1208 to magnetically attract armature 1076 to pole 1074, thereby allowing water from inlet 1042 to flow between valve seat 1061 and diaphragm 1062, and into outlets 1044 and 1046. Electrically-operable valve assembly 1048 may be comprised of polymeric or other electrically nonconductive materials.

Figure 25A:
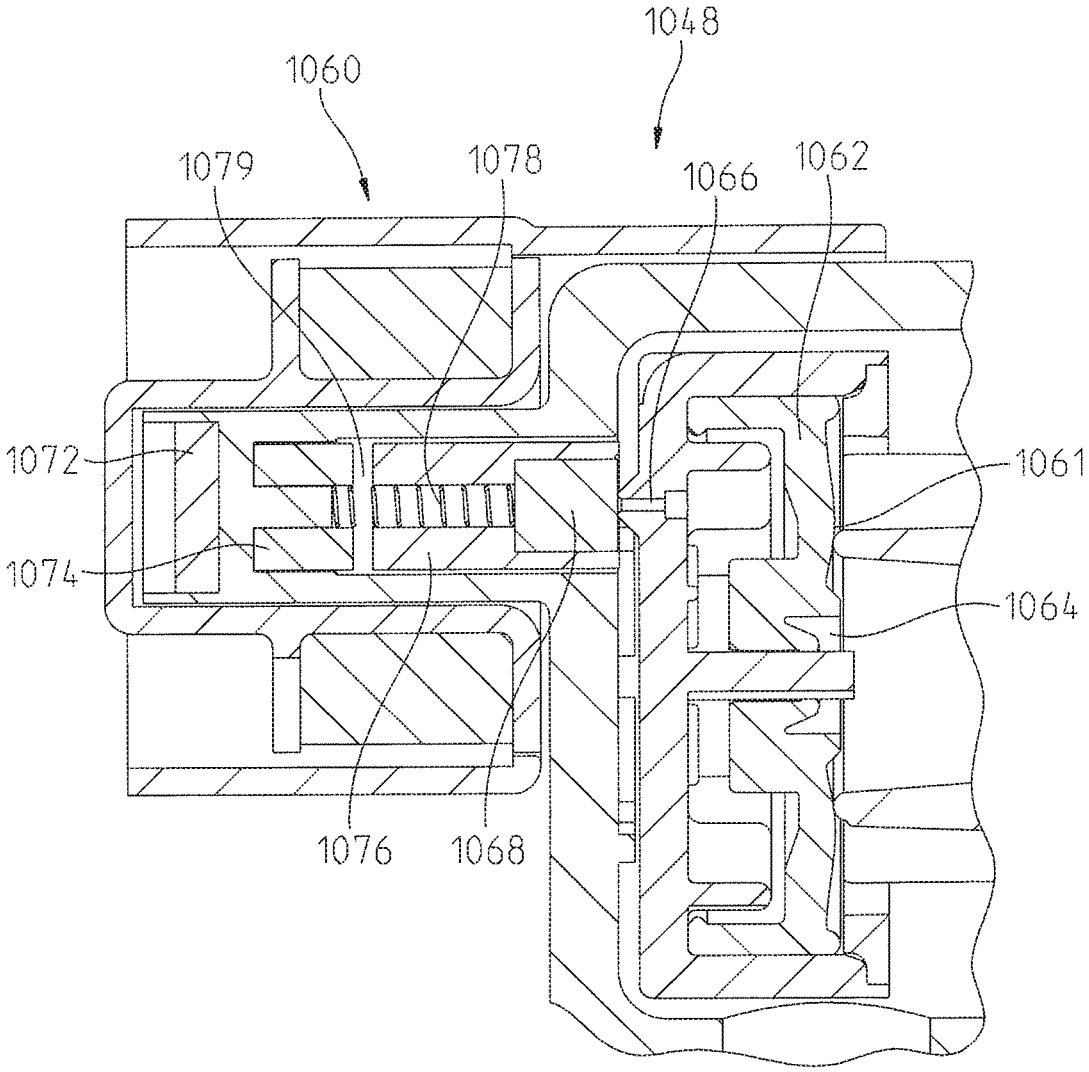
FIG. 25A is a cross-sectional view of an electrically-operable valve assembly of the fill valve assembly of FIG. 24 in a closed position.

As shown in FIG. 25A, when electrically-operable valve assembly 1048 is in the closed position, diaphragm 1062 engages valve seat 1061 due to the force behind diaphragm 1062. More particularly, the force behind diaphragm 1062 is sufficient to overcome the force at the front of diaphragm 1062. The resulting force behind diaphragm 1062 is due to water pressure at opposing front and rear surfaces of diaphragm 1062 in combination with surface area differences between the front and rear of diaphragm 1062. While the pressure at the front and rear of diaphragm 1062 may be equalized (due to water flow through shaped portions 1064), the greater surface at the rear of diaphragm 1062 creates a greater force behind diaphragm 1062. As such, diaphragm 1062 engages with valve seat 1061 such that water flowing through filter 1070 from inlet 1042 (FIG. 28) may not pass between diaphragm 1062 and valve seat 1061, thereby preventing water from flowing through slots 1080 and into outlets 1044 and 1046.

The force behind diaphragm 1062 may be created when armature 1076 is spaced apart from pole 1074. A gap 1079 may be defined by the space between armature 1076 and pole 1074 when valve assembly 1048 is in the closed position. In particular, spring 1078 biases armature 1076 away from pole 1074 in order to position seal 1068 against pilot hole 1066. When pilot hole 1066 is sealed, a force is maintained behind diaphragm 1062 to sealingly engage diaphragm 1062 with valve seat 1061.

Figure 25B:
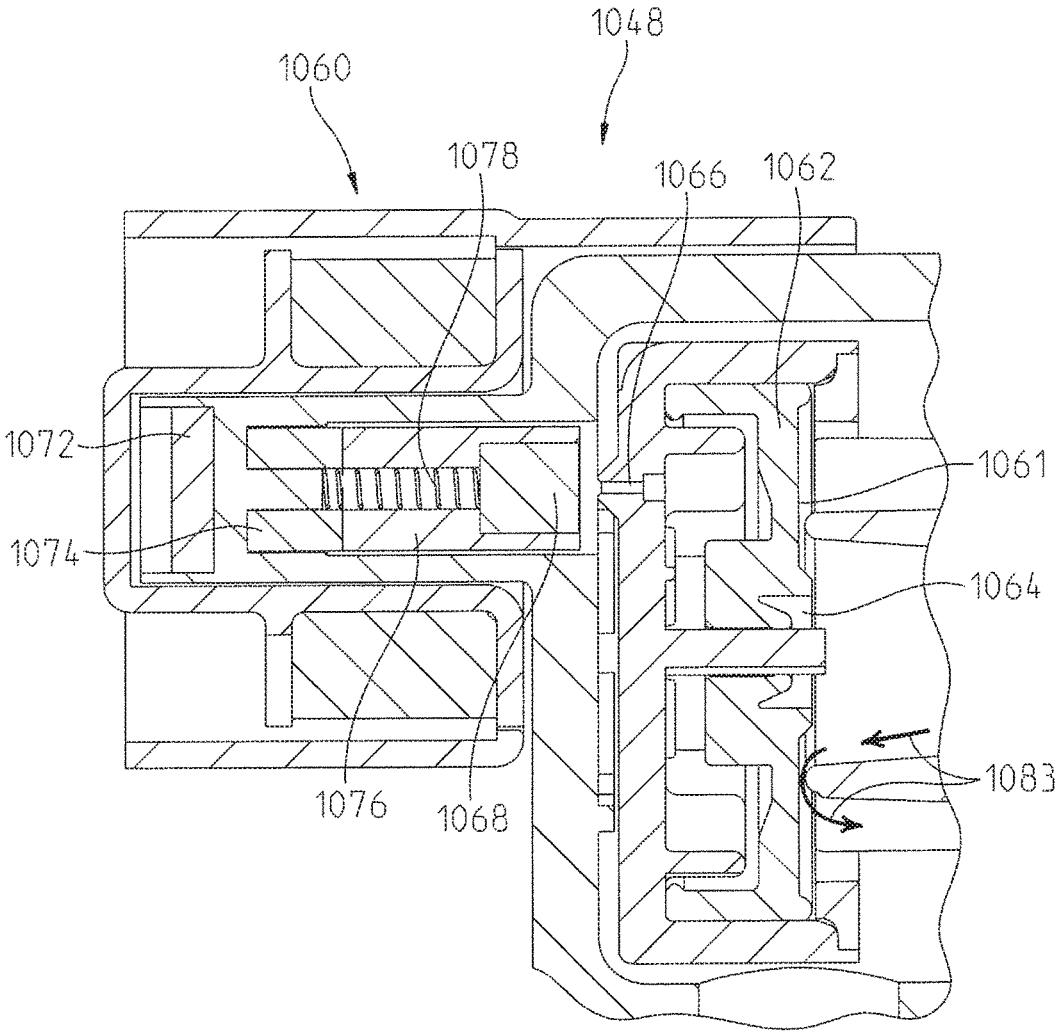
FIG. 25B is a cross-sectional view of the electrically-operable valve assembly of the fill valve assembly of FIG. 25A in an open position.

However, as shown in FIG. 25B, when electrically-operable valve assembly 1048 has been actuated by controller 1208, a short electrical pulse is provided in order to move armature 1076 toward pole 1074. When the electrical pulse is discontinued, armature 1076 will remain latched to, or otherwise in contact with, pole 1074 due to a magnetic attraction to magnet 1072. This magnetic force is sufficient to overcome the bias in spring 1078 to allow armature 1076 to move toward pole 1074 and close gap 1079. When armature 1076 contacts pole 1074, seal 1068 moves with armature 1076 and is pulled away from pilot hole 1066, which creates a pressure and force differential in valve assembly 1048. In particular, the pressure behind diaphragm 1062 is reduced because pilot hole 1066 is no longer sealed. As such, diaphragm 1062 may flex, bend, or otherwise move in response to the force from the water at inlet 1042. As such, water may flow through filter 1080 in the direction of arrows 1083 and between diaphragm 1062 and valve seat 1061 in order to flow through slots 1080 (FIG. 24) and into outlets 1044 and 1046.

When it is necessary to close electrically-operable valve assembly 1048, a short electrical pulse is provided in order to generate a magnetic force opposite that of magnet 1072. The opposing magnetic force unlatches armature 1076 from pole 1074 in order to move armature 1076 toward seal 1068. Spring 1078 facilitates the movement of armature 1076 toward seal 1068 because the electrical pulse has a short duration, for example 25 milliseconds. Additional details of the operation of electrically-operable valve assembly 1048 are disclosed in U.S. Provisional Patent Application No. 61/610,205, filed on Mar. 13, 2012, the complete disclosure of which is expressly incorporated by reference herein.

Figure 26:
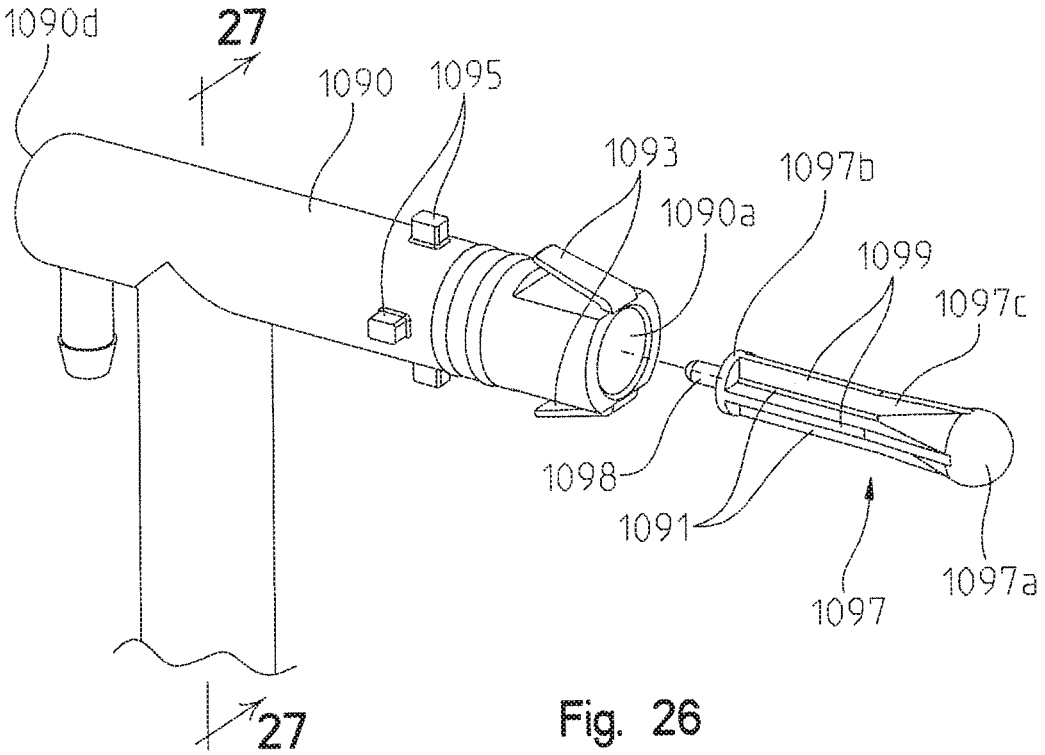
FIG. 26 is an exploded view of an outlet tube, a plunger, and a tank refill tube of the fill valve assembly of FIG. 24.
Figure 27:
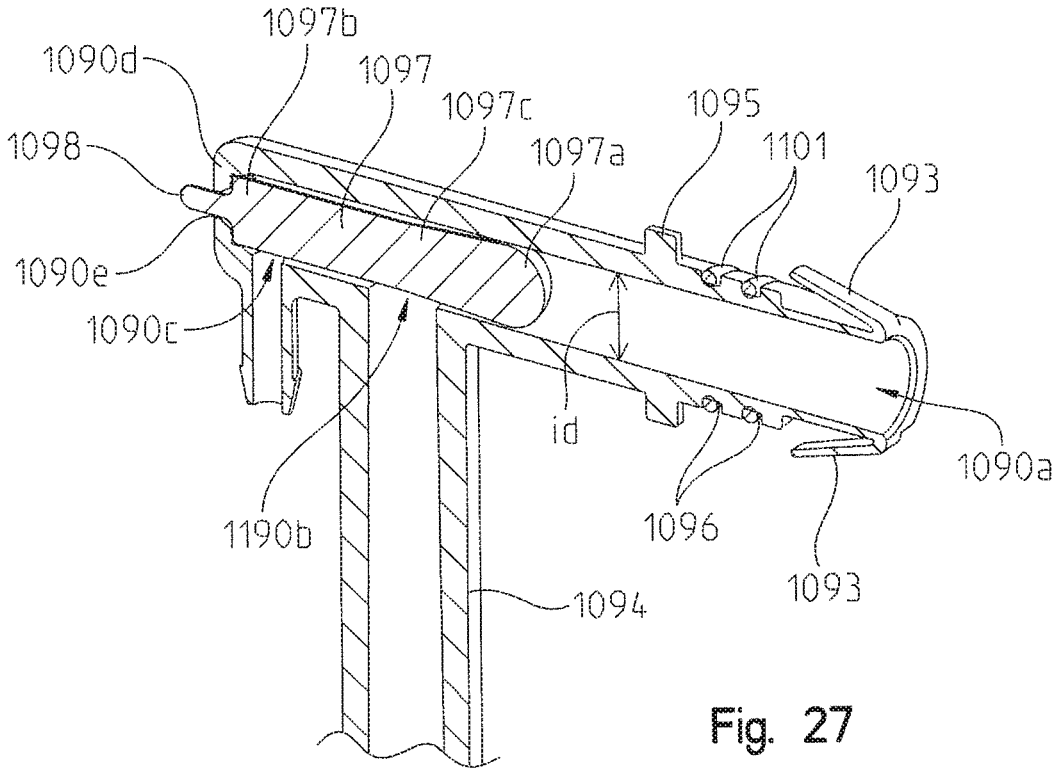
FIG. 27 is a cross-sectional view of the outlet tube, the plunger, and the tank refill tube of FIG. 26, taken along line 27-27 of FIG. 26.

Referring to FIG. 24, the illustrative embodiment of fill valve assembly 1040 includes two outlets 1044 and 1046, however, any number of outlets may be included to accommodate particular applications of fill valve assembly 1040. Refill outlet 1044 may be integrally formed with housing 1050 and extend therefrom. Illustratively, refill outlet 1044 may generally extend from housing 1050 and may be approximately perpendicular to inlet 1042. Additionally, as shown in FIGS. 26 and 27, refill outlet 1044 may be fluidly coupled to an outlet tube 1090, which illustratively is coupled to a bowl refill tube 1092 and a tank refill tube 1094.

As shown in FIGS. 23 and 24, exemplary bowl refill tube 1092 includes first and second generally right-angle bends 1092*a*, 1092*b* in order to extend away from outlet tube 1090 and toward an overflow tube 1192 of overflow assembly

1190. Illustratively, bowl refill tube 1092 extends around tank refill tube 1094 and over a cylindrical housing 1162 of flush valve assembly 1100 in order to couple with overflow tube 1192. Bowl refill tube 1092 may be smaller in diameter than overflow tube 1192 such that it is may be received therein. The illustrative embodiment of bowl refill tube 1092 may be received within a cap 1202 on overflow tube 1192, as shown in FIG. 23.

As shown in FIG. 24, outlet tube 1090 also is fluidly coupled tank refill tube 1094 which, illustratively, is positioned intermediate refill outlet 1044 and bowl refill tube 1092. Tank refill tube 1094 extends downwardly from outlet tube 1090 and may be positioned near bottom wall 1029 of tank 1020. As such, the position of tank refill tube 1094 may prevent water splashing and/or a user from hearing the water in tank refill tube 1094 contacting bottom wall 1029 of tank 1020 when tank 1020 is being refilled.

Outlet tube 1090 includes an inlet 1090*a* fluidly coupled to refill outlet 1044 of fill valve assembly 1040, a tank outlet 1090*b* fluidly coupled to tank refill tube 1094, a bowl outlet 1090*c* fluidly coupled to bowl refill tube 1092, and a plunger end 1090*d* generally opposite inlet 1090*a* and including an opening 1090*e*. Alternatively, bowl refill tube 1092 may be removed from fill valve assembly 1040. Instead, overflow tube 1192 may be aligned with bowl outlet 1090*c* such that water flowing from bowl outlet 1090*c* flows into overflow tube 1192. At least two resilient arms 1093 are positioned near inlet 1090*a* and are configured to extend into refill outlet 1044 in order to secure outlet tube 1090 therein. Additionally, a plurality of protrusions or stops 1095 and a plurality of channels 1096 are positioned adjacent resilient arms 1093. Channels 1096 receive o-rings 1101 for sealing outlet tube 1090 to refill outlet 1044. Stops 1095 are configured to fit within a plurality of recesses 1045 at refill outlet 1044 to limit the distance that outlet tube 1090 extends within refill outlet 1044.

Referring to FIGS. 26 and 27, outlet tube 1090 is configured to receive a plunger 1097 through inlet 1090*a*. Plunger 1097 has a body portion 1097*c* extending between a rounded end 1097*a* and a generally flat or planar end 1097*b*. A tip 1098 extends from flat end 1097*b*. Body portion 1097*c* of plunger 1097 includes a plurality of ribs 1099 extending between rounded end 1097*a* and flat end 1097*b*. Ribs 1099 are spaced apart from each other and define channels 1091 therebetween. Ribs 1099 increase the strength and stability of plunger 1097. Plunger 1097 is narrower at channels 1091 of body portion 1097*c* relative to rounded end 1097*a*. As such, the clearance, or flow path, between the inner diameter (id) of outlet tube 1090 and body portion 1097*c* of plunger 1097 is greater than the clearance, or flow path, between the inner diameter (id) of outlet tube 1090 and the rounded end 1097*a* of plunger 1097.

In operation, when fill valve assembly 1040 is actuated, water flows from supply tube 1036, through refill outlet 1044, and into inlet 1090*a* of outlet tube 1090. Water flows past plunger 1097 and exits outlet tube 1090 through tank and bowl outlets 1090*b* and 1090*c* to flow into tank refill tube 1094 and bowl refill tube 1092, respectively. The water entering outlet tube 1090 pushes plunger 1097 toward plunger end 1090*d* of outlet tube 1090 such that tip 1098 extends through opening 1090*e*. As such, plunger 1097 is generally positioned above bowl outlet 1090*c* and tank outlet 1090*b*. As the water flows toward plunger 1097 and tank and bowl outlets 1090*b* and 1090*c*, the flow path for the water narrows because the clearance between rounded end 1097*a* of plunger 1097 and the inner diameter (id) of outlet tube 1090 is less than the inner diameter (id) of outlet tube 1090. Therefore, as water flows into outlet tube 1090, the water velocity increases because the flow path at plunger 1097 is restricted relative to the flow path at inlet 1090*a*. Because the flow path in outlet tube 1090 is restricted, the water pressure at inlet 1090*a* increases, as detailed further herein. Channels 1091 provide a gradual transition for the water velocity to decrease when transitioning from the restricted flow path at rounded end 1097*a* to the unrestricted flow path in bowl and tank refill tubes 1092 and 1094, which may decrease the amount of noise produced by the restricted water flow.

If a vacuum occurs at inlet 1042 of fill valve assembly 1040, plunger 1097 moves away from plunger end 1090*d* and toward inlet 1090*a* of outlet tube 1090 such that tip 1098 is spaced apart from opening 1090*e*. As plunger 1097 moves away from opening 1090*e*, plunger 1097 "breaks" any vacuum at inlet 1042, thereby preventing water from flowing into electrically-operable valve assembly 1048 and supply tube 1036.

Illustratively, fill valve assembly 1040 is controlled by controller 1208 (FIG. 40). More particularly, controller 1208 receives a signal from a bowl sensor 1210 coupled to bowl 1034 which determines if an overflow condition has occurred in bowl 1034. Bowl sensor 1210 is coupled to bowl 1034 with adhesive, for example an adhesive tape 1212, or other similar materials, which may eliminate the need for invasive fasteners, such as bolts or screws, which would penetrate bowl 1034 and form a potential leakage point. Illustratively, bowl sensor 1210 is integral with adhesive tape 1212, which may be conductive. For example, bowl sensor 1210 is in contact with bowl 1034 and an electrical connection, such as a rivet or snap, coupled to bowl sensor 1210 to tape 1212.

Bowl sensor 1210 is configured to detect an overflow condition, such as when the water level in bowl 1034 rises above a predetermined, critical level. In particular, bowl sensor 1210 may prevent operation of fill valve assembly 1040 when an overflow condition is detected. Therefore, bowl sensor 1210 also may prevent operation of flush actuator assembly 1108 and flush valve assembly 1100 when an overflow condition is detected. Alternatively, when an overflow condition is not signaled by bowl sensor 1210, controller 1208 (FIG. 40) may send a signal to electrically-operable valve assembly 1048 to initiate a flush cycle, as further detailed herein. Bowl sensor 1210 also may be configured to detect a water leak in bowl 1034 and signal a leak condition to controller 1208. Controller 1208, through an indicator 1110 on tank 1020, may signal a user that bowl 1034 has a leak condition and/or an overflow condition. Bowl sensor 1210 may be a piezoelectric element, an infrared sensor, a radio frequency ("RF") device, a capacitive sensor, a float device, an ultrasound device, or an electric field, for example. Illustratively, bowl sensor 1210 is a capacitive sensor.

Figure 30:
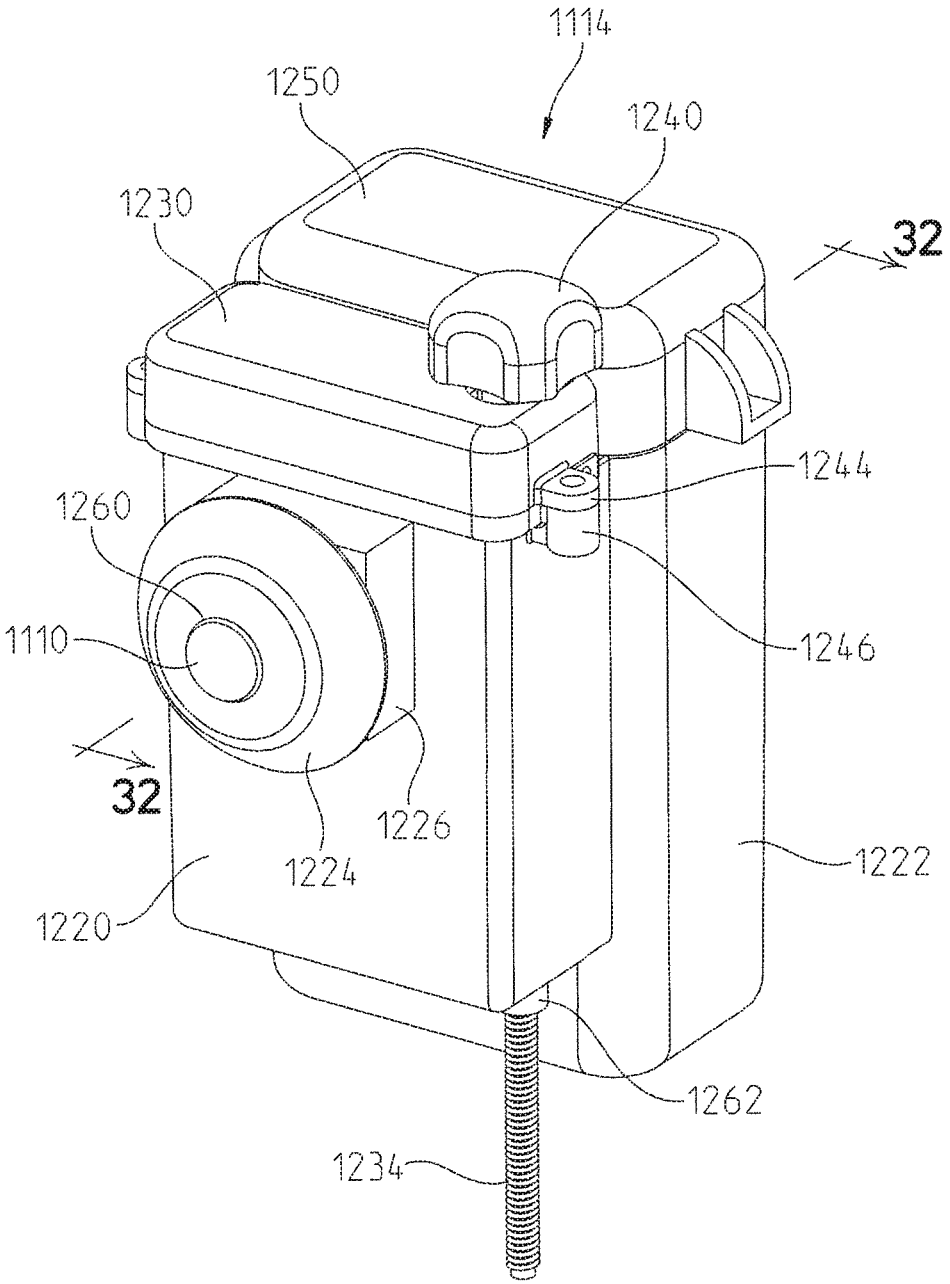
FIG. 30 is a front perspective view of the housing for electrical components of FIG. 22.
Figure 31:
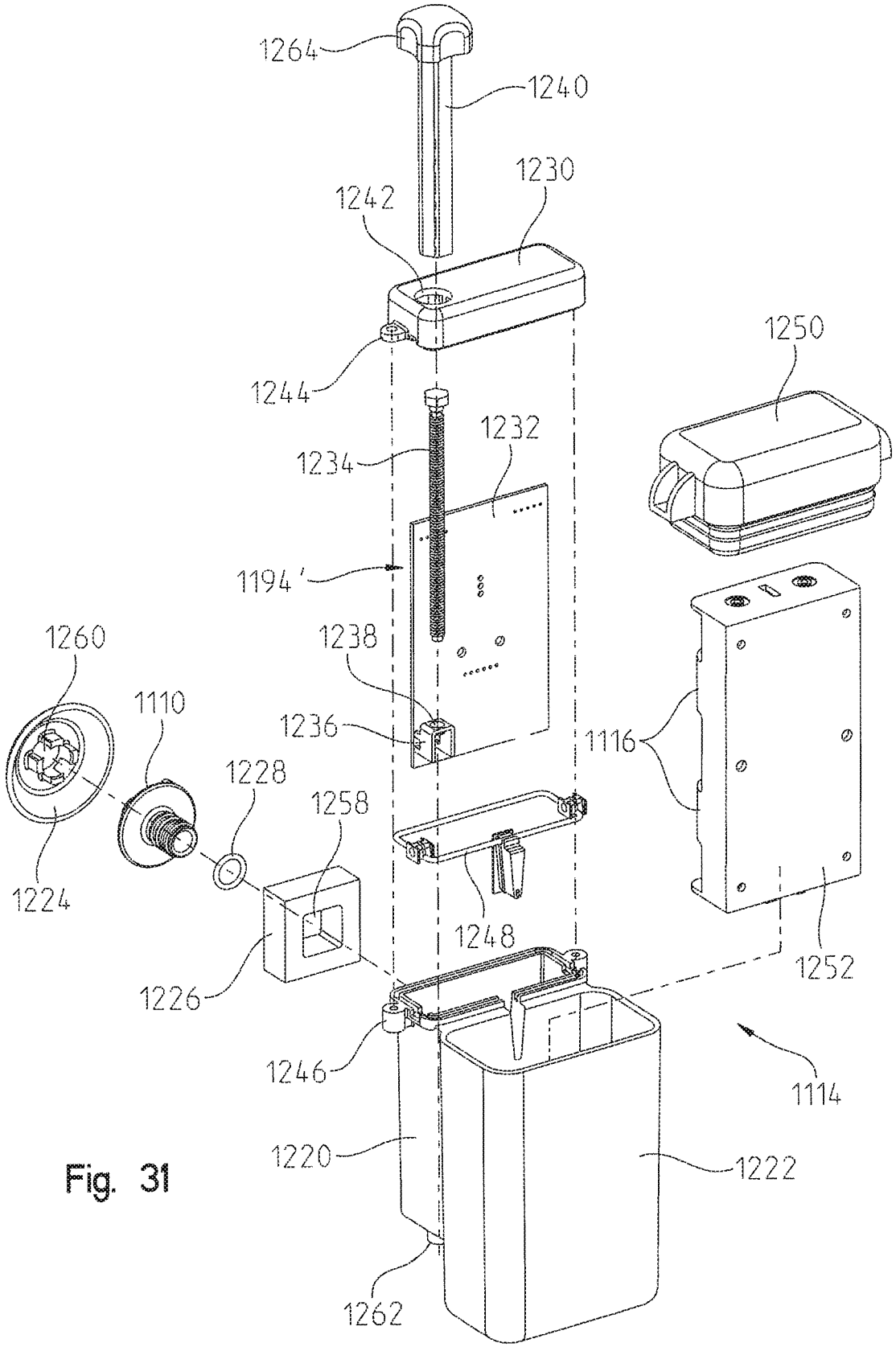
FIG. 31 is a rear exploded view of the housing of FIG. 30.
Figure 32:
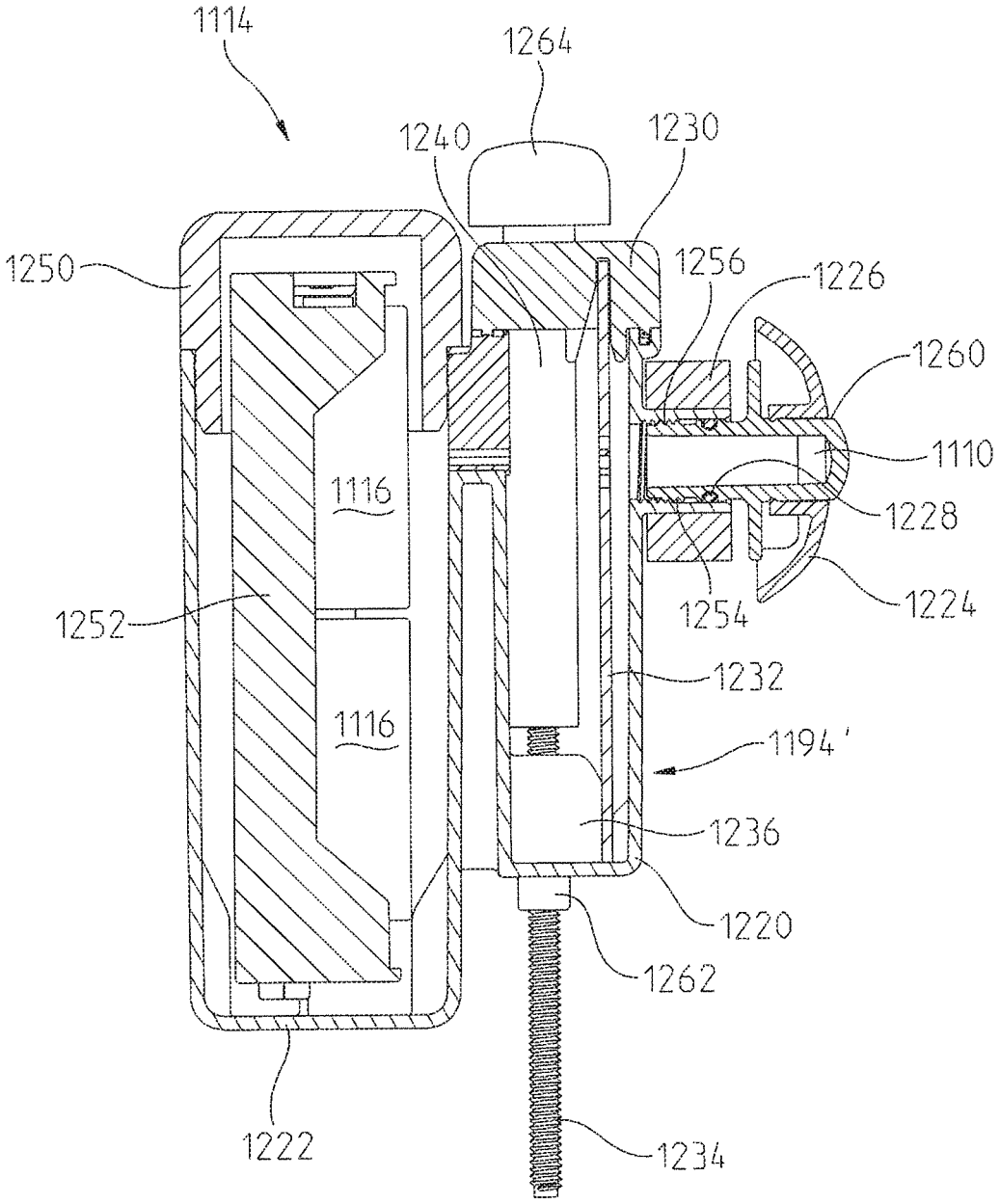
FIG. 32 is a cross-sectional view of the housing of FIG. 30, taken along line 32-32 of FIG. 30.

Referring to FIGS. 23, 24, and 28, fill valve assembly 1040 is fluidly coupled to flush actuator assembly 1108 through flush actuator outlet 1046. Illustratively, flush actuator outlet 1046 may be a conduit extending from housing 1050 to flush valve assembly 1100. Flush valve assembly 1100 includes a flush tube 1104, flush valve flapper 1106, flush actuator assembly 1108, indicator 1110, and a flush actuation sensor 1112 (FIG. 40). Flush actuation sensor 1112 cooperates with indicator 1110 (FIGS. 21 and 22) and controller 1208 (FIG. 40) to initiate a flush cycle. Indicator 1110 may be coupled to tank 1020 and extend therefrom, as shown in FIGS. 21 and 22. More particularly, indicator 1110 and controller 1208 may be coupled to the same wall of tank 1020 such that the wall is intermediate flush indicator 1110 and controller 1208. Illustratively, controller 1208 and indicator 1110 may be supported by a waterproof housing or casing 1114 in tank 1020 (FIGS. 30-32). Casing 1114 may also house at least one battery 1116 (FIG. 31) in order to supply power to controller 1208. Additionally, other electronic components may be housed within casing 1114, for example, indicator 1110 may include additional sensors electrically coupled to controller 1208.

Flush actuation sensor 1112 may be a piezoelectric element, an infrared sensor, a radio frequency ("RF") device, a capacitive sensor, a float device, an ultrasound device, or an electric field, for example. Illustratively, flush actuation sensor 1112 is a capacitive sensor. Flush actuation sensor 1112 is configured to receive a user input and is in electronic communication with controller 1208 (FIG. 40). In one illustrative embodiment, flush actuation sensor 1112 may be a capacitive sensor, using touch or hands-free proximity sensing. By incorporating capacitive sensing into toilet 1010, a single microchip may be used to electrically communicate with flush actuation sensor 1112, bowl sensor 1210, and a tank sensor 1194 (FIG. 23). Additionally, capacitive sensing may allow bowl sensor 1210 (FIG. 21) to sense through bowl 1034 without adding holes to bowl 1034. Furthermore, as is known, capacitive sensing provides for robust electrical communication and may be less expensive than other sensing mechanisms.

As shown in FIG. 28 and further disclosed in U.S. Provisional Patent Application No. 61/610,205, filed on Mar. 13, 2012, the complete disclosure of which is expressly incorporated by reference herein, flush actuator assembly 1108 may include a piston assembly 1120 coupled to a diaphragm 1122 within a cylinder 1124. Cylinder 1124 is defined by upper and lower portions 1052, 1054 of housing 1050. Because upper and lower portions 1052, 1054 are integral with each other and fill valve assembly 1040, cylinder 1124 also is integral with fill valve assembly 1040, including electrically-operable valve assembly 1048, through housing 1050. Lower portion 1054 of housing 1050 illustratively includes a channel 1126 which receives a lip 1128 of diaphragm 1122. Lip 1128 of diaphragm 1122 is positioned within channel 1126 between upper and lower portions 1052, 1054 of housing 1050. Upper portion 1052 may include protrusions 1130 which depress into lip 1128 of diaphragm 1122 in order to further secure diaphragm 1122 to cylinder 1124. A sealing end 1132 of diaphragm 1122 may be coupled to piston assembly 1120 with a screw 1134. As such, sealing end 1132 of diaphragm 1122 may form a seal between piston assembly 1120 and cylinder 1124. Illustratively, diaphragm 1122 is a rolling diaphragm and may move with piston assembly 1120, as further detailed herein. Diaphragm 1122 may be comprised of a flexible elastomeric material. During operation, diaphragm 1122 provides a long stroke with minimal friction, which reduces the minimum amount of friction needed to operate piston assembly 1120. Additionally, by decreasing the amount of friction necessary to operate piston assembly 1120, the stiffness of spring 1136 may be reduced. Because piston assembly 1120 may operate at a reduced pressure, toilet 1010 will continue to operate even in situations when the water pressure decreases (e.g., a well water supply or water is simultaneously running to other devices within a building).

As shown in FIG. 28, piston assembly 1120 illustratively includes a spring 1136, piston 1138, a piston rod 1140, and a retainer plate 1142 coupled to the top of piston 1138 with screw 1134 or other fastener. Piston 1138 is coupled to sealing end 1132 of diaphragm 1122 via retainer plate 1142 and screw 1134. As such, retainer plate 1142 also fluidly seals piston assembly 1120 from upper portion 1052 of housing 1050. In operation, water pressure may be used to engage flush actuator assembly 1108 and move piston assembly 1120. Additionally, a lower surface 1144 of cylinder 1124 may include apertures 1146 (FIG. 33) for releasing or exhausting air from cylinder 1124 during operation of flush actuator assembly 1108.

Illustrative piston 1138 may have a generally round shape that is substantially hollow (e.g., inverted cup shape). At least a portion of spring 1136 and piston rod 1140 are illustratively positioned within piston 1138. Piston rod 1140 may be coupled to piston 1138 via screw 1134. Piston rod 1140 extends downwardly from piston 1138 and through an aperture 1148 in cylinder 1124 to extend below cylinder 1124. As shown in FIG. 28, piston rod 1140 may be selectively coupled to a lever arm 1150 through a piston lever 1152. Piston lever 1152 may be pivotably coupled to piston rod 1140 and is configured to selectively engage lever arm 1150.

Referring to FIG. 28, lever arm 1150 includes a first end 1154 and an opposing second end 1156. First end 1154 is adjacent piston lever 1152 and may be in contact with piston lever 1152 during a flush cycle of toilet 1010. A pivot member 1155 may be coupled to first end 1154 of lever arm 1150 in order to pivotally contact piston lever 1152, as is detailed further herein. Lever arm 1150 and piston lever 1152 may pivot relative to a bracket 1153 coupled to lower portion 1054 of housing 1050. An opening 1157 in bracket 1153 allows lever arm 1150 to pivot within housing 1162 of flush valve assembly 1100.

Figure 33:
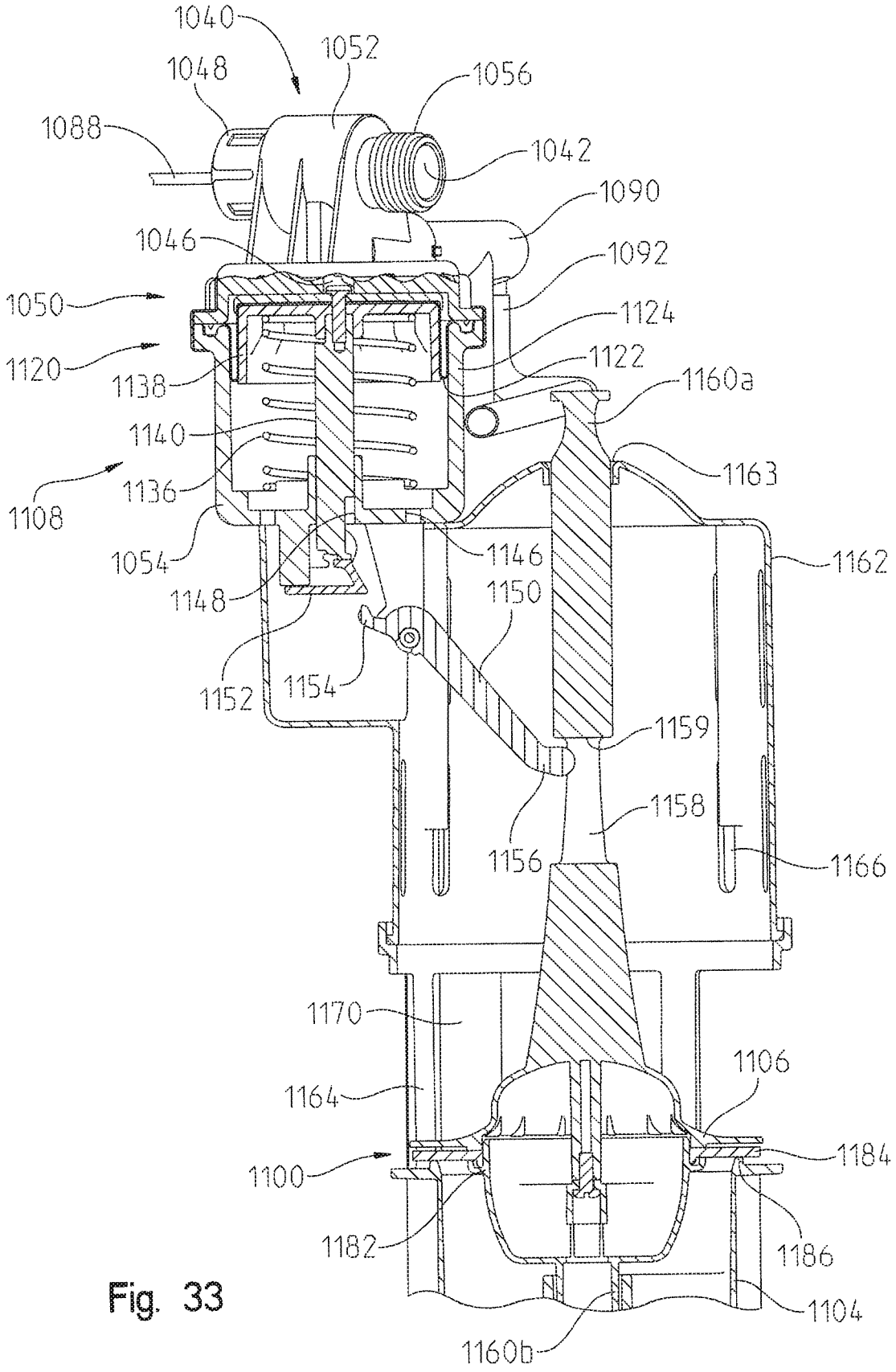
FIG. 33 is a cross-sectional view of the flush valve assembly in a closed position, taken along line 33-33 of FIG. 23, illustrating an initial stage of a flush cycle of the toilet of the present disclosure.

As shown in FIG. 33, second end 1156 of lever arm 1150 is illustratively coupled to flapper 1106 through a channel 1158. Channel 1158 is supported on a post 1160 of flush valve assembly 1100 and is positioned within housing 1162. Channel 1158 cooperates with lever arm 1150 to raise and lower flapper 1106 with the movement of lever arm 1150 during the flush cycle, as is detailed further herein. The illustrative embodiment of flush valve assembly 1100 is chainless because flapper 1106 is coupled to post 1160 rather than a chain. By using a rigid rod, shaft, or other similar structure, such as post 1160, it is more likely that flush valve assembly 1100 will operate properly when opening and closing flapper 1106. More particularly, if post 1160 is substituted with a chain, it is more likely that the chain may kink or otherwise fold or overlap, which may prevent the chain from fully extending. As such, a chain may not allow flapper 1106 to fully close and water may continuously flow from tank 1020 to bowl 1034. However, by using post 1160, rather than a chain, flush valve assembly 1100 operates properly to fully open and close flapper 1106.

Figure 29:
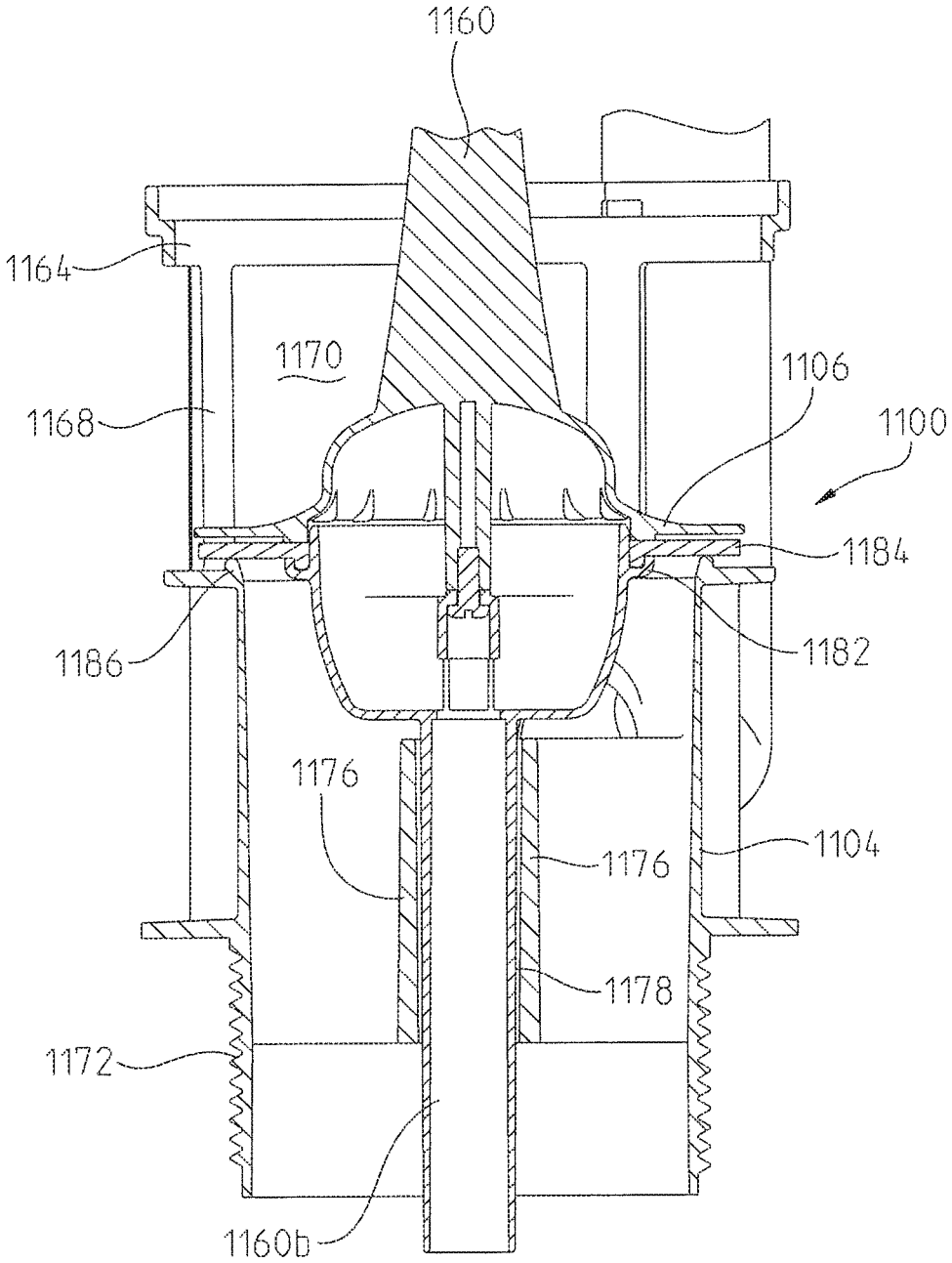
FIG. 29 is a cross-sectional view of the flush valve assembly of FIG. 23.

Referring to FIGS. 23, 24, and 29, flapper 1106 of flush valve assembly 1100 is positioned within a frame 1164 coupled to housing 1162 (FIG. 33). More particularly, housing 1162 is illustratively coupled to the top of frame 1164. Housing includes a plurality of slots 1166 which allows water to pass into and out of housing 1162. Housing 1162 may be configured for rotation relative to frame 1164 in order to accommodate various sizes and spatial arrangements of tank 1020 and supply tube 1036. Frame 1164 includes frame members or uprights 1168 that are circumferentially spaced apart from each to define radial apertures 1170. Frame 1164 may be coupled to flush tube 1104 below apertures 1170 and frame members 1164 in order to provide an outlet for flush valve assembly 1100. Illustratively, frame 1164 is integrally coupled to flush tube 1104, although alternative embodiments of frame 1164 and flush tube 1104 may be removably coupled to each other using conventional fasteners.

As shown in FIGS. 22-24, flush tube 1104 may be a cylindrical, or tubular, structure. Flush tube 1104 is fluidly coupled to bowl 1034, as shown in FIG. 21. An outer surface of flush tube 1104 may include external threads 1172 in order to receive nut 1174 for coupling flush valve 1104 to tank 1020. Flush tube 1104 may include support members 1176 (FIG. 29) extending inwardly to define a guide 1178 for post 1160 of flush valve assembly 1100. Additionally, flush tube 1104 may be fluidly coupled to overflow assembly 1190. Illustrative post 1160, shown in FIG. 24, includes an upper end 1160*a* and a lower end 1160*b*. Post 1160 extends through flapper 1106 such that upper end 1160*a* extends above flapper 1106 and through an aperture 1163 of housing 1162, and lower end 1106*b* extends below flapper 1106 and into guide 1178. Post 1160 may include ribs 1180 which may increase the strength and stability of post 1160.

As shown in FIG. 29, flapper 1106 may include a channel 1182 that receives a seal 1184. Flapper 1106 is configured for axial movement within frame 1164 and flush tube 1104, and seal 1184 also may move with flapper 1106. Additionally, post 1160 facilitates the axial movement of flapper 1106 and seal 1184. Post 1160 is positioned within guide 1178 of flush tube 1104 in order to properly position flapper 1106 within frame 1164 during axial movement. Therefore, post 1160 ensures that flapper 1106 is aligned on frame 1164 in order to properly seal flush valve assembly 1100. The alignment of flapper 1106 on frame 1164 provides repeatable operation and performance of toilet 1010 because the amount of water is dispersed from tank 1020 to bowl 1034 is generally consistent for every flush cycle.

With reference to FIG. 29, when flush valve assembly 1100 is closed, flapper 1106 engages a shoulder 1186 of frame 1164. Shoulder 1186 extends in a generally vertical direction relative to frame 1164. As such, when flush valve assembly 1100 is in the closed position, seal 1184 and flapper 1106 prevent water from flowing through flush tube 1104 and into bowl 1034. In contrast, when flush valve assembly 1100 is in an open position, as shown in FIGS. 34-37, post 1160 cooperates with lever arm 1150 to axially pull flapper 1106 and seal 1184 upwards and away from shoulder 1186. More particularly, flapper 1106 is held above shoulder 1186 such that water may enter flush tube 1104 during a flush cycle.

Referring further to FIGS. 23 and 24, overflow assembly 1190 includes overflow tube 1192 and tank sensor 1194 coupled thereto. Overflow tube 1192 is a cylindrical tube that is open at an upper end 1196 and a lower end 1198 thereof. Upper end 1196 of overflow tube 1192 is in fluid communication with bowl refill tube 1092 and illustratively has a larger diameter than bowl refill tube 1092. As shown in FIG. 23, bowl refill tube 1092 is received within a bracket 1200 on cap 1202 at upper end 1196 of overflow tube 1192. As such, bowl refill tube 1092 does not extend within overflow tube 1192 but is fluidly coupled thereto, such that water flowing from bowl refill tube 1092 flows into overflow tube 1192. Alternatively, bowl refill tube 1092 may extend within overflow tube 1192.

Lower end 1158 of overflow tube 1192 is in fluid communication with flush tube 1104 of flush valve assembly 1100 through a bracket 1204. Bracket 1204 may be integrally formed with frame 1164 of flush valve assembly 1100 or may be coupled thereto with conventional fasteners. As such, water entering upper end 1196 of overflow tube 1192 flows down overflow tube 1192, through lower end 1198 and flush tube 1104, and into bowl 1034. More particularly, if the water level in tank 1020 rises above upper end 1196 of overflow tube 1192, the water above upper end 1196 is directed into bowl 1034 through overflow tube 1192 and flush tube 1104. As such, the height or position of upper end 1196 of overflow tube 1192 may prevent the water in tank 1020 from overflowing. Furthermore, it may be appreciated that lower end 1198 is positioned below flapper 1106, which allows water to flow from overflow tube 1192, into flush tube 1104, and into bowl 1034 when flush valve assembly 1100 is in both the open position and the closed position.

Tank sensor 1194 may be coupled to the outer surface of overflow tube 1192. More particularly, tank sensor 1194 is coupled to, or integrally formed with, a clip 1206 positioned generally around overflow tube 1192 near upper end 1196 thereof. Illustratively, as shown in FIG. 23, clip 1206 and tank sensor 1194 are positioned below cap 1202. Exemplary clip 1206 may be a metal ring crimped onto overflow tube 1192. The position of clip 1206 and tank sensor 1194 may be adjustable along the length of overflow tube 1192 in order to adjust the water level in tank 1020. Tank sensor 1194 is in electronic communication with controller 1208 (FIG. 40). Tank sensor 1194 may be a piezoelectric element, an infrared sensor, a radio frequency ("RF") device, a capacitive sensor, a float device, an ultrasound device, or an electric field in wired or wireless communication with controller 1208, for example. Illustratively, tank sensor 1194 is a capacitive sensor. A second tank sensor (not shown) may be positioned in tank 1020 and configured to detect an overflow condition, such as when a water level in tank 1020 rises above a predetermined water level.

An alternative tank sensor 1194' may be supported by casing 1114 on tank 1020. Referring to FIGS. 30-32, casing 1114 includes a first portion 1220 and a second portion 1222. First portion 1220 may be integrally formed with second portion 1222, or may be coupled thereto with conventional fasteners. Second portion 1222 includes a battery bracket 1252 for supporting batteries 1116 therein. A lid 1250 is removably coupled to second portion 1222 and seals second portion 1222 from the water in tank 1020.

First portion 1220 supports indicator 1110, a cover member 1224, a bracket 1226, an o-ring 1228, a lid 1230, a circuit board 1232, and alternative embodiment tank sensor 1194', illustratively a metallic bolt 1234 and an adjustment member 1240. Lid 1230 is removably coupled to first portion 1220 via coupling members 1244, 1246 to seal first portion 1220 from the water in tank 1020. Indicator 1110 is supported by bracket 1226 on first portion 1220. Illustratively, bracket 1226 defines a square in cross-section and includes a square opening 1258 for receiving a threaded portion 1254 of indicator 1110. O-ring 1228 may be retained on threaded portion 1254 to seal opening 1258 of bracket 1226 when threaded portion 1254 is threadedly coupled with a threaded portion 1256 of first portion 1220 of casing 1114 (FIG. 32).

Cover member 1224 is illustratively positioned outwardly from bracket 1226 and, as shown in FIG. 22, also is positioned outward from tank 1020. As such, indicator 1110 extends between cover member 1224 and bracket 1226. In particular, cover member includes an opening 1260 through which a portion of indicator 1110 may extend. In this way, indicator 1110 and cover member 1224 are externally visible on tank 1020 such that a user may know to actuate flush actuation sensor 1112 through indicator 1110.

First portion 1220 further supports circuit board 1232 therein. Circuit board 1232 is coupled to a support member 1248 within first portion 1220 and includes various electrical components and connections, such as a metallic base member 1236. Base member 1236 is coupled to circuit board 1232 through conventional means and includes an aperture 1238 for receiving metallic bolt 1234 therethrough. More particularly, metallic bolt 1234 extends through an aperture 1242 in lid 1230, through aperture 1238 in base member 1236, and through an aperture 1262 on the bottom surface of first portion 1220 in order to extend into tank 1020. Similarly, adjustment member 1240 partially extends through aperture 1242 in lid 1230 and threadedly couples with bolt 1234 above base member 1236. A head portion 1264 of adjustment member 1240 is supported above lid 1230.

When bolt 1234 is supported on base member 1236, bolt 1234 may be electrically coupled to circuit board 1232 because bolt 1234 and base member 1234 are both metallic and, therefore, may transmit an electrical connection to circuit board 1232. Preferably, bolt 1234 is a capacitive sensor. As such, if water in tank 1020 contacts bolt 1234, controller 1208 detects the increase in capacitance and signals fill valve assembly 1040 to stop the flow of water into tank 1020. As such, bolt 1234 and base member 1236 define alternative tank sensor 1194' and may be used to signal to controller 1208 that no additional water should be added to tank 1020. Controller 1208 may be supported on circuit board 1232, or may be in electrical communication therewith, and receives the electrical signal indicating that water in tank 1020 is at the level of bolt 1234. Controller 1208 may then close fill valve assembly 1040 to prevent additional water flowing into tank 1020. Using adjustment member 1240, a user may rotate head portion 1264 of adjustment member 1240 in order to adjust the length of bolt 1234 extending from aperture 1262 and into tank 1020. Therefore, the predetermined water level in tank 1020 may be adjusted. For example, if a user wants to lower the predetermined water level in tank 1020, the user may rotate head portion 1264 in a first direction to move bolt 1234 away from head portion 1264 of adjustment 1240 and further into tank 1020. Conversely, if a user desires to raise the predetermined water level in tank 1020, the user may, for example, rotate head portion 1264 in a second direction to move bolt 1234 towards head portion 1264 and further into first portion 1220 such that less of bolt 1234 extends into tank 1020.

Both tank sensor 1194 and 1194' may be configured to cooperate with controller 1208 to indicate a water leak in tank 1020. For example, if the water level in tank 1020 no longer contacts tank sensor 1194 or 1194', controller 1208 may determine if a flush cycle was initiated. If a flush cycle was not initiated, controller 1208 may then indicate to a user, through indicator 1110, that tank 1020 has a water leak (i.e., that the water level in tank 1020 is decreasing between flush cycles).

In use, toilet 1010 may be operated by initiating the flush cycle, as shown in FIGS. 33-39. More particularly, and referring to FIG. 33, when a user desires to flush toilet 1010, the user activates flush actuation sensor 1112 (FIG. 40). For example, a user's hand may be placed in proximity to (e.g., placed in front of) indicator 1110 in order to trigger the flush cycle. As such, toilet 1010 is an automatic and hands-free flush toilet because a user normally initiates a flush cycle through flush actuation sensor 1112, rather than by depressing a manual handle or button on toilet 1010. Flush actuation sensor 1112 receives the user input and sends a signal to controller 1208 to initiate operation of flush valve assembly 1100 and fill valve assembly 1040. Before initiating the flush cycle, controller 1208 (FIG. 40) receives signals from bowl sensor 1210 to determine if the water level in bowl 1034 is above the predetermined critical water level. If the water level in bowl 1034 is at or below the critical level, then controller 1208 will initiate the flush cycle. Conversely, if bowl sensor 1210 signals to controller 1208 that the water level in bowl 1034 is above the critical level, controller 1208 will not actuate fill valve assembly 1040 to initiate a flush cycle. In particular, when an overflow condition is detected, water does not flow from inlet 1042 of fill valve assembly 1040 to outlets 1044, 1046. As such, water does not flow into or from tank 1020 during an overflow condition. Illustratively, water does not flow from inlet 1042 to flush actuator outlet 1046 and, therefore, flush actuator assembly 1108 does not lift flapper 1106, which prevents water in tank 1020 from flowing into bowl 1034. Additionally, water does not flow from inlet 1042 to refill outlet 1044 and, therefore water does not flow into tank 1020 through tank refill tube 1094 or into bowl 1034 through bowl refill tube 1092.

However, it may be appreciated that exemplary toilet 1010 is configured to allow a user to flush toilet 1010 once after an overflow condition has been detected. In particular, the user may remove lid 1022 of toilet 1010 and manually pull post 1160 upwardly through aperture 1163 of housing 1162 in order to manually lift flapper 1106 and open flush valve assembly 1100. The water in tank 1020 will flow through flush valve assembly 1100, into bowl 1034, and through trapway 1038 to flush toilet 1010. However, because an overflow condition has been signaled to controller 1208, controller 1208 does not actuate fill valve assembly 1040 and, therefore, tank 1020 and bowl 1034 are not refilled. As such, a user is prevented from manually flushing toilet 1010 more than once when an overflow condition is detected because no water remains in tank 1020 for another flush cycle.

Alternatively, toilet 1010 may include an external button, lever, or other mechanical user interface device coupled to post 1160, which would allow a user to manually flush toilet 1010 without removing lid 1022. For example, the user may push, rotate, or otherwise move a device externally coupled to toilet 1010 which would raise post 1160, thereby opening flapper 1106, to allow water to enter bowl 1034 without actuating controller 1208 or fill valve assembly 1040. As such, post 1160 allows a user to override controller 1208, and also allows a user to operate toilet 1010 one time when battery 1116 needs to be replaced or the electrical sensors and/or controller 1208 malfunction.

When an overflow condition is not detected, controller 1208 sends a signal to fill valve assembly 1040 in response to the signal from flush actuation sensor 1112, to initiate the flush cycle. In particular, when electrically-operable valve assembly 1048 is actuated, armature 1076 moves toward pole 1074 to close gap 1079 and unseal pilot hole 1066, thereby allowing a portion of diaphragm 1062 to flex away from valve seat 1061 (FIG. 25B). Water from supply tube 1036 may flow between valve seat 1061 and diaphragm 1062 to provide fluid communication between inlet 1042 and refill outlet 1044 and flush actuator outlet 1046.

Figure 34:
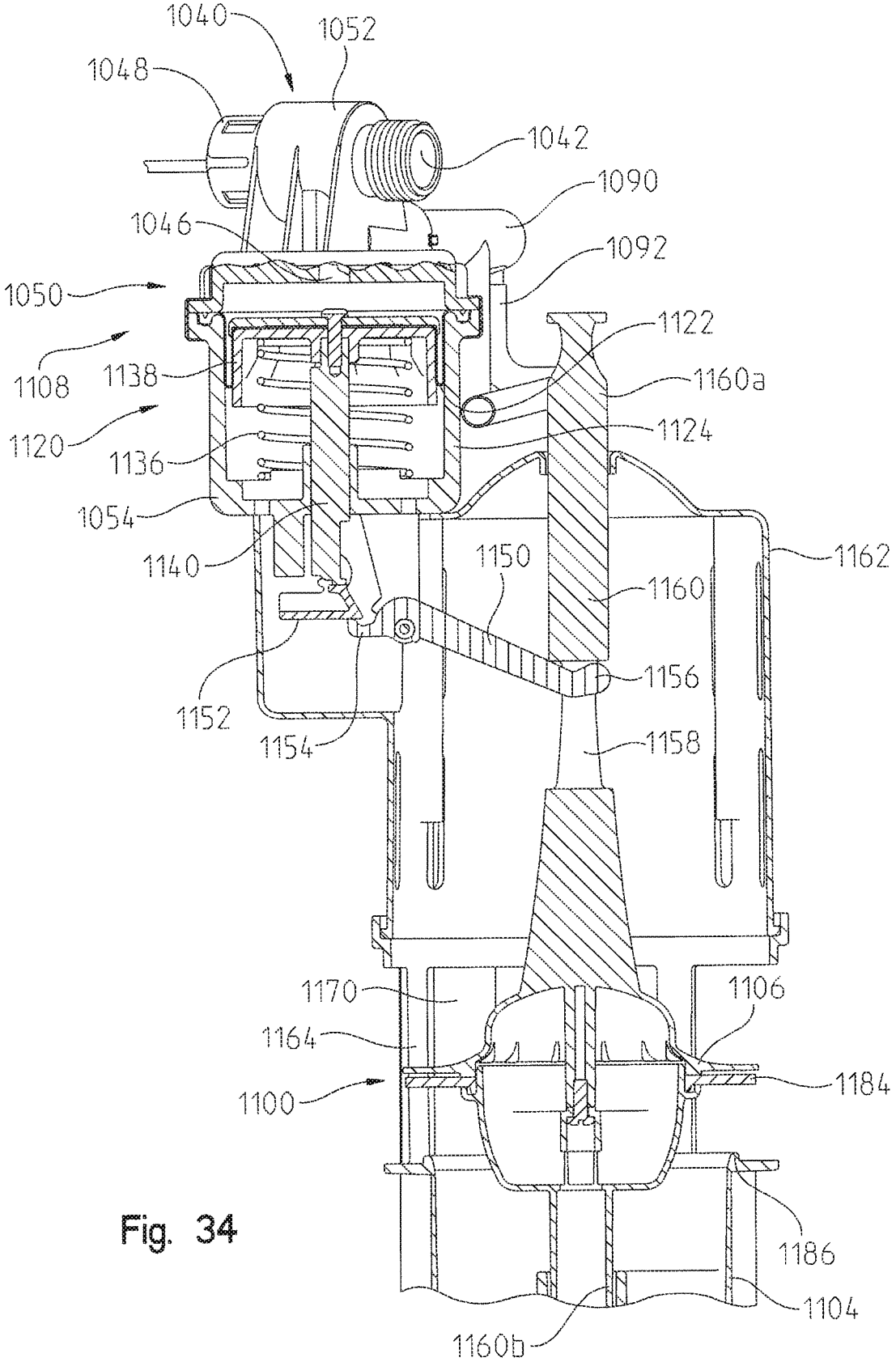
FIG. 34 is a cross-sectional view of the flush valve assembly of FIG. 33 in an initial open position, illustrating the flush cycle after the flush valve assembly has been open opened.
Figure 35:
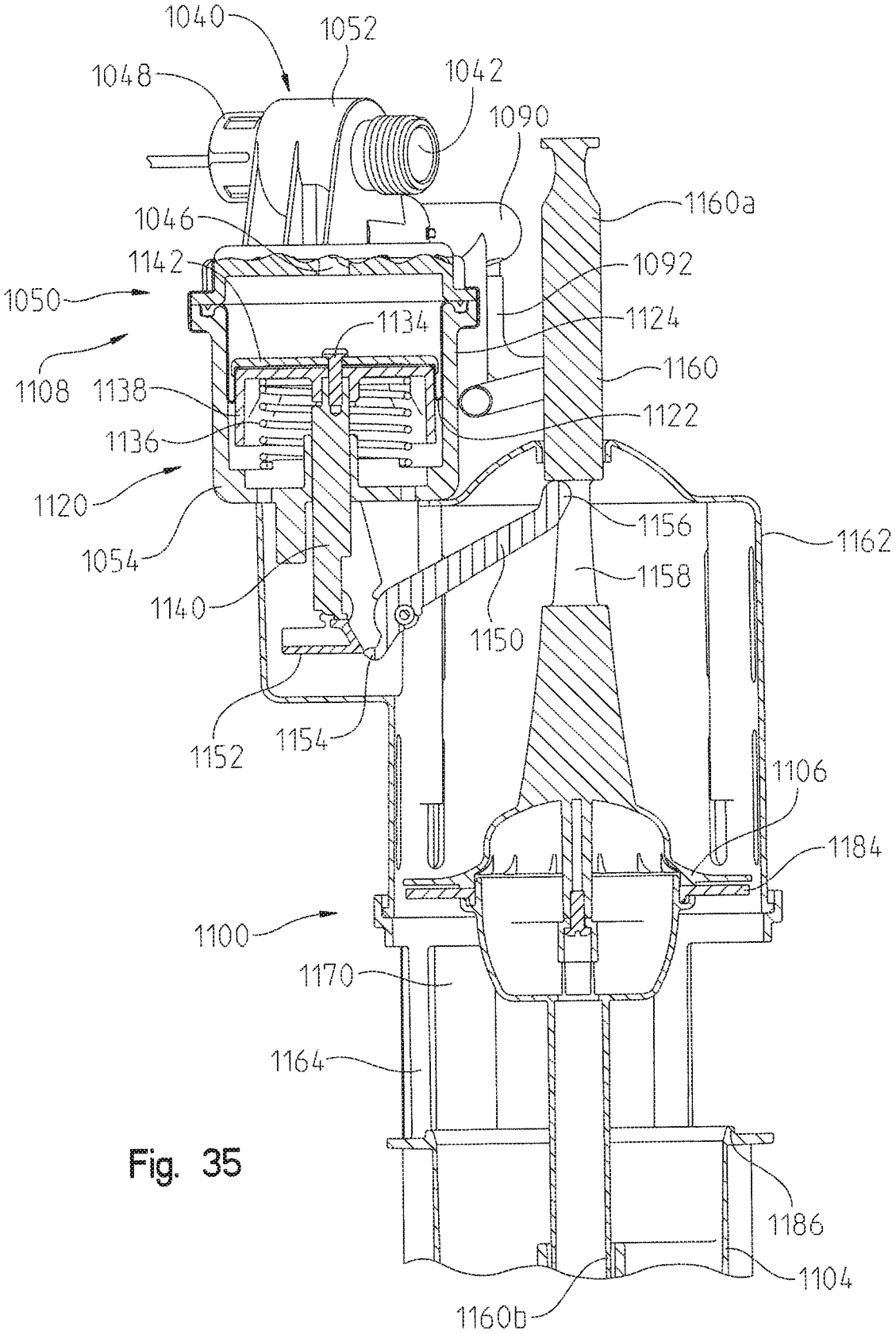
FIG. 35 is an additional cross-sectional view of the flush valve assembly of FIG. 33 in the open position, illustrating a later stage of the flush cycle.
Figure 36:
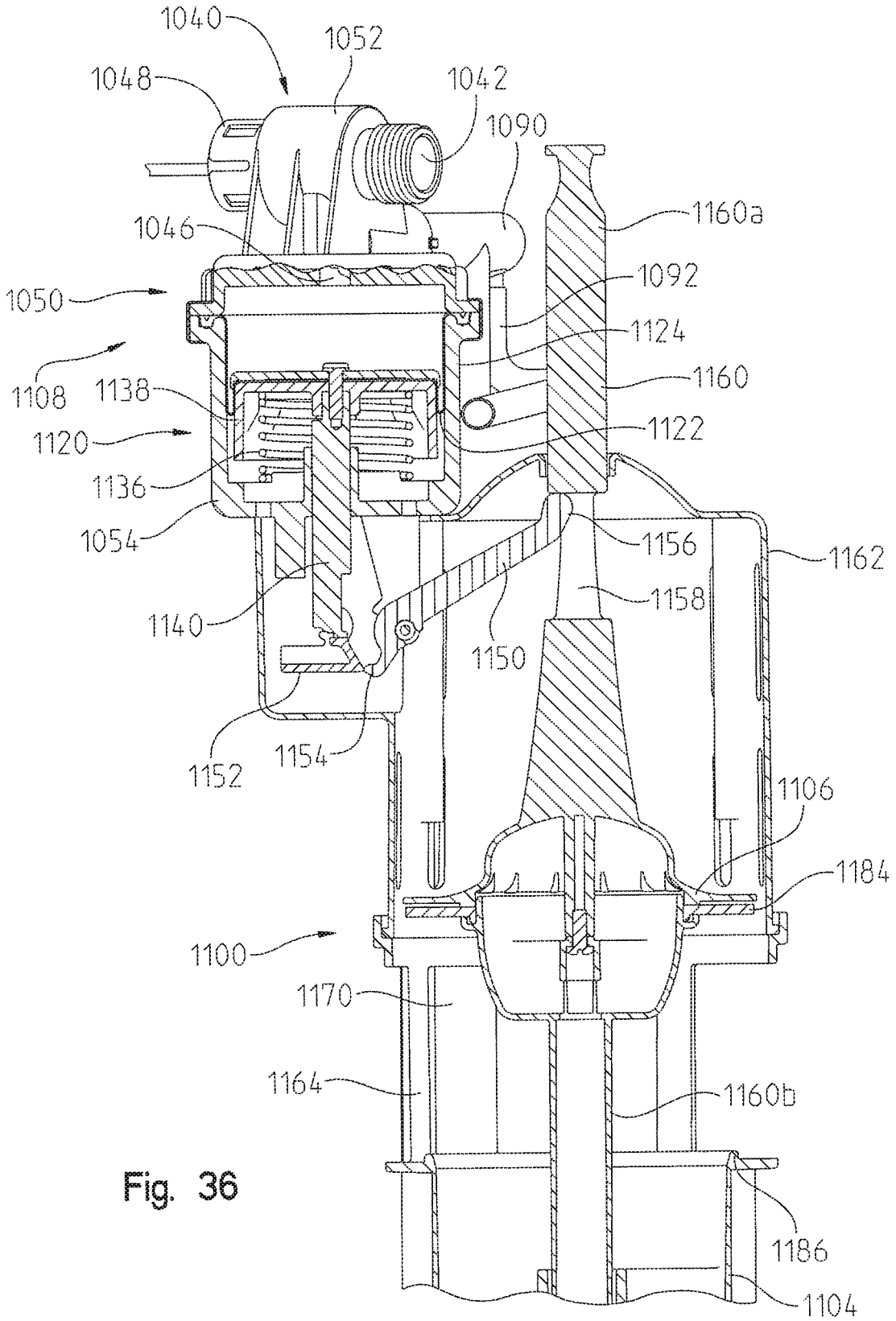
FIG. 36 is a cross-sectional view of the flush valve assembly of FIG. 33 in the open position, illustrating a lever arm at full travel during the flush cycle.

Water flows from supply tube 1036, through inlet 1042, into electrically-operable valve assembly 1048, through flush actuator outlet 1046, and into flush actuator assembly 1108. Water also simultaneously flows through refill outlet 1044 and into outlet tube 1090. The incoming water pressurizes flush actuator assembly 1108 due, in part, to the flow restriction in outlet tube 1090 caused by plunger 1097. By pressurizing flush actuator assembly 1108, diaphragm 1122 is depressed, thereby causing diaphragm 1122 and piston 1138 to move axially downward in cylinder 1124, as shown in FIGS. 34-36. The water pressure is sufficient to overcome the bias in spring 1136 and the force caused by the weight of flapper 1106 and the water above flapper 1106 in order to lower piston 1138 and compress spring 1136. For example, the pressure in flush actuator assembly 1108 may be 10-15 psi in order to overcome the bias of spring 1136 and initiate movement of diaphragm 1122.

The downward movement of piston 1138 causes piston rod 1140 to also move downwardly. At the initiation of the flush cycle, piston rod 1140 and piston lever 1152 are spaced apart from lever arm 1150 (FIG. 33). However, as piston rod 1140 is pushed further downward by the water pressure applied to diaphragm 1122 and piston 1138, piston lever 1152 contacts first end 1154 of lever arm 1150 (FIG. 34). In response, lever arm 1150 pivots upwardly in housing 1162. More particularly, second end 1156 of lever arm 1150 moves upwardly within channel 1158 of post 1160 until contacting an upper surface 1159 of channel 1158. When lever arm 1150 contacts upper surface 1159 of channel 1158, post 1160 moves upwardly with lever arm 1150. As such, flapper 1106 moves upwardly as well.

Referring to FIGS. 34 and 35, the upward movement of post 1160 and flapper 1106 causes flush valve assembly 1100 to open. As flush valve assembly 1100 opens, water from tank 1020 flows through apertures 1170 and into flush tube 1104 in order to enter bowl 1034. Substantially all of the water in tank 1020 may flow into bowl 1034 when flush valve assembly 1100 is open. The sudden increase in water in bowl 1034 creates a siphon effect in trapway 1038, whereby fluid and other contents of bowl 1034 are pulled or suctioned out of bowl 1034 and into trapway 1038 and the drain (not shown).

As shown in FIGS. 35 and 36, at full travel, first end 1154 of lever arm 1150 slips past piston lever 1152. As such, piston lever 1152 is clear of lever arm 1150 and may no longer be in contact therewith. Second end 1156 of lever arm 1150 is then able to pivot downwardly within channel 1158 to its original position due to its weight. Even though lever arm 1150 begins to move downwardly within channel 1158, flapper 1106 may remain in an open position while water is in tank 1020. More particularly, due to buoyancy, flapper 1106 may initially remain open when water is in tank 1020. However, as the water level in tank 1020 decreases, flapper 1106 may close due to a loss of buoyancy and a decrease in the velocity of the water flowing from tank 1020 into bowl 1034. For example, flapper 1106 may include a plurality of holes (not shown) which allow water to flow into flapper 1106, thereby decreasing its buoyancy. As such, flapper 1106 may move downwardly through the water in tank 1020 and close while some water is still in tank 1020. The holes in flapper 1106 may be arranged according to predetermined conditions of the flush cycle, such as flush volume (e.g., 1.28 gallons/flush) and the desired duration of the flush cycle. Flush valve assembly 1100 is closed when flapper 1106 is seated on shoulder 1186 of frame 1164, which then allows water from tank fill tube 1094 to remain water in tank 1020.

After flush valve assembly 1100 closes, tank 1020 and bowl 1034 may be refilled with water. In order to refill tank 1020 and bowl 1034 after toilet 1010 has been flushed, electrically-operable valve assembly 1048 of fill valve assembly 1040 remains in the open position such that refill outlet 1044 and flush actuator outlet 1046 remain open. Water from supply tube 1036 flows through refill outlet 1044, into outlet tube 1090, and through bowl refill tube 1092 in order to flow through overflow tube 1192 and into bowl 1034 via flush tube 1104. As detailed herein, lower end 1198 of overflow tube 1192 is fluidly coupled to flush tube 1104 below flapper 1106 such that water from overflow tube 1192 may flow into bowl 1034 when flush valve assembly 1100 is closed.

While bowl 1034 is being refilled, water in outlet tube 1090 also flows into tank refill tube 1094 in order to replenish the water in tank 1020. With flush valve assembly 1100 in the closed position, the water flowing from tank refill tube 1094 remains in tank 1020. Tank sensor 1194 or 1194' may be used to indicate to controller 1208 when tank 1020 has been sufficiently replenished with water. Fill valve assembly 1040 may be calibrated such that bowl 1034 and tank 1020 are sufficiently replenished with water at approximately the same time. Any excess water in tank 1020 may flow into overflow tube 1192, through flush tube 1104, and into bowl 1034 in order to spill over into trapway 1038. However, under normal or correct operation of tank sensor 1194 or 1194', there is no excess water in tank 1020.

Flush actuator assembly 1108 may remain pressurized when inlet 1042 and outlets 1044 and 1046 of fill valve assembly 1040 are open, such that diaphragm 1122, piston 1138, and piston rod 1140 remain depressed. In order to relieve the pressure in flush actuator assembly 1108, electrically-operable valve assembly 1048 moves to the closed position. With particular reference to FIG. 25A, a magnetic force is no longer generated and the bias of spring 1078 pushes armature 1076 away from pole 1074. As such, pilot hole 1066 is sealed, thereby pressurizing diaphragm 1062 and preventing water flow between valve seat 1061 and diaphragm 1062. More particularly, the force behind diaphragm 1062 overcomes the force at the front of diaphragm 1062 (i.e., the force created by the water at inlet 1042) such that diaphragm 1062 does not flex in response thereto.

Figure 37:
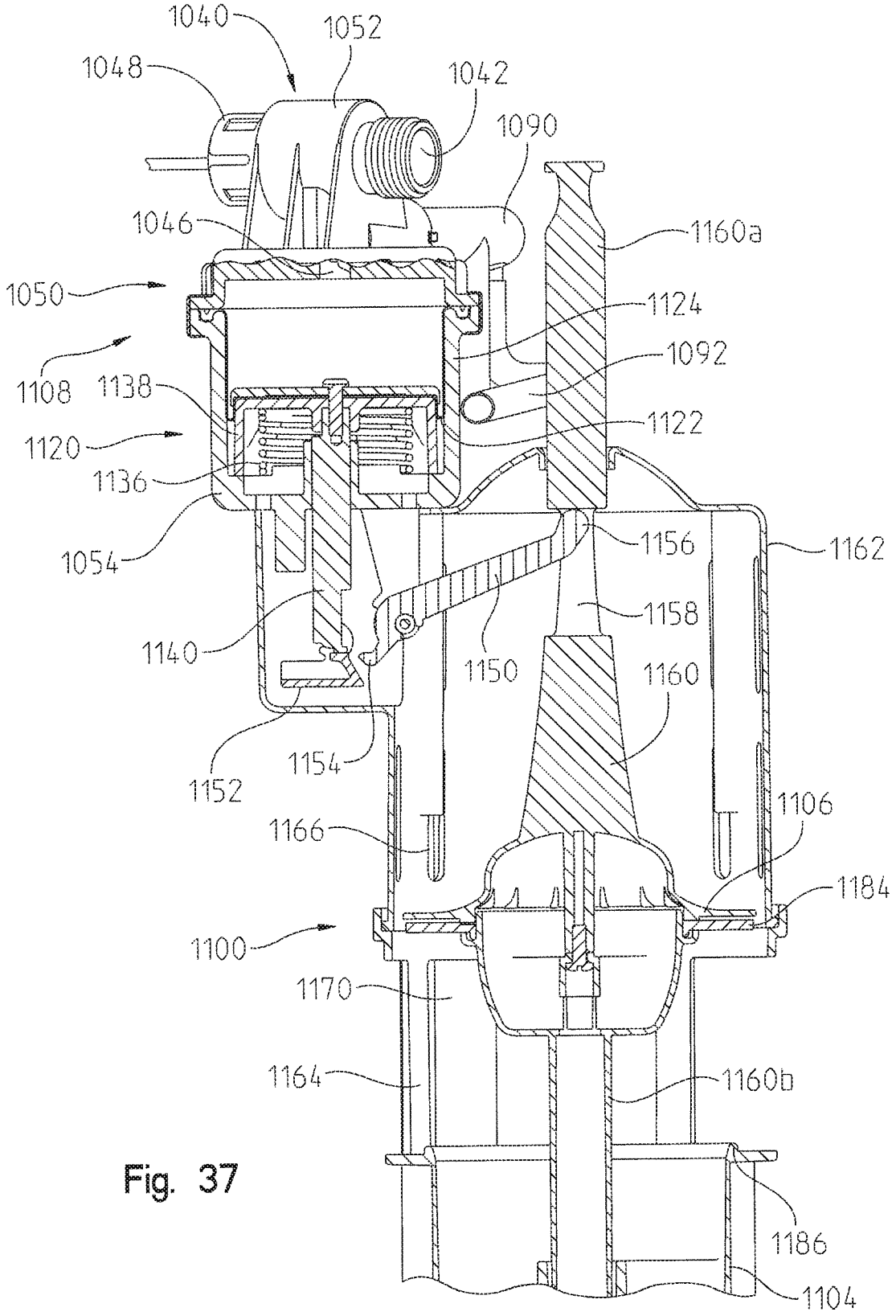
FIG. 37 is a cross-sectional view of the flush valve assembly of FIG. 33, illustrating the lever arm pivoting downwardly to close the flush valve assembly.
Figure 38:
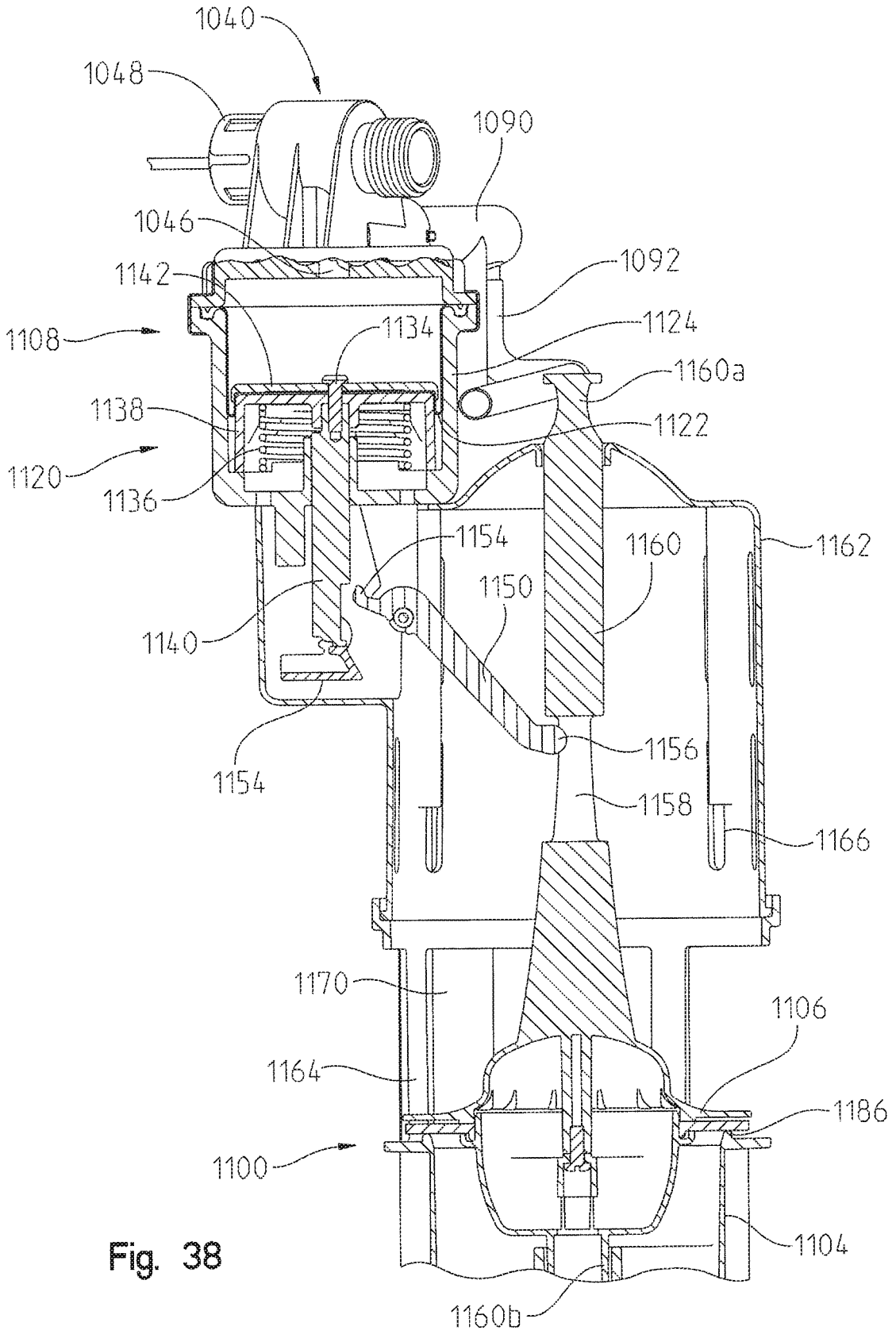
FIG. 38 is a cross-sectional view of the flush valve assembly of FIG. 33 in the closed position at a further stage of the flush cycle.
Figure 39:
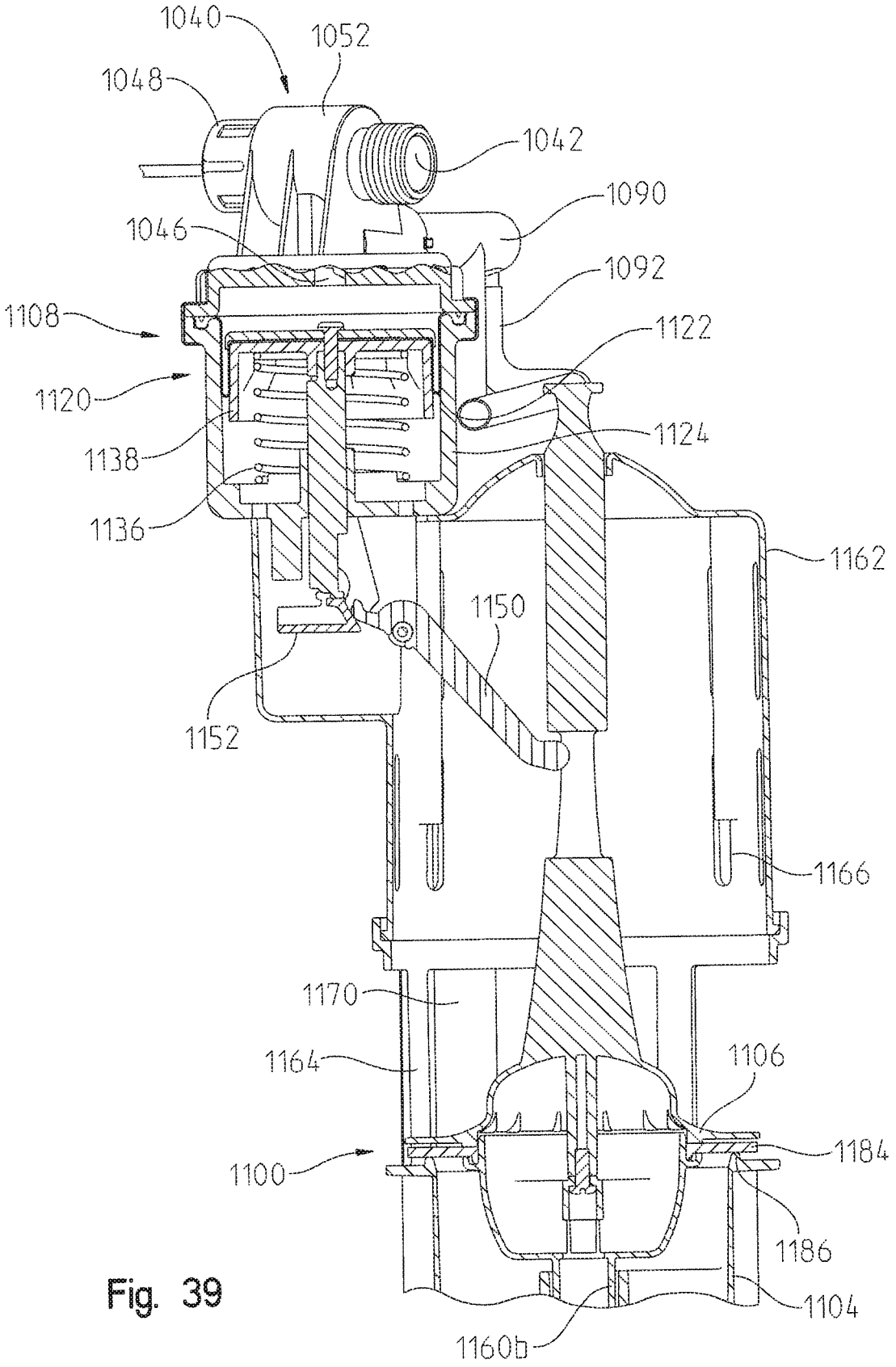
FIG. 39 is a cross-sectional view of the flush valve assembly of FIG. 33 at the end of the flush cycle.

With inlet 1042 sealed, the water depressing diaphragm 1122 may flow upward through flush actuator outlet 1046 in order to be released through refill outlet 1044 after tank 1020 and bowl 1034 have been refilled. Alternatively, fill valve assembly 1040 may include a separate bleed hole (not shown) to release the water in flush actuator assembly 1108. By reducing the water pressure in flush actuator assembly 1108, diaphragm 1122, piston 1138, spring 1136, and piston rod 1140 move upwardly due to the bias of spring 1136, as shown in FIGS. 37-39. This upward movement allows piston lever 1152 to rotate over first end 1154 of lever arm 1150 and return to its original position (FIGS. 33 and 39). Before and after a flush cycle is initiated, piston lever 1152 is not in contact with lever arm 1150, however, lever arm 1150 may remain positioned within channel 1158 of post 1160 before, during, and after a flush cycle.

Piston lever 1152 may not be in contact with lever arm 1150 at the end of the flush cycle and, as such, it may be necessary for a user to wait until the pressure in flush actuator assembly 1108 has been relieved before another flush cycle may be initiated. Alternative embodiments of controller 1208 may be configured to send a signal to electrically-operable valve assembly 1048 in order to initiate an additional flush cycle before tank 1020 and bowl 1034 have been fully refilled.

Controller 1208 may be configured with a "timer" or "shut off" function which turns off fill valve assembly 1040 after being open for a predetermined time with no signal from tank sensor 1194 or 1194'. For example, if tank 1020 has not been refilled with water within a predetermined duration of time (e.g., two minutes). In particular, if tank sensor 1194 or 1194' malfunctions and does not indicate to controller 1208 that water in tank 1020 is at the level of sensor 1194 or 1194', then water will continuously flow from tank 1020 into bowl 1034 through overflow tube 1192. As such, the timer function of controller 1208 is a "backup" to tank sensor 1194 or 1194' to prevent water from continuously flowing into bowl 1034 if the water level in tank 1020 cannot be determined within a predetermined length of time after a flush cycle has been initiated.

Indicator 1110 may include a lens in order to be illuminated with a light source (e.g., a light-emitting diode ("LED")) or other device. As such, at least a portion of indicator 1110 may be illuminated according to certain applications and conditions of toilet 1010. For example, controller 1208 may illuminate indicator 1110 during certain hours, such as at night, or when the lavatory is dark. Indicator 1110 also may include a photo sensor to detect the absence of light.

Additionally, controller 1208 may illuminate indicator 1110 when it is time to change battery 1116. Indicator 1110 is configured to produce a plurality of colors in both solid and flashing form. For example, indicator 1110 may be illuminated with a solid blue color to indicate that toilet 1010 is operating normal, a solid green color to indicate a leak in tank 1020, a solid and/or flashing red color to indicate a low battery warning, a flashing blue color to indicate an overflow condition, a flashing green color to indicate a combined leak and overflow condition, a yellow or orange color to indicate a cleaning condition or mode, and a purple color to indicate that the fill time for tank 1020 was exceeded. Other colors and indications are contemplated for other modes.

In operation, indicator 1110 illuminates when a user triggers flush actuation sensor 1112 through indicator 1110. Indicator 1110 remains illuminated during a flush cycle and may turn off, for example, when tank sensor 1194 or 1194' signals controller 1208 that tank 1020 is full. Alternatively, if a flush cycle is not initiated (e.g., when an overflow condition is sensed), indicator 1110 will remain illuminated for a predetermined amount of time.

Referring to FIGS. 41-44, an alternative embodiment of toilet 1010 includes a handle assembly 1300 coupled to tank 1020' for initiating a flush cycle. The alternative embodiment of toilet 1010 may include many of the similar features detailed above, wherein like reference numbers identify similar components. Handle assembly 1300 is operably coupled to flush valve assembly 1100' through a coupling device, illustratively a chain 1302. The coupling device also may be a wire, line, rod, or other similar component for operably coupling handle assembly 1300 to flapper 1106'. As is detailed above, flush valve assembly 1100' includes flush tube 1104' and flapper 1106'. Flapper 1106' is coupled to chain 1302 with conventional fasteners. Overflow tube 1192 is fluidly coupled to flush tube 1104' through bracket 1204'.

Figure 42A:
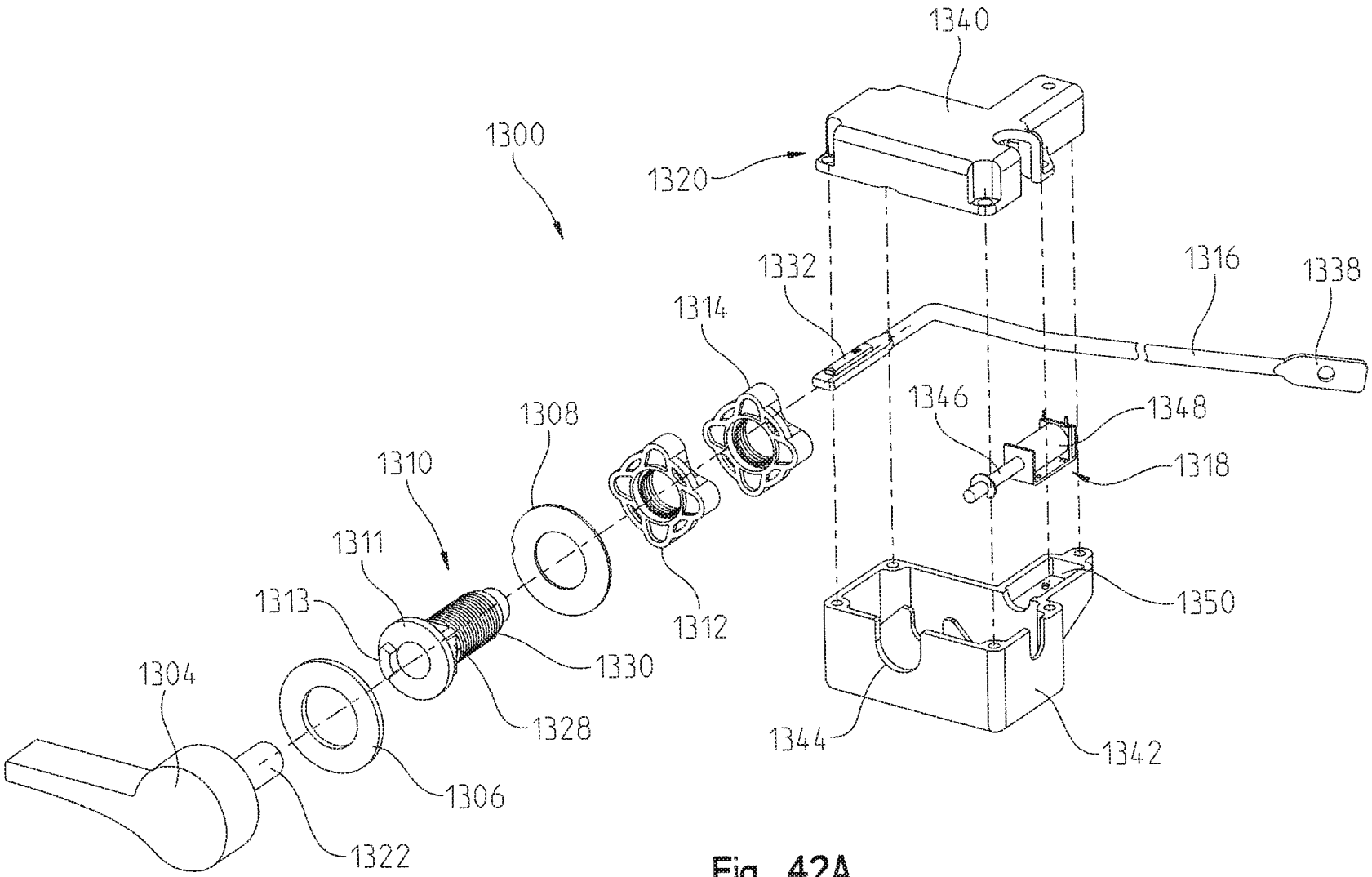
FIG. 42A is a front exploded view of the alternative embodiment handle assembly of FIG. 41.
Figure 42B:
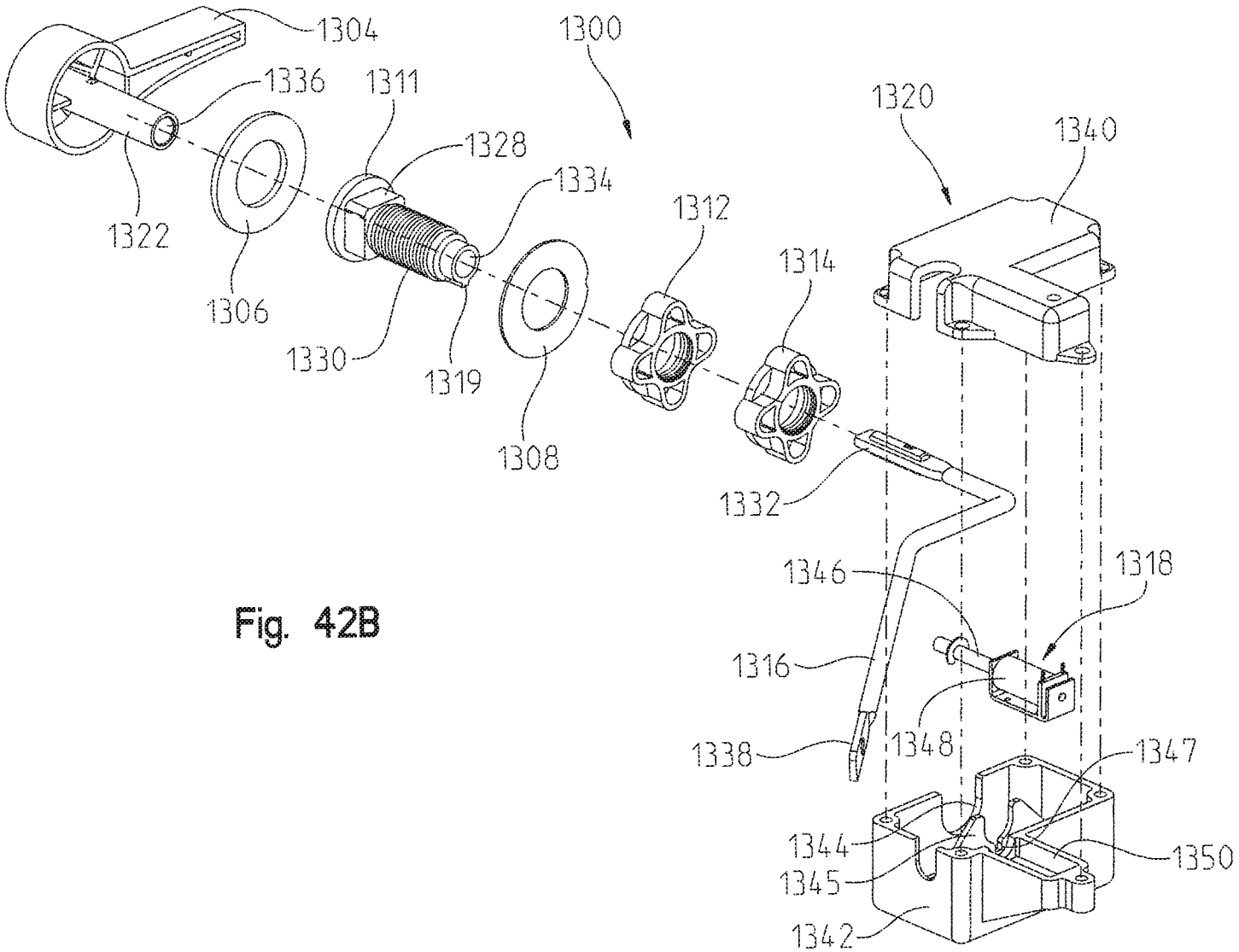
FIG. 42B is a rear exploded view of the handle assembly of FIG. 42A.
Figure 42C:
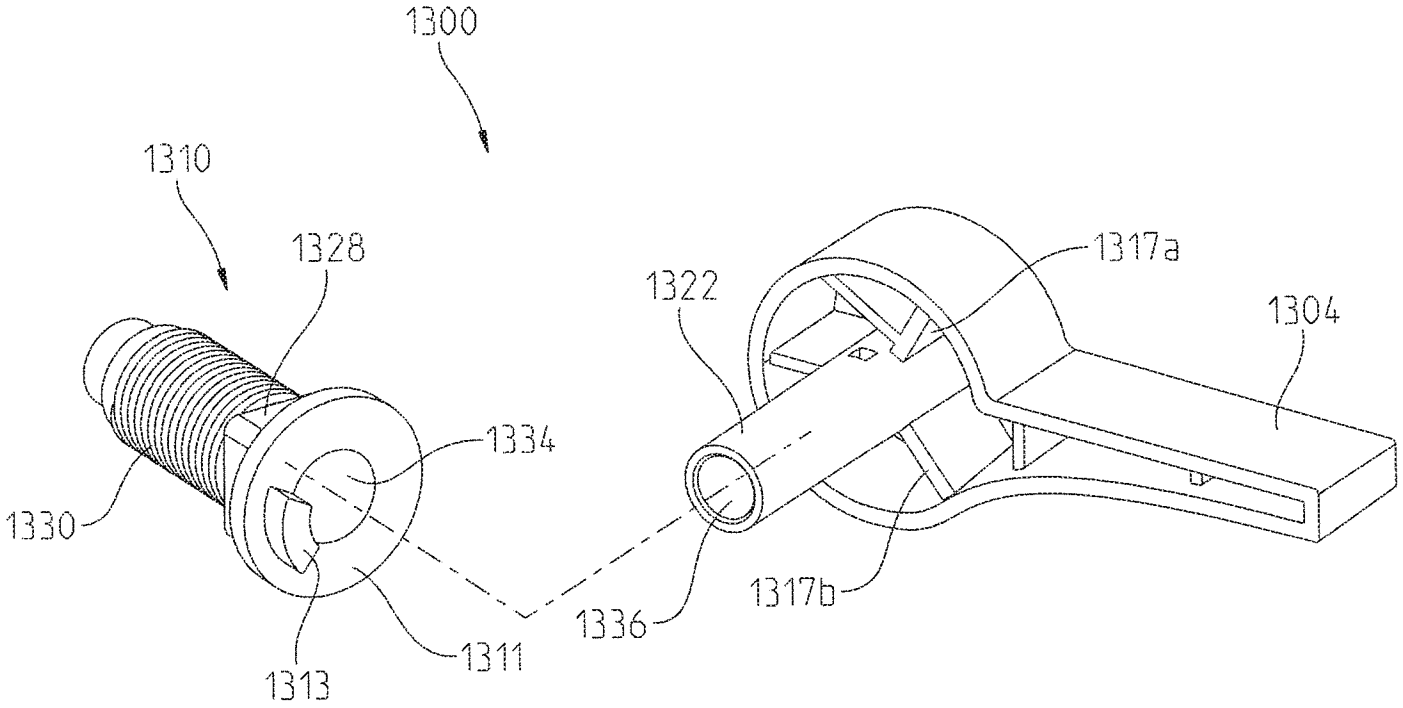
FIG. 42C is a rear exploded view of a handle and a coupler of the handle assembly of FIG. 42B.

As shown in FIGS. 42A-C, handle assembly 1300 includes a handle 1304, washers 1306 and 1308, a plurality of couplers, illustratively a threaded coupler 1310 and nuts 1312 and 1314, a lever arm 1316, a blocking pin assembly 1318, and a housing 1320. Handle assembly 1300 is supported on tank 1020' such that handle 1304 is positioned outwardly from tank 1020' and housing 1320 is positioned within tank 1020'. A post 1322 of handle 1304 extends through an aperture (not shown) in tank 1020' in order to coupled with lever arm 1316 to operate flush valve assembly 1100'. In particular, a first end 1332 of lever arm 1316 is received within an aperture 1334 of threaded coupler 1310 and an aperture 1336 of post 1322. A second end 1338 of lever arm 1316 is coupled to chain 1302. Lever arm 1316 includes a generally right-angle bend adjacent first end 1332 in order to extend lever arm 1316 toward chain 1302 and flapper 1106'.

Figure 41:
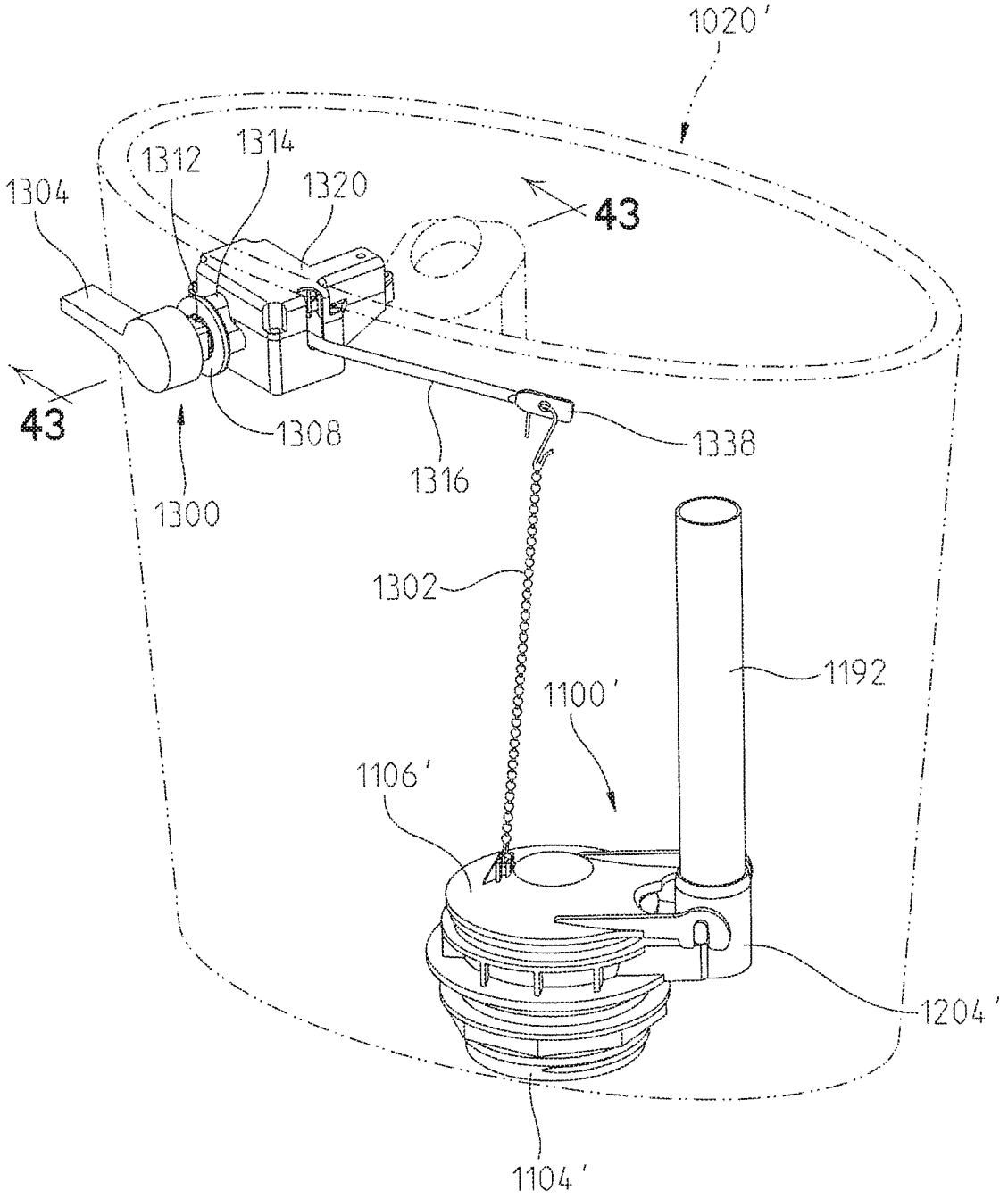
FIG. 41 is a front perspective view of an alternative embodiment of the overflow assembly of FIG. 22, including a handle assembly coupled to a tank and having a blocking pin assembly.

Coupler 1310 is fixed to tank 1020' by a mounting portion 1328. Illustratively, mounting portion 1328 defines a square cross-section and the aperture in tank 1020' also may define a square. Threaded portion 1330 of threaded coupler 1310 is received through aperture 1324 of washer 1306 and an aperture 1326 of washer 1308 and is threadedly coupled with nut 1312 and nut 1314 to fix coupler 1310 to tank 1020'. As such, coupler 1310 does not rotate relative to tank 1020'. As shown in FIG. 41, nut 1314 may be positioned outside of housing 1320 when coupled with threaded portion 1330, or alternatively, nut 1314 may be positioned within housing 1320 when coupled with threaded portion 1330. Nuts 1312, 1314 allow handle assembly 1300 to accommodate varying thicknesses of the walls of various tanks.

Coupler 1310 also is coupled to housing 1320. Housing 1320 includes an upper housing member 1340 and a lower housing member 1342. Upper and lower housing members 1340, 1342 are coupled together by conventional means (e.g., fasteners, welds, rivets, adhesive). Lower housing member 1342 includes an upstanding member 1345 which has a groove 1347. When threaded portion 1330 extends along a surface 1344 of lower housing member 1342, a rib 1319 on coupler 1310 (FIG. 42B) is received within groove 1347. When rib 1319 is positioned within groove 1347, housing 1320 is fixed to coupler 1310. As such, housing 1320 also is fixed to tank 1020' because coupler 1310 is fixed to tank 1020'. Therefore, coupler 1310 prevents housing 1320 from rotating when handle 1304 is depressed by a user.

Housing 1320 further supports pin assembly 1318, which includes a pin 1346 and a motor assembly or an electrically-operable valve assembly, illustratively a solenoid valve 1348. Solenoid valve 1348 is electrically coupled to a controller, for example controller 1208 (FIG. 40), in order to control the movement of handle 1304. Controller 1208 also may be in electrical communication with bowl sensor 1210 (FIG. 40) in order to detect an overflow condition in bowl 1034 (FIGS. 20 and 21). Pin assembly 1318 is supported on a portion 1350 of housing 1320, which is elevated relative to cut-out portion 1344. As such, pin assembly 1318 is elevated relative to lever arm 1316.

Figure 44:
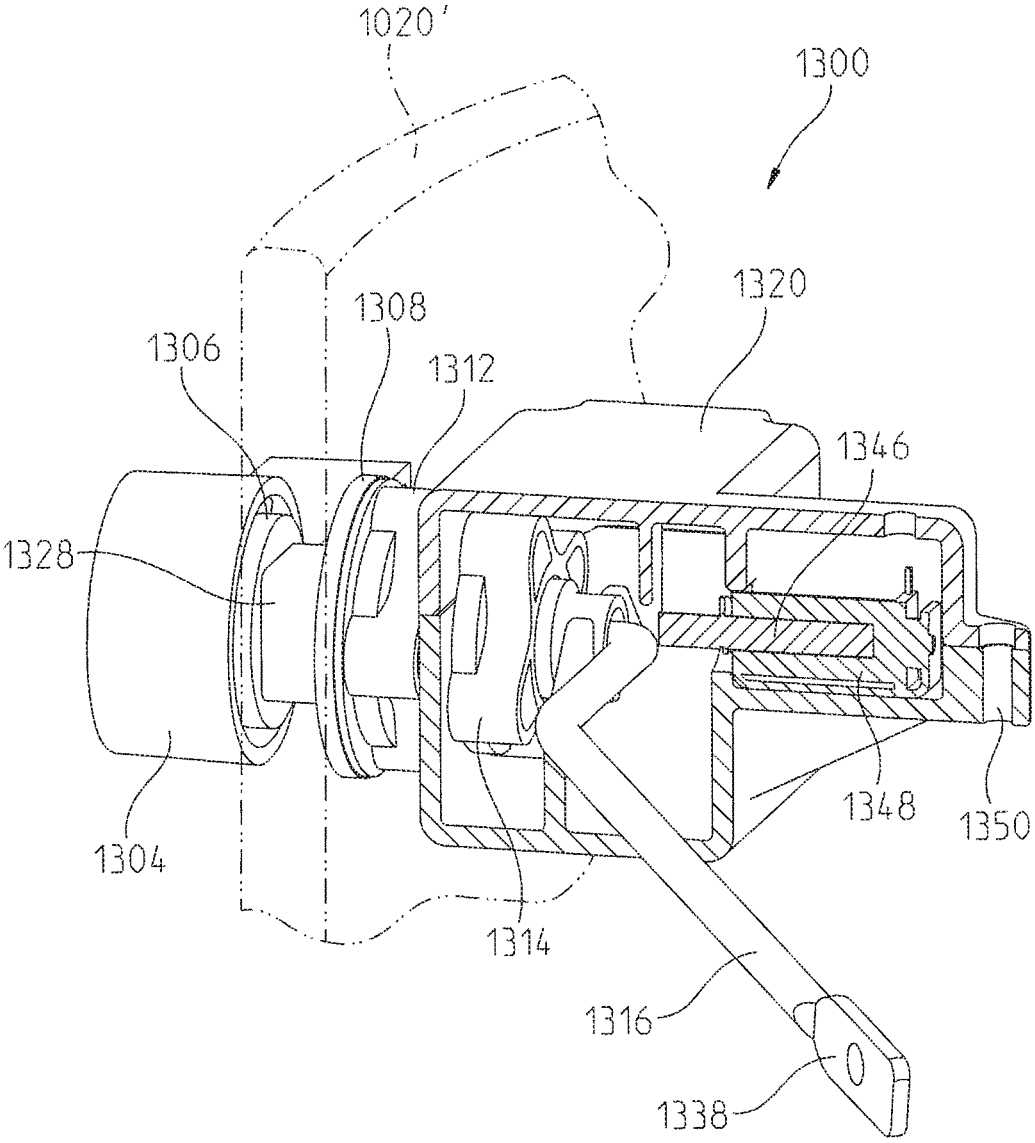
FIG. 44 is a cross-sectional view of the handle assembly of FIG. 43 in a flush position.
Figure 45:
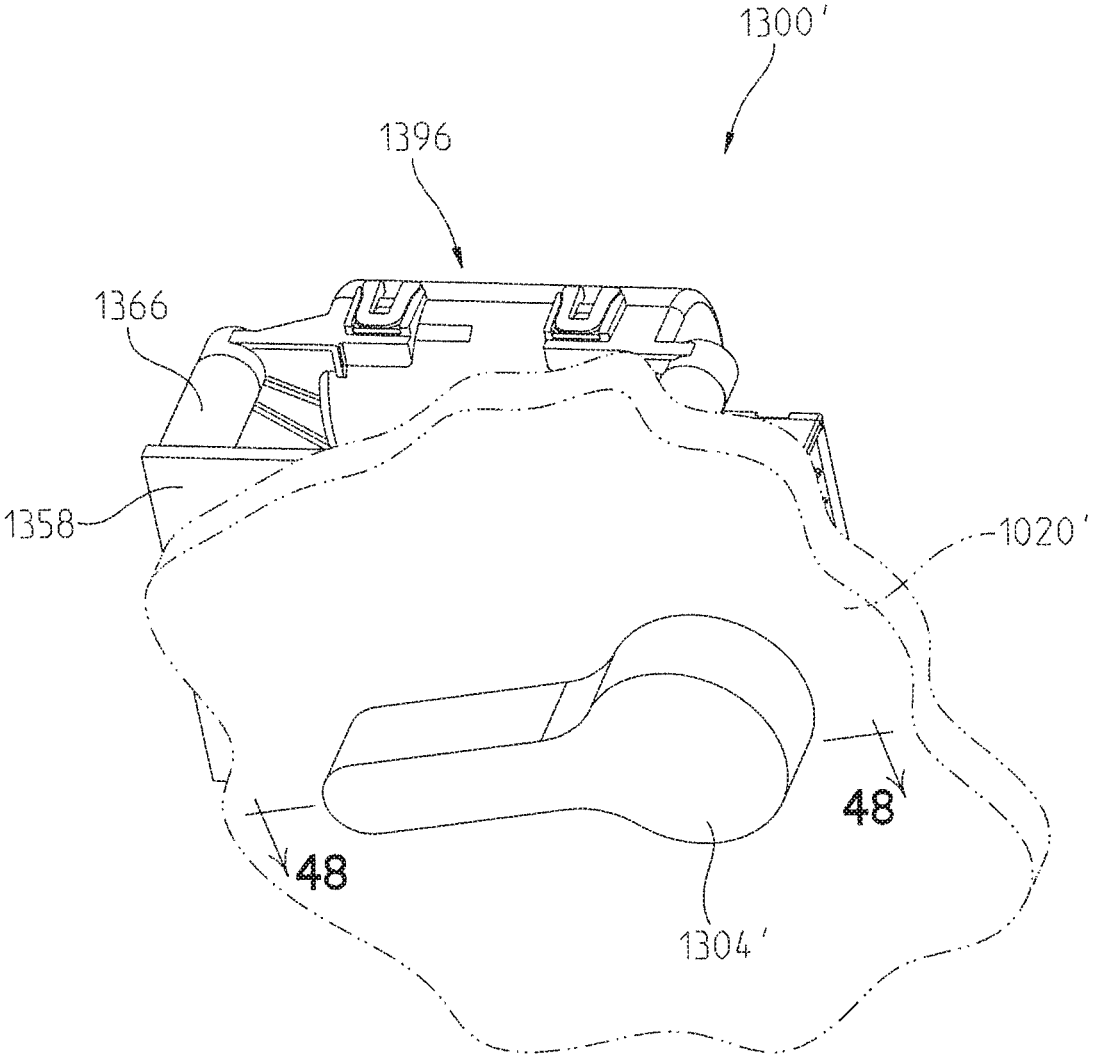
FIG. 45 is a front perspective view of an alternative embodiment of the handle assembly of FIG. 41, including an alternative embodiment of the blocking pin assembly.

During operation, if no overflow condition is detected by bowl sensor 1210, handle assembly 1300 is in a flush position and controller 1208 allows handle 1304 to rotate. As such, when a user desires to initiate a flush cycle for toilet 1010, handle 1304 is depressed. Handle 1304 and lever arm 1316 rotate together relative to coupler 1310, such that the rotation of handle 1304 also causes first end 1332 of lever arm 1316 to rotate through post 1322 of handle 1304. More particularly, first end 1332 of lever arm 1316 rotates in a counter-clockwise direction in housing 1320 and second end 1338 rotates upwardly in tank 1020'. The upward rotation of second end 1338 pulls up on chain 1302 and, therefore, on flapper 1106'. As such, flush valve assembly 1100' is opened and water from tank 1020' flows through flush tube 1104' and into bowl 1034 (FIG. 20). As shown in FIG. 44, pin 1346 is retracted within solenoid valve 1348 and, therefore, does not interfere with the rotation of lever arm 1316 when handle 1304 is depressed by a user.

The rotation of handle 1304 may be limited by a protrusion 1313 on an end 1311 of coupler 1310. More particularly, handle 1304 includes surfaces 1317*a* and 1317*b*, which are spaced apart from each other and extend generally outward from post 1322. Protrusion 1313 is received within a slot of handle 1304 defined by surfaces 1317*a*, 1317*b*. As such, when handle 1304 rotates, the downward movement of handle 1304 is stopped when surface 1317*a* contacts protrusion 1313. Additionally, the upward movement of handle 1304 is stopped when surface 1317*b* contacts protrusion 1313.

Figure 43:
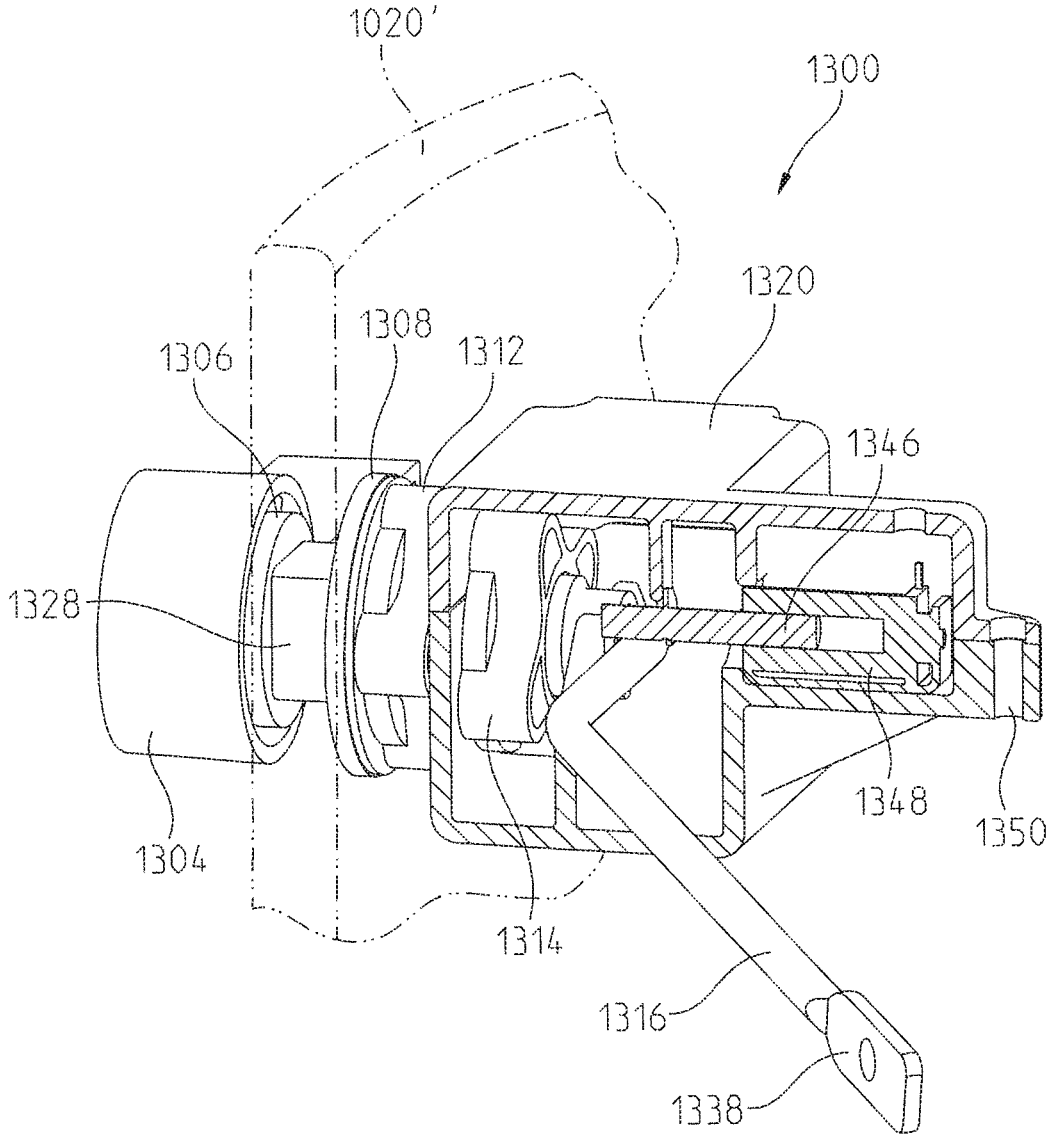
FIG. 43 is a cross-sectional view of the handle assembly of FIG. 41, taken along line 43-43 of FIG. 41, in an overflow position.

However, as shown in FIG. 43, if an overflow condition is detected by bowl sensor 1210, handle assembly 1300 is in an overflow position and controller 1208 prevents rotation of handle 1304. In particular, controller 1208 actuates solenoid valve 1348, illustratively a latching-type solenoid valve, which projects pin 1346 outwardly such that pin 1346 is positioned above lever arm 1316. As such, pin 1346 interferes with the rotation of lever arm 1316. As shown in FIG. 43, pin 1346 prevents second end 1338 of lever arm 1316 from rotating upwardly. As such, when a user desires to initiate a flush cycle after an overflow condition is detected, the user will not be able to depress handle 1304. Rather, as the user attempts to depress handle 1304 and second end 1338 of lever arm 1316 attempts to rotate upwardly, pin 1346 prevents such rotation. Therefore, the user cannot fully depress handle 1304 and flapper 1106' does not move away from flush tube 1104'. Pin 1346 prevents the flush cycle when an overflow condition is detected.

Once an overflow condition is no longer detected by bowl sensor 1210 (FIG. 40), controller 1208 signals solenoid valve 1348 to retract pin 1346 such that second end 1338 is allowed to rotate and, therefore, handle 1304 may be depressed by the user.

Referring to FIGS. 45-49, an alternative embodiment handle assembly 1300' is coupled to tank 1020' for initiating a flush cycle. The alternate embodiment handle assembly 1300' may include many of the similar features detailed above, wherein like reference numbers identify similar components. Handle assembly 1300' is operably coupled to flush valve assembly 1100' through a coupling device, illustratively a chain 1302 (FIG. 41). Flapper 1106' is coupled to chain 1302 with conventional fasteners.

Figure 46:
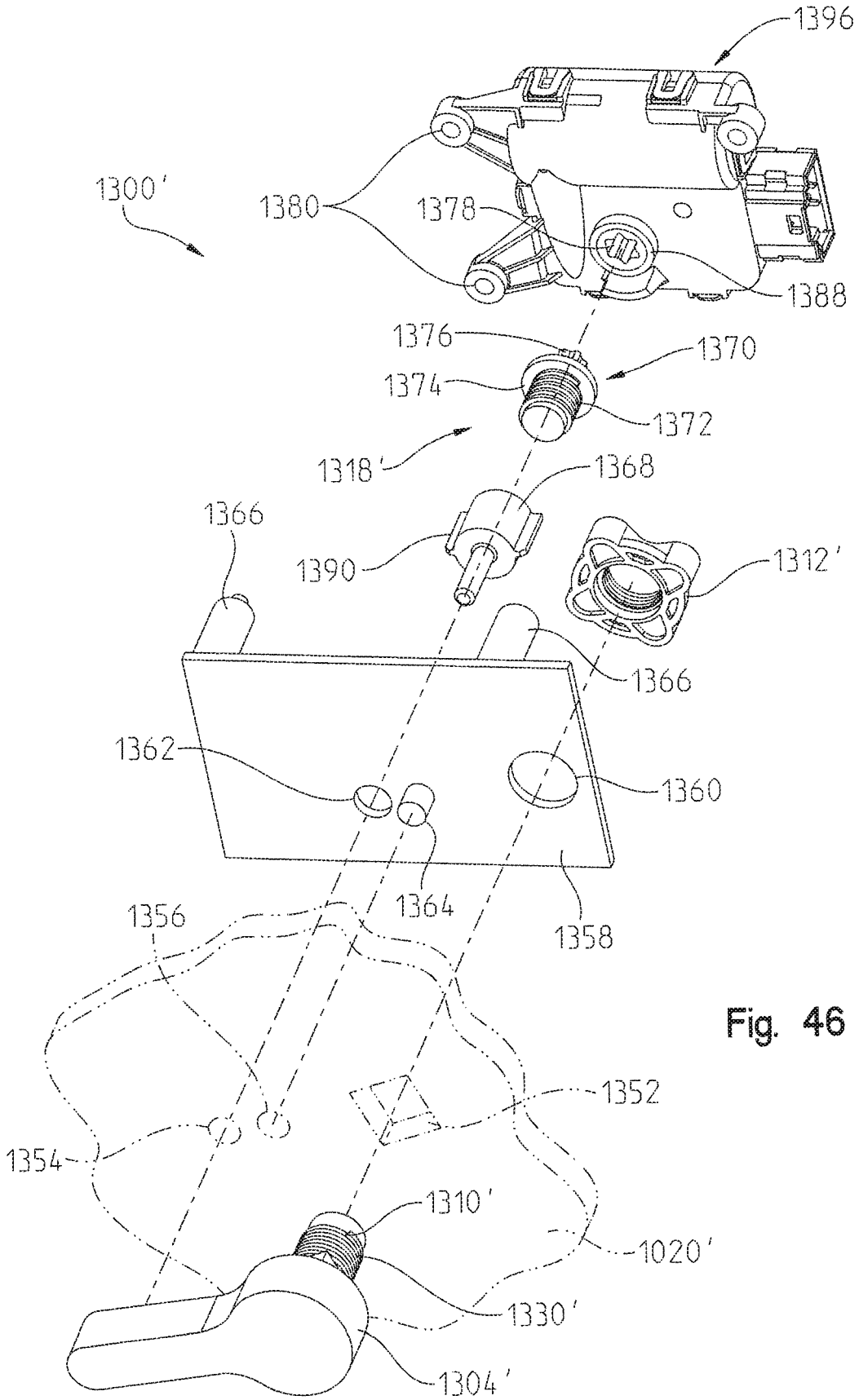
FIG. 46 is a front exploded view of the alternative embodiment handle assembly of FIG. 45.
Figure 47:
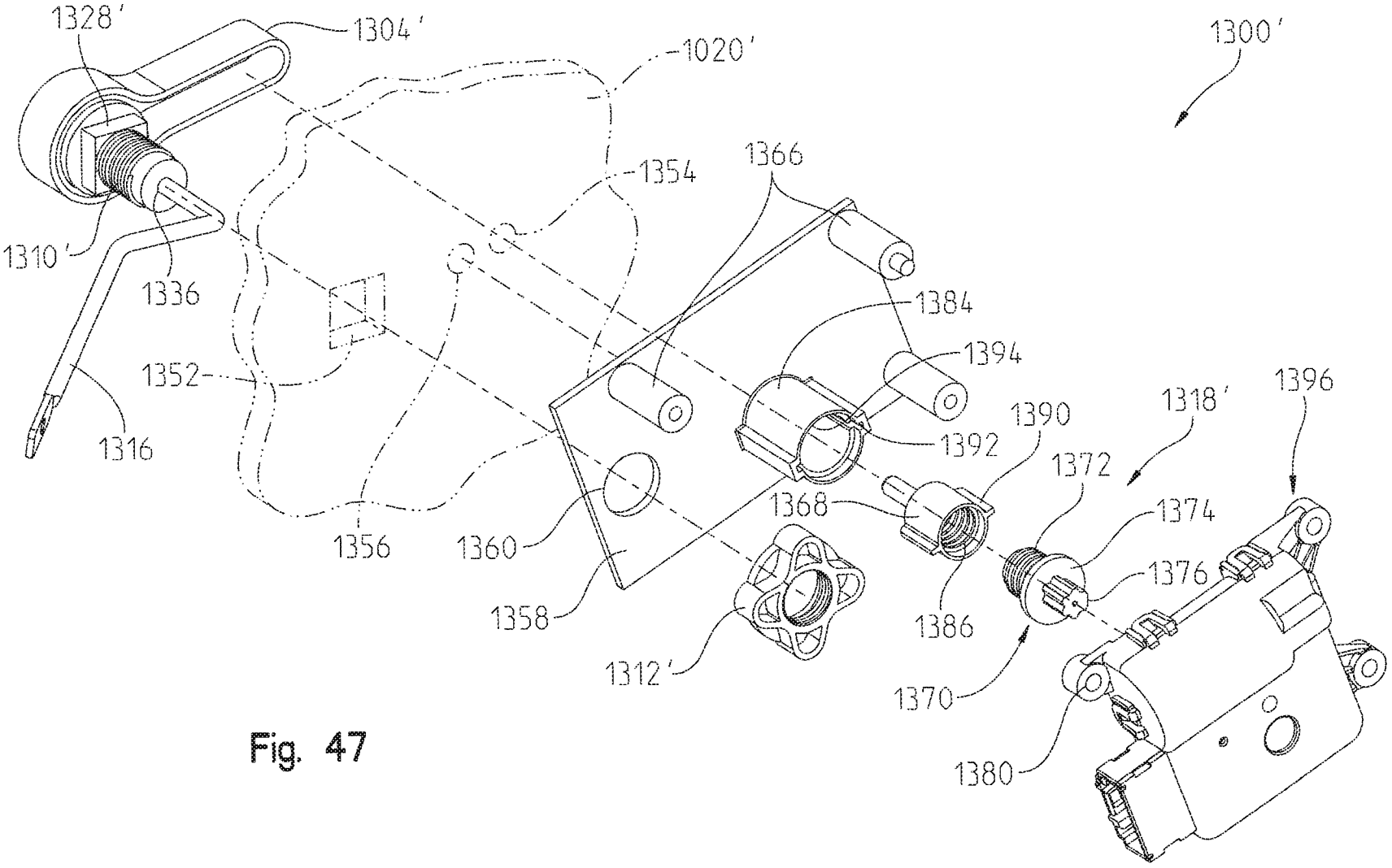
FIG. 47 is a rear exploded view of the handle assembly of FIG. 45.

As shown in FIGS. 46 and 47, handle assembly 1300' includes a handle 1304' having a mounting portion 1328' and a post 1322', a plate 1358, a locating pin 1364 extending from plate 1358, blocking pin assembly 1318', a plunger 1370, and a power output assembly, illustratively a motor assembly 1396. To couple handle 1304' with tank 1020', post 1322' is received through an aperture 1352 in tank 1020' such that mounting portion 1328' is positioned within aperture 1352. Illustratively, both mounting portion 1328' and aperture 1352 define a square in cross-section. Post 1322' is further received through an aperture 1360 in plate 1358 in order to be secured thereto with nut 1312'. Handle 1304' is operable coupled to flush valve assembly 1100' through lever arm 1316 and chain 1302 (FIG. 41). As such, rotation of handle 1304' causes lever arm 1316 to rotate and pull up on chain 1302 and flapper 1106' to initiate a flush cycle.

Plate 1358 is positioned on tank 1020' using locating pin 1364, which is positioned within an aperture 1356 of tank 1020. Plate 1358 is coupled to motor assembly 1396 through legs 1366 extending from plate 1358. Legs 1366 are received within apertures 1380 on motor assembly 1396. Battery 1116 provides power to controller 1208 for operating motor assembly 1396. Motor assembly 1396 also is configured to receive an electrical signal from controller 1208 (FIG. 40) in order to selectively operate motor assembly 1396 in response to signals from bowl sensor 1210 (FIG. 40) which may indicate an overflow condition in bowl 1034 (FIG. 21).

Pin assembly 1318' is supported by plate 1358 and includes a pin 1346' and a body portion 1368. Body portion 1368 includes flanges 1390. Pin 1346' extends from body portion 1368 and is received through an aperture 1362 on plate 1358. Aperture 1362 is aligned with an aperture 1354 on tank 1020'. As shown in FIG. 47, a guide member 1384 extends rearwardly from plate 1358 and is configured to receive pin assembly 1318' through aperture 1394. To properly position pin assembly 1318', guide member 1384 includes grooves 1392 which receive flanges 1390. Grooves 1392 fix the rotation of body portion 1368 but allows body portion 1368 to axially slide therein. As such, grooves 1392 prevent rotation of body portion 1368 when plunger 1370 is rotated by motor assembly 1396, as detailed herein.

Body portion 1368 includes an aperture 1386 having internal threads for threadedly coupling with external threads 1372 of plunger 1370. Plunger 1370 is received within aperture 1386 of pin assembly 1318' (FIG. 47) and further includes a flange 1374 and a protrusion 1376. Illustratively, flange 1374 is intermediate threads 1372 and protrusion 1376. Protrusion 1376 is received within a channel 1378 of motor assembly 1396 (FIG. 46). Channel 1378 includes an internal profile generally corresponding to the external profile of protrusion 1376. Channel 1378 further includes a stop surface 1388 that abuts flange 1374 when protrusion 1372 is received within channel 1378.

Figure 48:
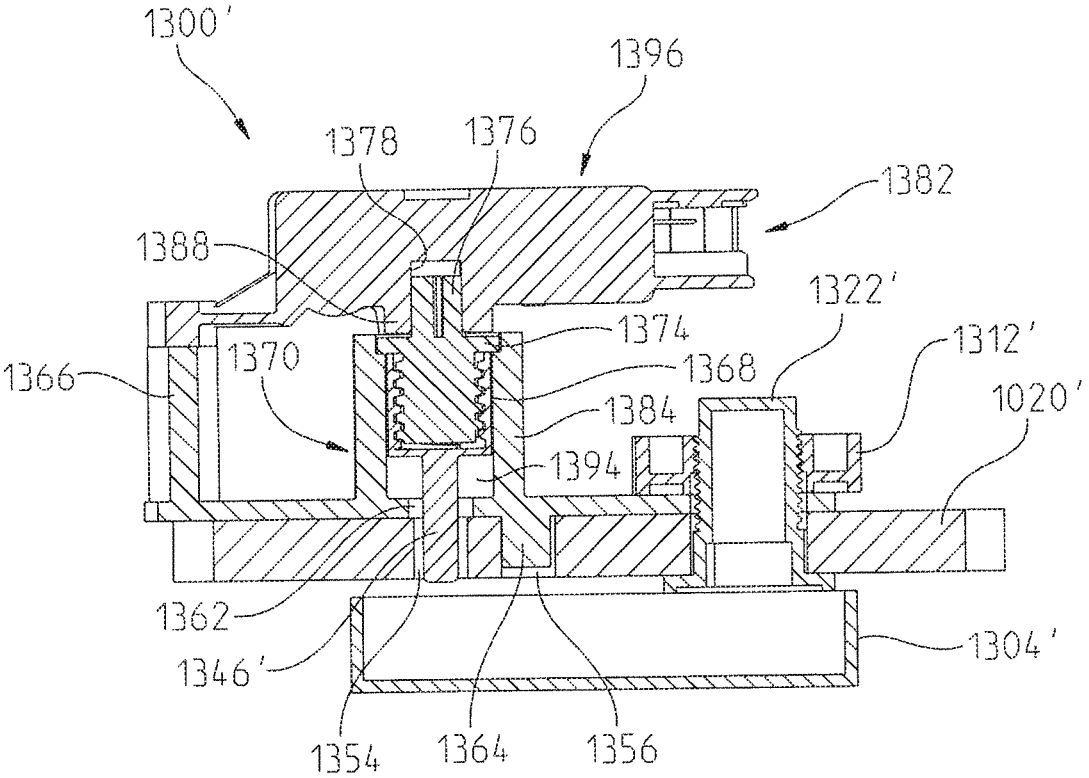
FIG. 48 is a top cross-sectional view of the handle assembly of FIG. 45, taken along line 48-48 of FIG. 45, in a flush position.

In operation, if no overflow condition is detected by bowl sensor 1210, handle assembly 1300' is in a flush position and controller 1208 allows handle 1304' to rotate. As such, when a user desires to initiate a flush cycle for toilet 1010, handle 1304' is depressed. The rotation of handle 1304' also causes lever arm 1316 to rotate, thereby pulling up on chain 1302 and, therefore, on flapper 1106' (FIG. 41). As such, flush valve assembly 1100' is opened and water from tank 1020' flows through flush tube 1104' and into bowl 1034 (FIG. 20). As shown in FIG. 48, pin 1346' is retracted and does not extend from aperture 1362 of plate 1358 and aperture 1354 of tank 1020'. Therefore, pin 1346' does not interfere with the rotation of handle 1304', and hence lever arm 1316, when handle 1304' is depressed by a user. Also, when in the flush position, body portion 1368 of pin assembly 1318' abuts flange 1374 of plunger 1370 to prevent pin 1346' from extending beyond aperture 1354 of tank 1020'.

Figure 49:
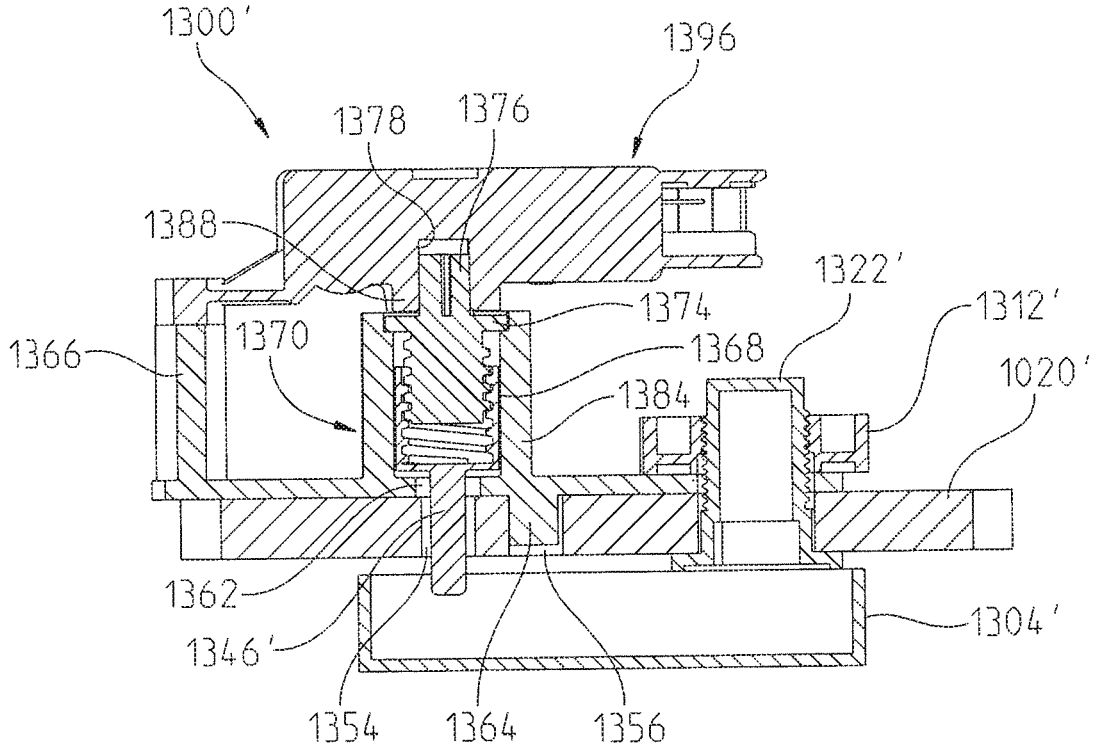
FIG. 49 is a top cross-section view of the handle assembly of FIG. 48 in an overflow position.

However, as shown in FIG. 49, if an overflow condition is detected by bowl sensor 1210, handle assembly 1300' is an overflow position and controller 1208 prevents rotation of handle 1304'. In particular, controller 1208 actuates motor assembly 1396 to project pin 1346' outwardly from plunger 1370 such that pin 1346' extends into handle 1304'. As such, pin 1346' interferes with the rotation of handle 1304'. As shown in FIG. 49, protrusion 1376 of plunger 1370 remains within channel 1378 such that flange 1374 of plunger abuts stop surface 1388 of channel 1378. However, motor assembly 1396 causes channel 1378 and, therefore, plunger 1370 to rotate. The rotation of plunger 1370 moves pin assembly 1318' outward from body portion 1368 and toward handle 1304' because the internal threads at apertures 1386 of pin assembly 1318' rotate against external threads 1372 on plunger 1370. As such, pin assembly 1318' moves toward handle 1304' such that body portion 1368 abuts plate 1358. When body portion 1368 abuts plate 1358, pin 1346' extends from aperture 1362 of plate 1358 and aperture 1354 of tank 1020' and is positioned to contact a rear portion of handle 1304'. As such, when a user attempts to depress handle 1304', handle 1304' contacts pin 1346' which prevents handle 1304' from rotating. Therefore, when a user desires to initiate a flush cycle after an overflow condition is detected, the user will not be able to depress handle 1304'.

Once an overflow condition is no longer detected by bowl sensor 1210 (FIG. 40), controller 1208 signals motor assembly 1396 to retract pin assembly 1318' such that body portion 1368 is spaced apart from plate 1358. For example, motor assembly 1396 may rotate in a reverse direction to retract pin assembly 1318' and move body portion 1368 to abut flange 1374 of plunger 1370. Therefore, handle 1304' is allowed to rotate when depressed by the user.

Referring to FIGS. 50-53, a further alternative embodiment handle assembly 1300" is coupled to tank 1020' for initiating a flush cycle. The alternate embodiment handle assembly 1300" may include many of the similar features detailed above, wherein like reference numbers identify similar components. Handle assembly 1300" is operably coupled to flush valve assembly 1100' through lever arm 1316 and a coupling device, illustratively chain 1302 (FIG. 41). Flapper 1106 is coupled to chain 1302 with conventional fasteners.

First end 1332 of lever arm 1316 is operably coupled to a handle 1304" of handle assembly 1300" and second end 1338 of lever arm 1316 is coupled to chain 1302. Conventionally, handle 1304" rotates when a user depresses handle 1304" to initiate a flush cycle, which causes second end 1338 of lever arm 1316 to rotate upwardly and pull up on chain 1302 and flapper 1106'. When flapper 1106' is spaced apart from flush tube 1104', a flush cycle is initiated because water from tank 1020' (FIG. 41) flows into bowl 1034 (FIG. 20) through flush tube 1104'.

Figure 50:
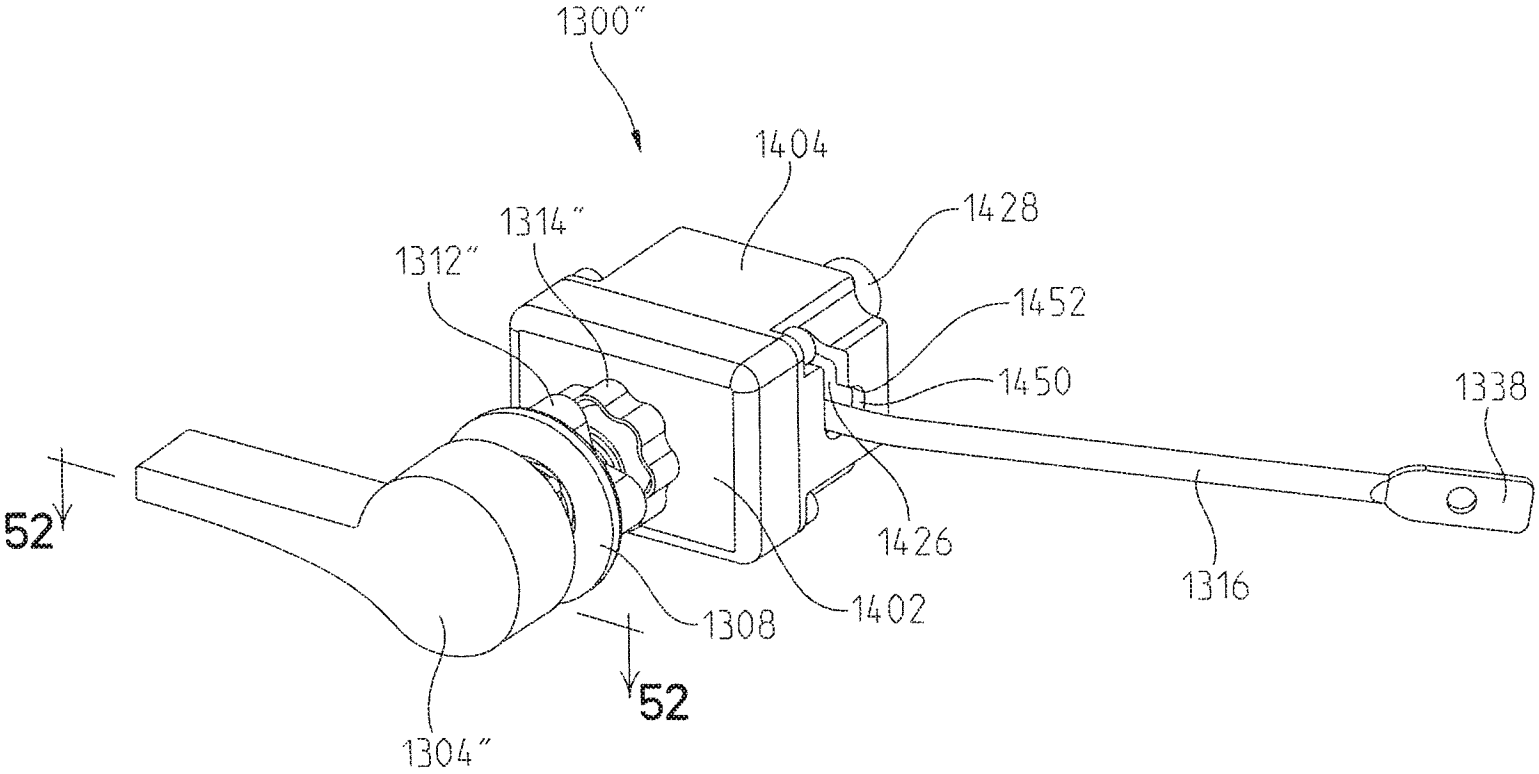
FIG. 50 is a side perspective view of an alternative embodiment of the handle assembly of FIG. 45, including a clutch assembly.
Figure 51A:
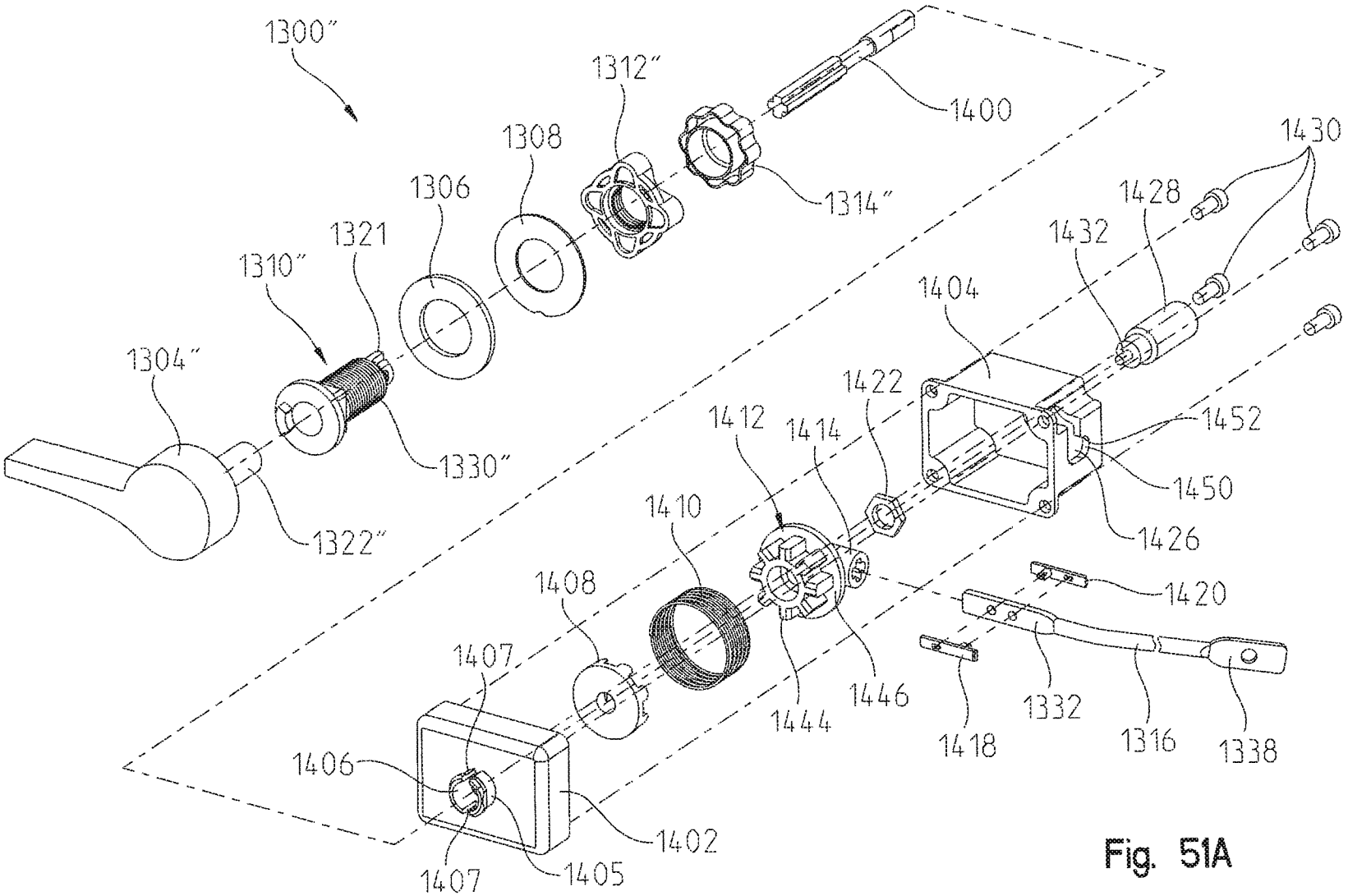
FIG. 51A is front exploded view of the alternative embodiment handle assembly of FIG. 50.
Figure 51B:
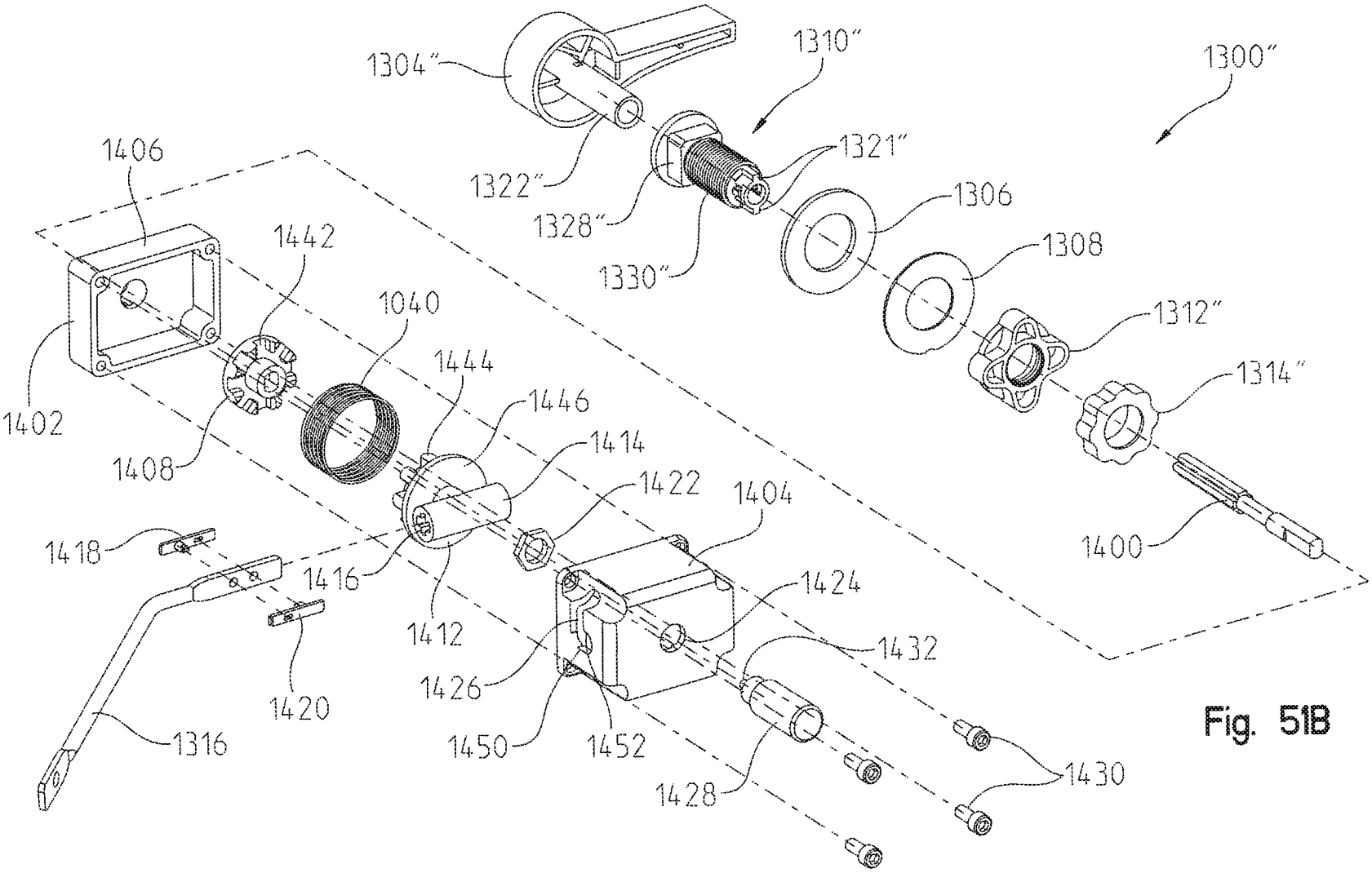
FIG. 51B is a rear exploded view of the alternative embodiment handle assembly of FIG. 51A.

As shown in FIGS. 50 and 51, handle assembly 1300" includes handle 1304", coupler 1310, washers 1306 and 1308, nuts 1312 and 1314", a rod 1400, a first clutch plate 1408, a spring 1410, a second clutch plate 1412, a plunger 1428 having a retractable tip 1432, and housing 1320" having front portion 1402 and rear portion 1404. Post 1322" of handle 1304" is received within an aperture 1398 (FIGS. 52 and 53) of coupler 1310 and washers 1306, 1308 are positioned generally adjacent mounting portion 1328 of coupler 1310. Mounting portion 1328 may be received through an aperture (not shown) in tank 1020' (FIG. 41) to couple handle assembly 1300" to tank 1020' with nut 1312. Nut 1314" also is threadedly coupled with threaded portion 1330 of coupler 1310 in order to secure housing 1320" to tank 1020'. In particular, nut 1314" snaps onto housing 1320" when resilient fingers 1405 of front portion 1402 are frictionally retained on the inner diameter of nut 1314". Fingers 1405 are separated by grooves 1407 which receive projections 1321 on coupler 1310. As such, coupler 1310 is fixed to housing 1320". Coupler 1310 also is fixed to tank 1020' and, therefore, housing 1320" is fixed to tank 1020". In this arrangement, housing 1320" does not rotate when handle 1304" is depressed.

Figure 52:
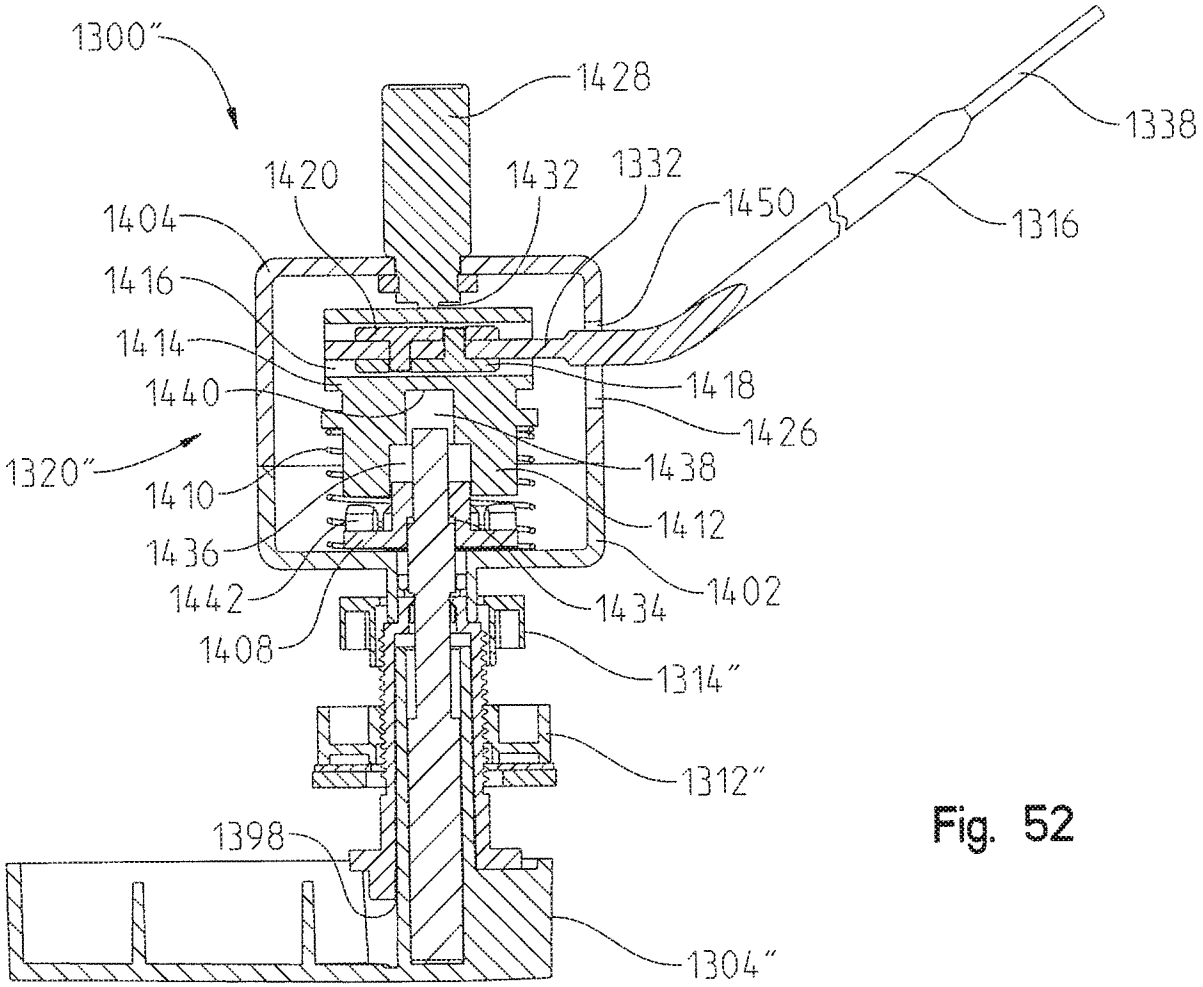
FIG. 52 is a top cross-sectional view of the handle assembly of FIG. 50, taken along line 52-52 of FIG. 50, in an overflow position.
Figure 53:
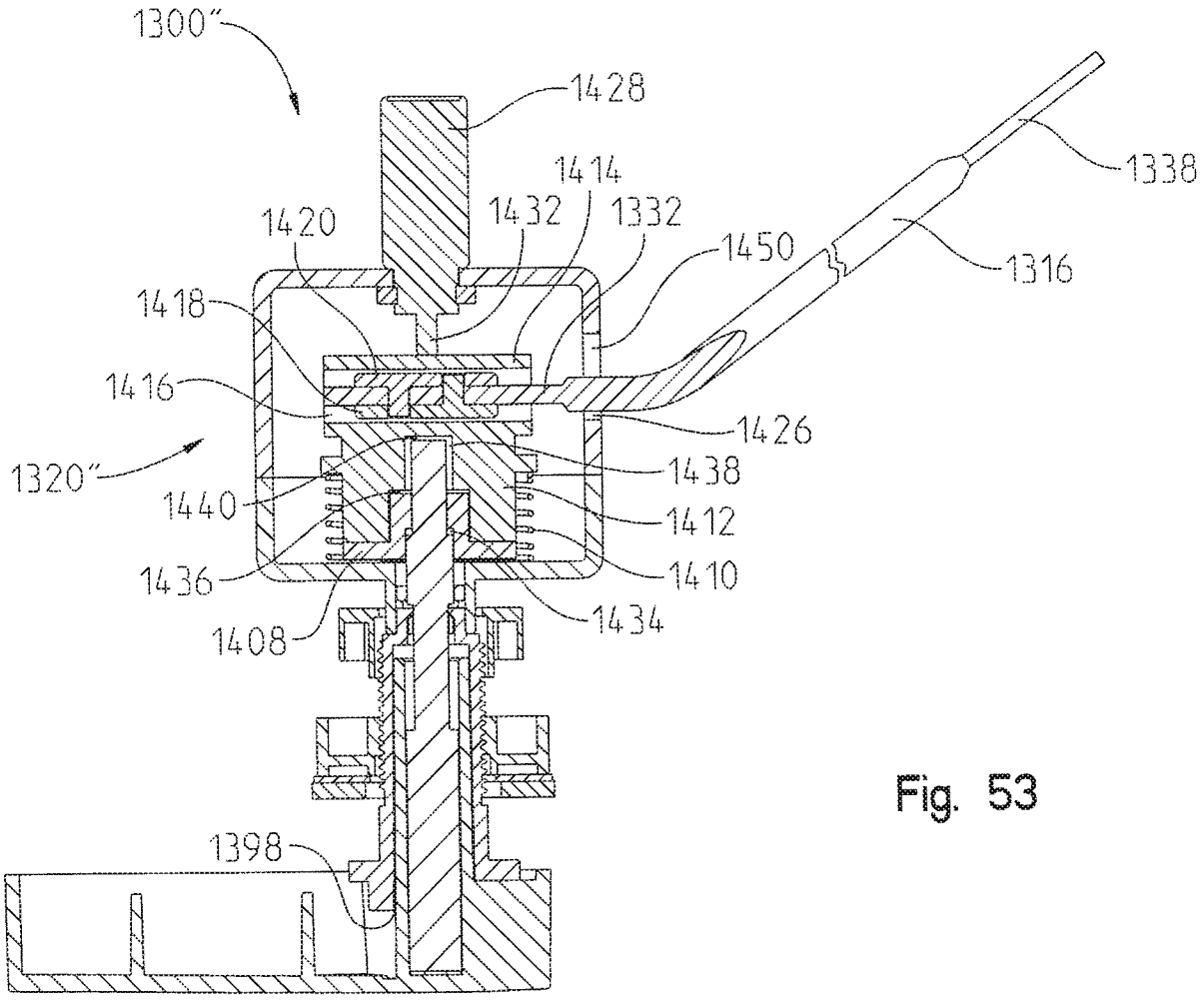
FIG. 53 is a top cross-sectional view of the handle assembly of FIG. 52 in a flush position.

Rod 1400 is received within aperture 1334 of coupler 1310 and extends into post 1322" of handle 1304" through aperture 1336. A portion of rod 1400 also is supported in housing 1320", which includes a front portion 1402 and a rear portion 1404 coupled together with fasteners 1430. In particular, rod 1400 is received through an aperture 1406 in front portion 1402 and is operably coupled to first and second clutch plates 1408, 1412. Illustratively, rod 1400 extends through an aperture 1434 of first clutch plate 1408 and is configured to be received within first and second recesses 1436, 1438 of second clutch plate 1412 (FIGS. 52 and 53). Rod 1400 is rotationally fixed to first clutch plate 1408 but is spaced apart from second clutch plate 1412.

Spring 1410 is positioned intermediate first and second clutch plates 1408, 1412. More particularly, first and second clutch plates 1408, 1412 are generally received within spring 1410 such that spring 1410 generally extends around detents 1442 of first clutch plate 1408 and detents 1444 of second clutch plate (FIGS. 51-53).

Second clutch plate 1412 includes a flange 1446 and a tubular member 1414 having a channel 1416. Channel 1416 is configured to receive lever arm 1316 therein. Lever arm 1316 is secured within channel 1416 with brackets 1418 and 1420, which are coupled together at first end 1332 of lever arm 1316. Alternatively, brackets 1418, 1420 may be integrally formed with lever arm 1316. Lever arm 1316 extends through opening 1426 in rear portion 1404 of housing 1320" in order to couple with chain 1302 (FIG. 41) for operating flush valve assembly 1100'.

Rear portion 1404 of housing 1320" further supports plunger 1428. Plunger 1428 extends through an aperture 1424 in rear portion 1404 and is secured thereto with a coupler, illustratively a nut 1422. Plunger 1428 may be electrically coupled to controller 1208 (FIG. 40) in order to selective retract and project tip 1432 from plunger 1428 in response to an overflow condition, as further detailed herein. For example, plunger 1428 may include a solenoid valve or a motor assembly (not shown) electrically coupled to controller 1208 for controlling the movement of tip 1432.

In operation, if no overflow condition is detected by bowl sensor 1210, handle assembly 1300" is in a flush position and controller 1208 allows handle 1304" to rotate. As such, when a user desires to initiate a flush cycle for toilet 1010, handle 1304" is depressed downwardly. The rotation of handle 1304" also causes lever arm 1316 to rotate within opening 1426 of rear portion 1404 of housing 1320", thereby pulling up on chain 1302 and, therefore, on flapper 1106' (FIG. 41). As such, flush valve assembly 1100' is opened and water from tank 1020' flows through flush tube 1104' and into bowl 1034 (FIG. 20).

As shown in FIG. 53, when handle 1304" is allowed to rotate, first and second clutch plates 1408, 1412 are coupled together such that detents 1442 of first clutch plate 1408 frictionally mate with detents 1444 of second clutch plate 1412 in order to allow handle 1304" to rotate. In an unactuated position, tip 1432 projects from plunger 1428. Tip 1432 contacts tubular member 1414 and overcomes the bias of spring 1410 such that first and second clutch plates 1408, 1412 are in contact. As such, lever arm 1316 is rotate within opening 1426 of rear portion 1404 when handle 1304" is depressed. When in the flush position, rod 1400 is received within first and second recesses 1436, 1438 of second clutch plate 1412 and is adjacent stop surface 1440 of second clutch plate 1412.

However, as shown in FIG. 52, if an overflow condition is detected by bowl sensor 1210, handle assembly 1300" is in an overflow position and controller 1208 prevents rotation of handle 1304". In particular, controller 1208 actuates the solenoid valve or motor assembly (not shown) in order to retract tip 1432 within plunger 1428. As such, when tip 1432 no longer applies pressure to second clutch plate 1412, the bias of spring 1410 moves second clutch plate 1412 away from first clutch plate 1408. Second clutch plate 1412 also moves away from rod 1400 such that rod 1400 is spaced apart from stop surface 1440 of second clutch plate 1412. Additionally, when second clutch plate 1412 moves away from first clutch plate 1408, lever arm 1316 moves rearwardly within an extension 1450 of opening 1426 of rear portion 1404 of housing 1320". As such, when a user attempts to depress handle 1304", handle 1304" does not rotate because lever arm 1316 is no longer rotationally coupled to handle 1304". Therefore, handle 1304" may rotate without initiating rotation in lever arm 1316.

Alternatively, second clutch plate 1412 may remain engaged with first clutch plate 1408. When tip 1432 is retracted within plunger 1428, both first and second clutch plates 1408, 1412 may move rearwardly in housing 1320". As such, lever arm 1316 also moves rearwardly. When handle 1304" is depressed, lever arm 1316 may contact an upper surface 1452 of extension 1450, which prevents lever arm 1316 from rotating upwardly. As such, flush valve assembly 1100' does not open. Therefore, when a user desires to initiate a flush cycle after an overflow condition is detected, the user will not be able to depress handle 1304".

Once an overflow condition is no longer detected by bowl sensor 1210 (FIG. 40), controller 1208 disengages the solenoid valve or motor assembly (not shown) and tip 1432 again projects from plunger 1428 to engage tubular member 1414 and moves second clutch plate 1412 toward first clutch plate 1408. Handle 1304" is allowed to rotate when depressed by the user because lever arm 1316 moves forward from extension 1450 and into opening 1426 which allows second end 1338 to rotate upwardly.

Referring to FIGS. 54-62, an alternative embodiment of toilet 1010 of FIG. 20 is shown as toilet 1510. The alternative embodiment toilet 1510 includes many similar features to those of toilet 10 and toilet 1010 detailed above, wherein like reference numbers identify similar components except as described below. Toilet 1510 includes a tank 1520, base 1032 (FIG. 20), bowl 1034 (FIG. 20), an inlet tube, illustratively a water supply tube 1536, an outlet tube, illustratively trapway 1038 (FIG. 21), a fill valve assembly 1540, a flush valve assembly 1600, and an overflow assembly 1690. Illustratively, toilet 1510 is a tank-type, gravity-fed toilet similar to toilet 10 (FIG. 1) and toilet 1010 (FIG. 20) described herein.

Figure 54:
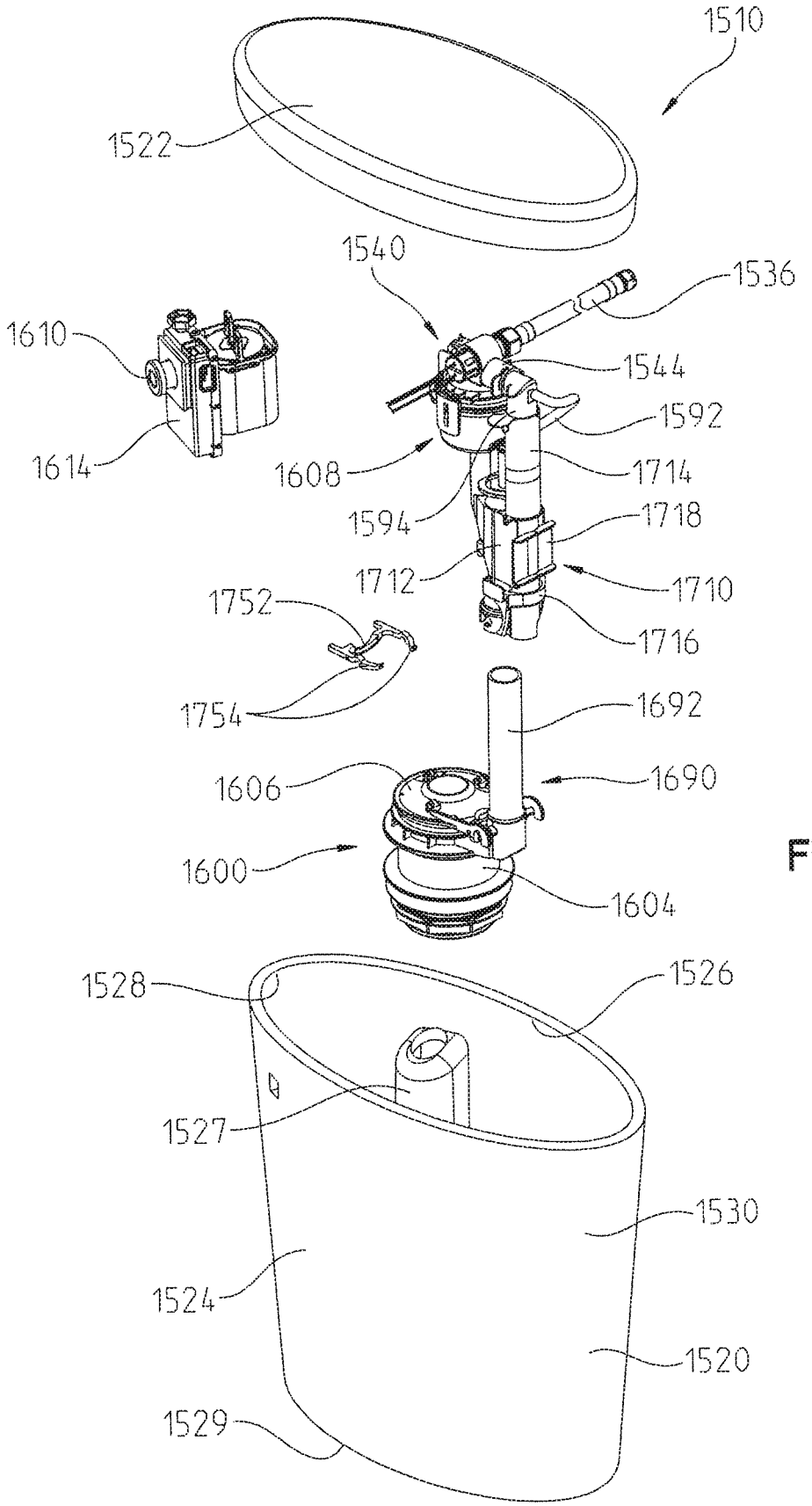
FIG. 54 is an exploded view of another illustrative alternative embodiment toilet of the present invention.

Tank 1520 includes a lid 1522, a bottom surface 1529, a front surface 1524, a rear surface 1526, a first side 1528, and a second side 1530. Tank 1520 may be comprised of a ceramic, metallic, or polymeric material, for example porcelain, stainless steel, or plastic composite materials. Rear surface 1526 includes an external recessed channel 1527 which guides supply tube 1536 into tank 1520 above the water level in tank 1520. As shown in FIG. 54, supply tube 1536 is in fluid communication with flush valve assembly 1600 and overflow assembly 1690 through fill valve assembly 1540. In particular, supply tube 1536 is fluidly coupled to a water supply (not shown) in order to flow water into fill valve assembly 1540, as further detailed herein.

Figure 55:
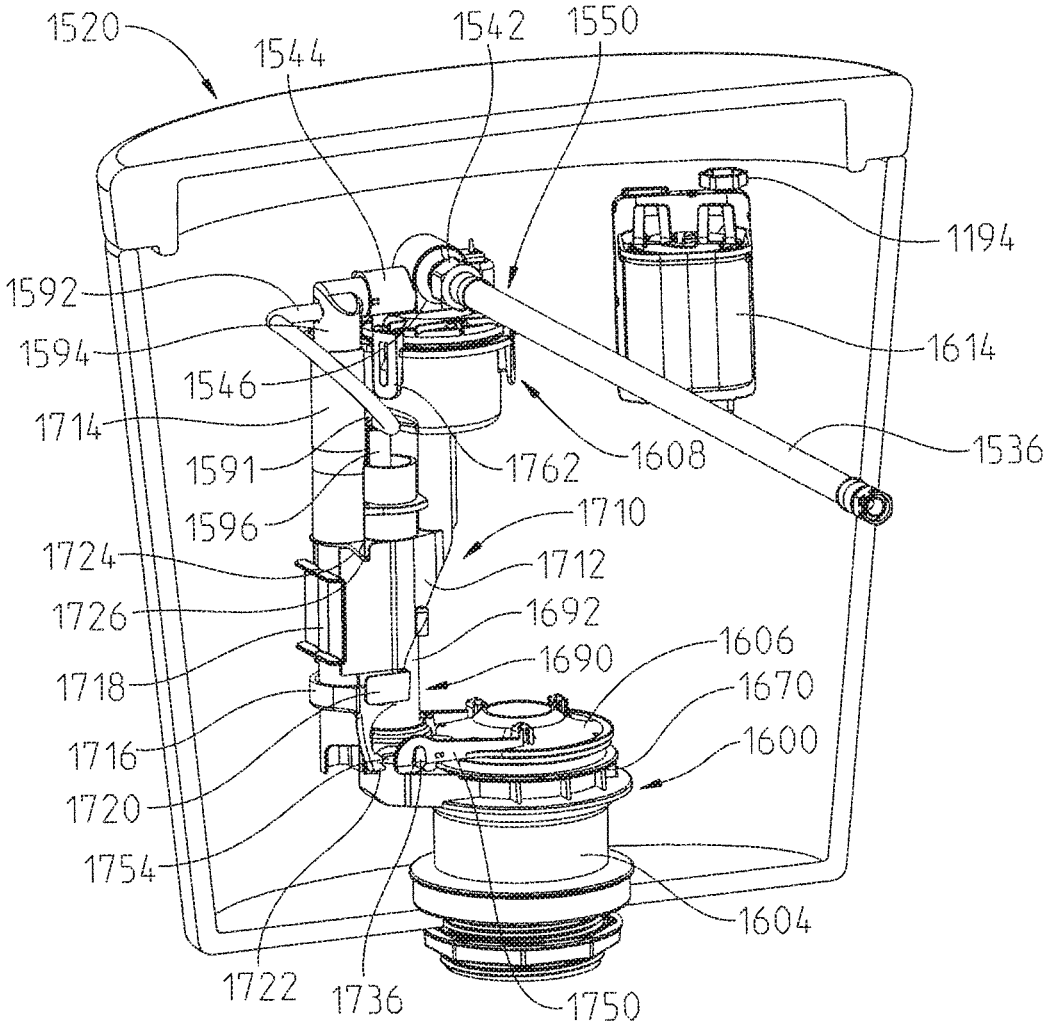
FIG. 55 is a rear perspective view of a fill valve assembly, a flush valve assembly, and an overflow assembly of the toilet of FIG. 54 within a tank.
Figure 56:
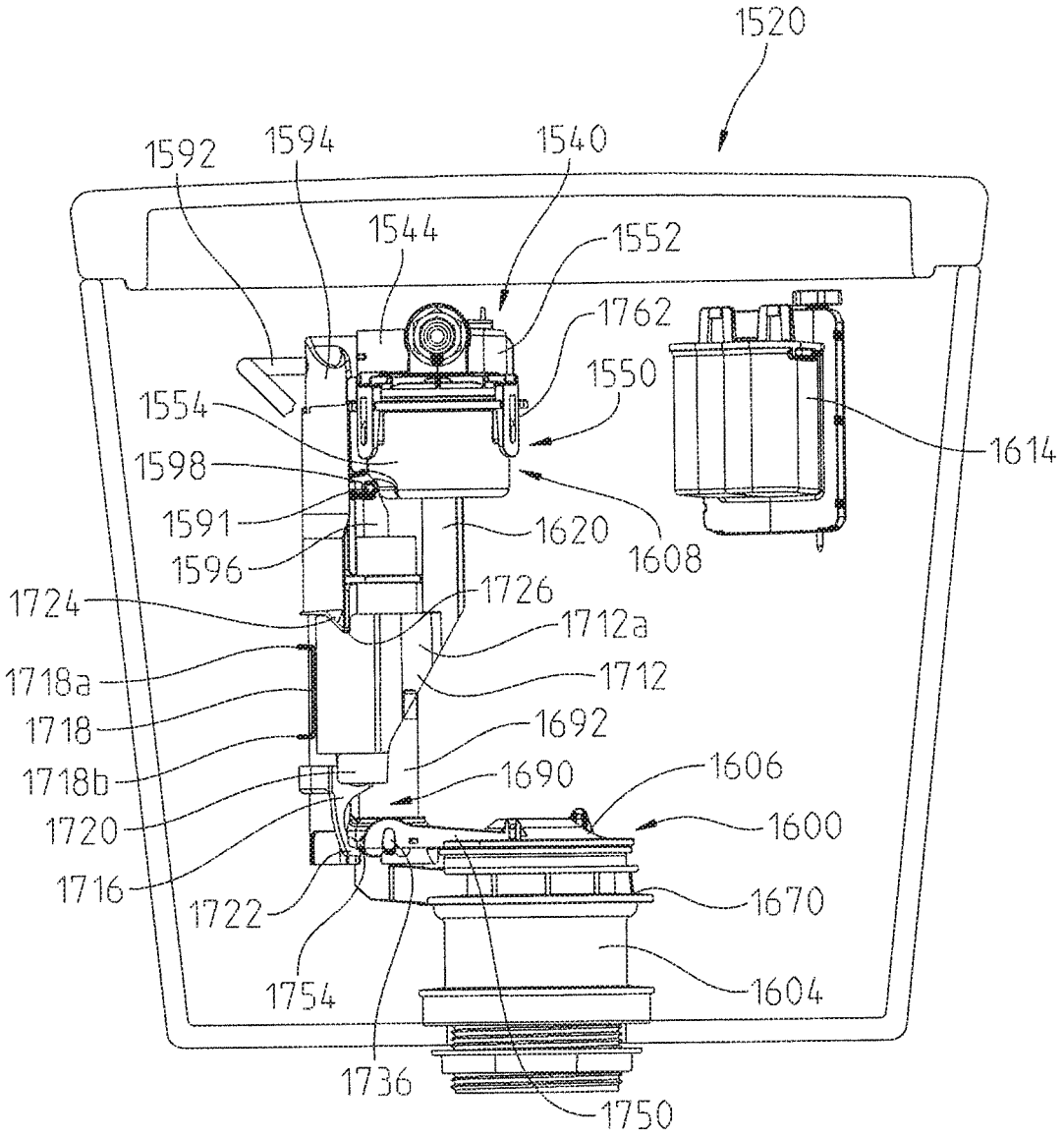
FIG. 56 is a rear view of the fill valve assembly, the flush valve assembly, and the overflow assembly of FIG. 55 within the tank.
Figure 59:
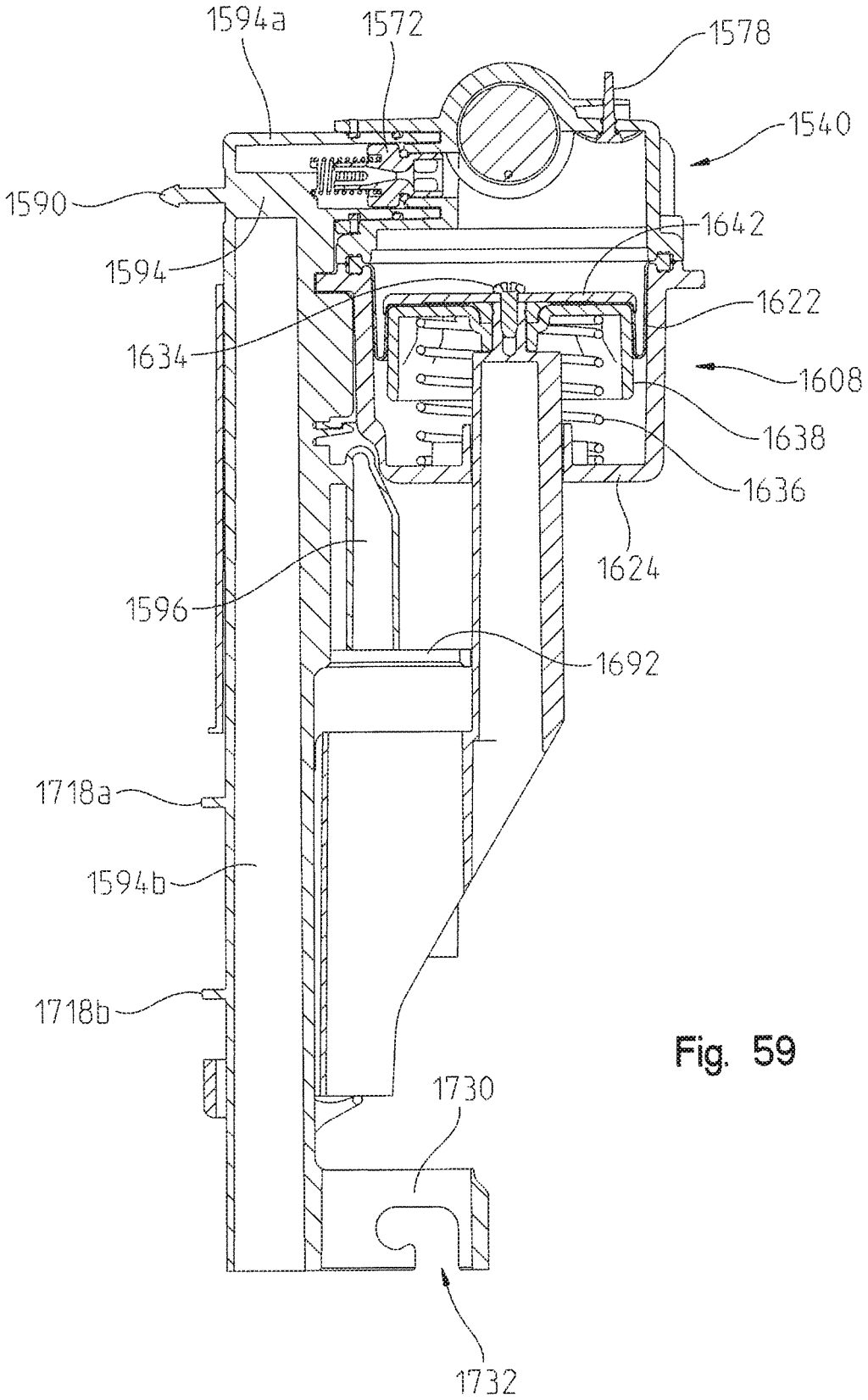
FIG. 59 is a rear cross-sectional view of the fill valve assembly of FIG. 57.
Figure 60:
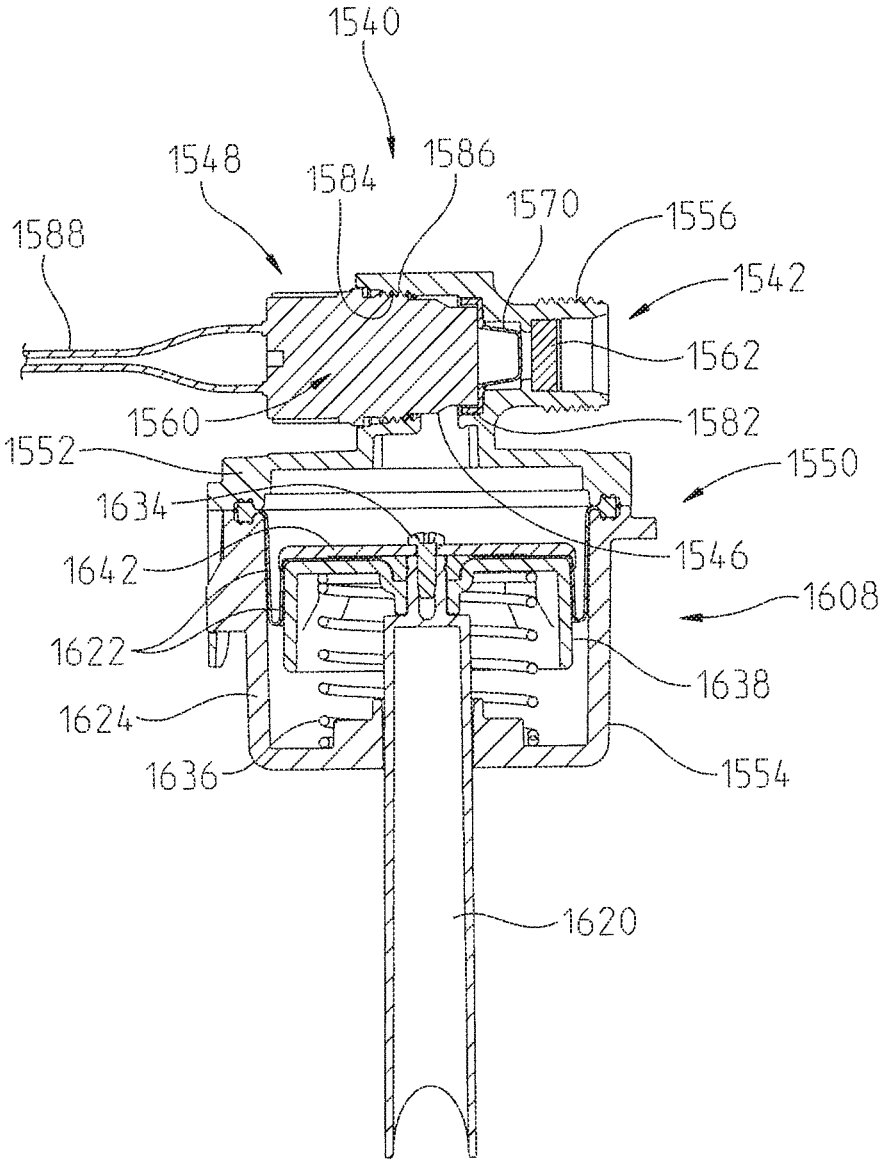
FIG. 60 is a side cross-sectional view of the fill valve assembly of FIG. 57.

As shown in FIGS. 55-60, a housing 1550 supports both a flush actuator assembly 1608 and fill valve assembly 1540. Referring to FIGS. 55 and 60, fill valve assembly 1540 includes an inlet 1542, a refill outlet 1544, a flush actuator outlet 1546, and an electrically-operable valve assembly 1548. Housing 1550 may include an upper portion 1552 and a lower portion 1554. Illustratively, upper portion 1552 is coupled to lower portion 1554 with snap fingers 1762 (FIGS. 55 and 56). Alternatively, upper portion 1552 may be integral with lower portion 1554, or may be coupled thereto with other conventional fasteners. Upper portion 1552 supports inlet 1542, outlets 1544, 1546, and electrically-operable valve assembly 1548.

As shown in FIGS. 55 and 60, inlet 1542 is fluidly coupled with supply tube 1536. More particularly, inlet 1542 may include external threads 1556 that threadedly couple with supply tube 1536. The connection between supply tube 1536 and inlet 1542 may occur within tank 1520.

Figure 57:
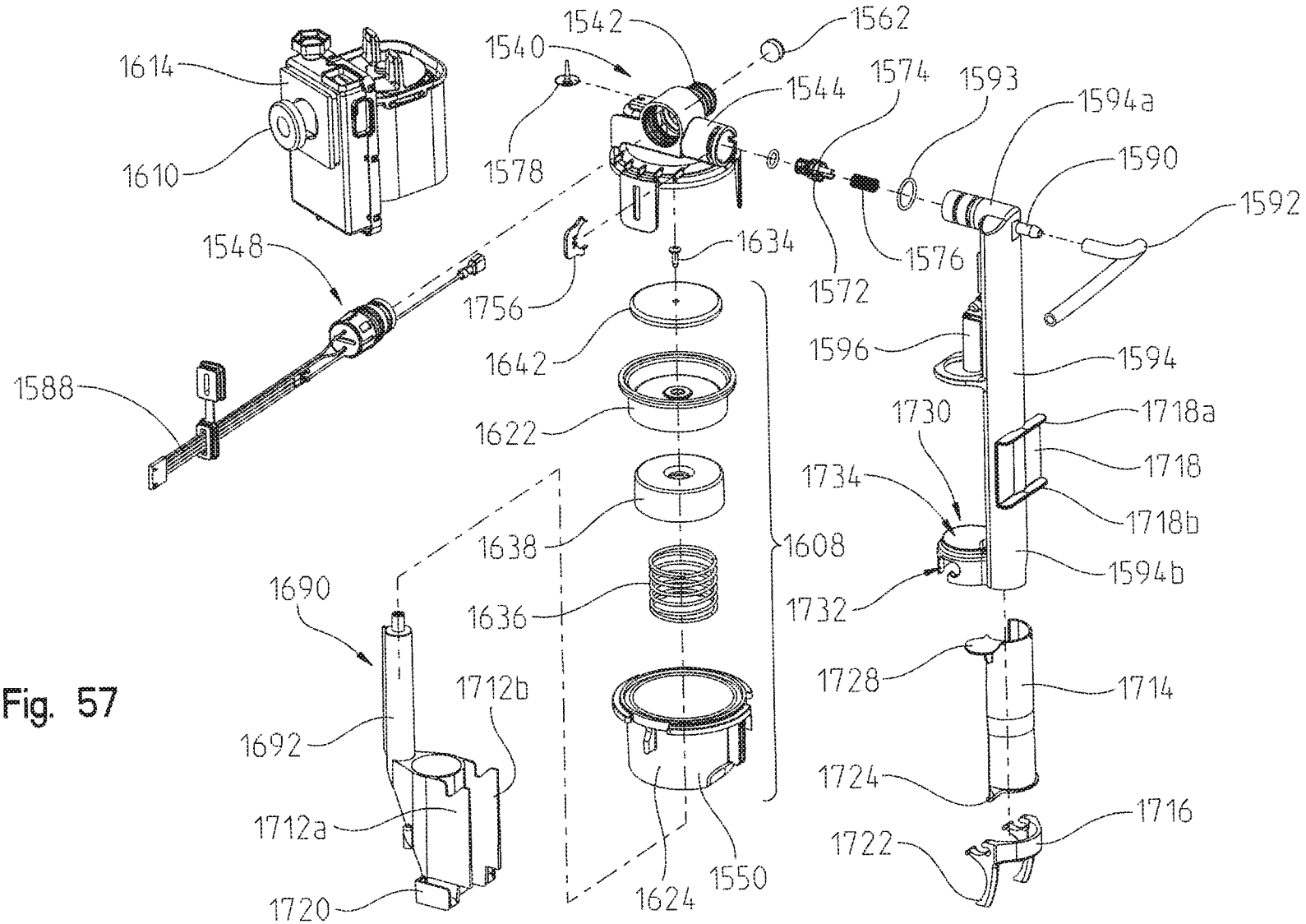
FIG. 57 is an exploded view of the fill valve assembly of FIG. 56.
Figure 58:
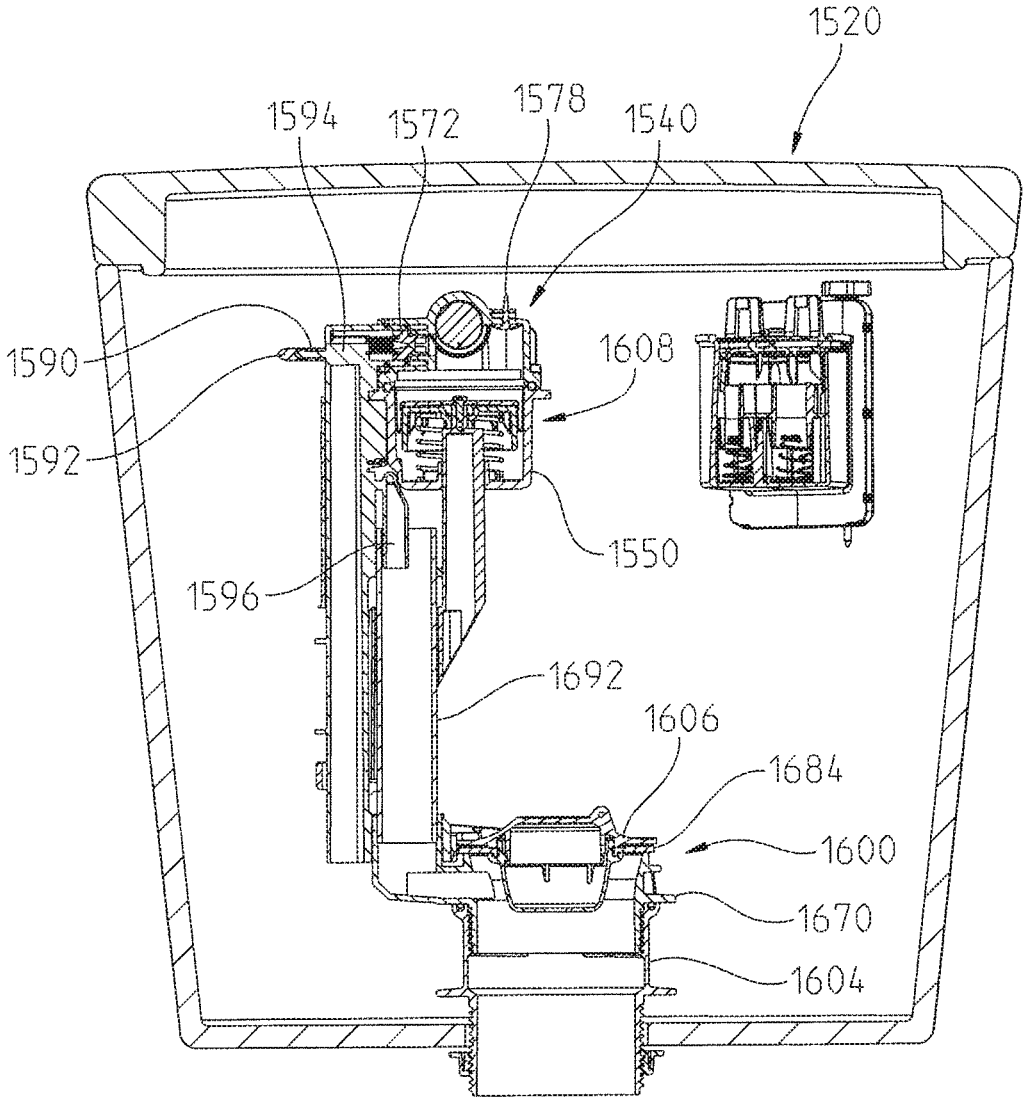
FIG. 58 is a rear cross-sectional view of the fill valve assembly, the flush valve assembly, and the overflow assembly within the tank.

Inlet 1542 may further support a flow restrictor 1562 (FIGS. 57 and 60). Illustratively, flow restrictor 1562 is a pressure-compensating flow restrictor. Flow restrictor 1562 may be positioned intermediate electrically-operable valve assembly 1548 and supply tube 1536, such that flow restrictor 1562 is upstream of electrically-operable valve assembly 1548. In one embodiment, flow restrictor 1562 may be configured to control the flow rate at approximately 2.5 gallons/minute. By controlling the flow rate, flow restrictor 1562 assists in maintaining a constant pressure within fill valve assembly 1540, as detailed further herein.

Additionally, fill valve assembly 1540 may include a check valve 1578, as shown in FIG. 57. If a vacuum occurs at inlet 1542 of fill valve assembly 1540, check valve 1578 is configured to "break" the vacuum, thereby preventing backflow, or water flow in a reverse direction through electrically-operable valve assembly 1548 and back into supply tube 1536.

Referring to FIG. 60, electrically-operable valve assembly 1548 is positioned within housing 1550 and is in fluid communication with inlet 1542, refill outlet 1544, and flush actuator outlet 1546. Electrically-operable valve assembly 1548 is threadedly coupled to upper portion 1552 of housing 1550 through external threads 1584 and internal threads 1586. Electrically-operable valve assembly 1548 may be, for example, an electromechanical valve, and more particularly, may be a solenoid valve of the latching-type. Exemplary electrically-operable valve assembly 1548 is the same as electrically-operable valve assembly 1048 of FIGS. 24-25B and 28 and, as such, may include a filter 1570, a seal 1582, and a body portion 1560 supporting a valve seat, a diaphragm, a shaped portion, a pilot hole, a seal, a magnet, a pole, an armature, and a spring. Electrically-operable valve assembly 1548 operates in the same manner as electrically-operable valve assembly 1048 (FIGS. 24-25B and 28). Electrically-operable valve assembly 1548 further includes electrical wires 1588 extending from body portion 1560 for supplying power to electrically-operable valve assembly 1548.

Electrically-operable valve assembly 1548 also may be in electric communication with a controller 1708 (FIG. 61) through electrical wires 1588. During operation of toilet 1510, electrically-operable valve assembly 1548 receives signals from controller 1708 to control the flow of water from inlet 1542 to refill outlet 1544 and flush actuator outlet 1546, as further detailed herein and in U.S. Provisional Patent Application Ser. No. 61/610,205, filed on Mar. 13, 2012, and U.S. Provisional Patent Application Ser. No. 61/722,074, filed on Nov. 2, 2012, the complete disclosures of which are expressly incorporated by reference herein. For example, electrically-operable valve assembly 1548 may be actuated by controller 1708 in order to flow water from inlet 1542 into outlets 1544 and 1546.

Referring to FIG. 55, the illustrative embodiment of fill valve assembly 1540 includes two outlets 1544 and 1546, however, any number of outlets may be included to accommodate particular applications of fill valve assembly 1540. Illustratively, refill outlet 1544 may be approximately perpendicular to inlet 1542. Additionally, as shown in FIGS. 54-57, refill outlet 1544 may be fluidly coupled to a bowl refill tube 1592 and a tank refill tube 1594. In the illustrative embodiment of FIG. 57, tank refill tube 1594 has a larger diameter than bowl refill tube 1592.

Tank refill tube 1594 includes an upper portion **1594*a* and a lower portion 1594*b*. Upper portion 1594*a* may be directly coupled to refill outlet 1544 with a sealing member, illustratively an o-ring 1593 (FIG. 57). In the illustrative embodiment of FIG. 57, lower portion 1594*b* is coupled to upper portion 1594*a* at an approximately right angle. Lower portion 1594*b* of tank refill tube 1594 extends downwardly from upper portion 1594*a* such that a bottom surface of lower portion 1594*b* is adjacent a flapper 1606 of flush valve assembly 1600 (FIGS. 54-56**).

Illustratively, tank refill tube 1594 includes a first nipple 1590, a second nipple 1591, and a conduit 1596 (FIGS. 55-59). First and second nipples 1590, 1591 and conduit 1596 may be integrally formed with tank refill tube 1594 or, alternatively, may be coupled thereto with conventional fasteners. As shown in FIGS. 55 and 57, first nipple 1590 extends from upper portion 1594*a* of tank refill tube 1594 and second nipple 1591 extends from conduit 1596. Lower portion 1594*b* may be positioned outward of conduit 1596. Conduit 1596 is coupled to lower portion 1594*b* with a support member 1598, as shown in FIG. 56, such that conduit 1596 is generally parallel to lower portion 1594*b*. Support member 1598 may be integrally coupled to tank refill tube 1594 or coupled thereto with conventional fasteners. A portion of conduit 1596 may be positioned within an overflow tube 1692 of overflow assembly 1690.

Lower portion 1594*b* of tank refill tube 1594 also includes a coupling member 1730, as shown in FIGS. 57 and 59. Illustratively, coupling member 1730 is integrally coupled to lower portion 1594*b* of tank refill tube 1594 and defines a circle in cross-section. Coupling member 1730 includes a center aperture 1734 which is configured to assemble around overflow tube 1692. In one embodiment, the inner diameter of center aperture 1734 is approximately the same size as the outer diameter of overflow tube 1692. Coupling member 1730 also includes cut-out portions 1732 on opposing sides of overflow tube 1692. Cut-out portions 1732 are configured to receive posts 1736 (FIG. 56) on overflow tube 1692. After posts 1736 are initially received within cut-out portions 1732, coupling member 1730 is configured to rotate about overflow tube 1692 in order to secure posts 1736 therein. Illustratively, coupling member 1730 is a twist and lock member for coupling tank refill tube 1594 to overflow tube 1692.

An upper end of bowl refill tube 1592 is coupled to first nipple 1590 and a lower end of bowl refill tube 1592 is coupled to second nipple 1591. As shown in FIGS. 55 and 56, when the lower end of bowl refill tube 1592 is coupled to second nipple 1591, water within bowl refill tube 1592 flows through second nipple 1591 and into conduit 1596 in order to refill bowl 1034 (FIG. 20). More particularly, a portion of the water in upper portion 1594*a* of tank refill tube 1594 flows through first nipple 1590, into bowl refill tube 1592, into conduit 1596, through overflow tube 1692, and into bowl 1034. In one embodiment, bowl refill tube 1592 is a flexible polymeric tube with an inner diameter of approximately 0.25 inch. For example, bowl refill tube 1592 may be comprised of polyvinylchloride (PVC) material. Bowl refill tube 1592 may be configured to bend around a portion of tank refill tube 1594 in order to couple with second nipple 1591. In one exemplary embodiment, approximately 25% of the water in upper portion 1594*a* of tank refill tube 1594 flows into bowl refill tube 1592 to refill bowl 1034, and approximately 75% of the water in upper portion 1594*a* flows into lower portion 1594*b* of tank refill tube 1594 to refill tank 1520 after toilet 1510 has been flushed.

Figure 62:
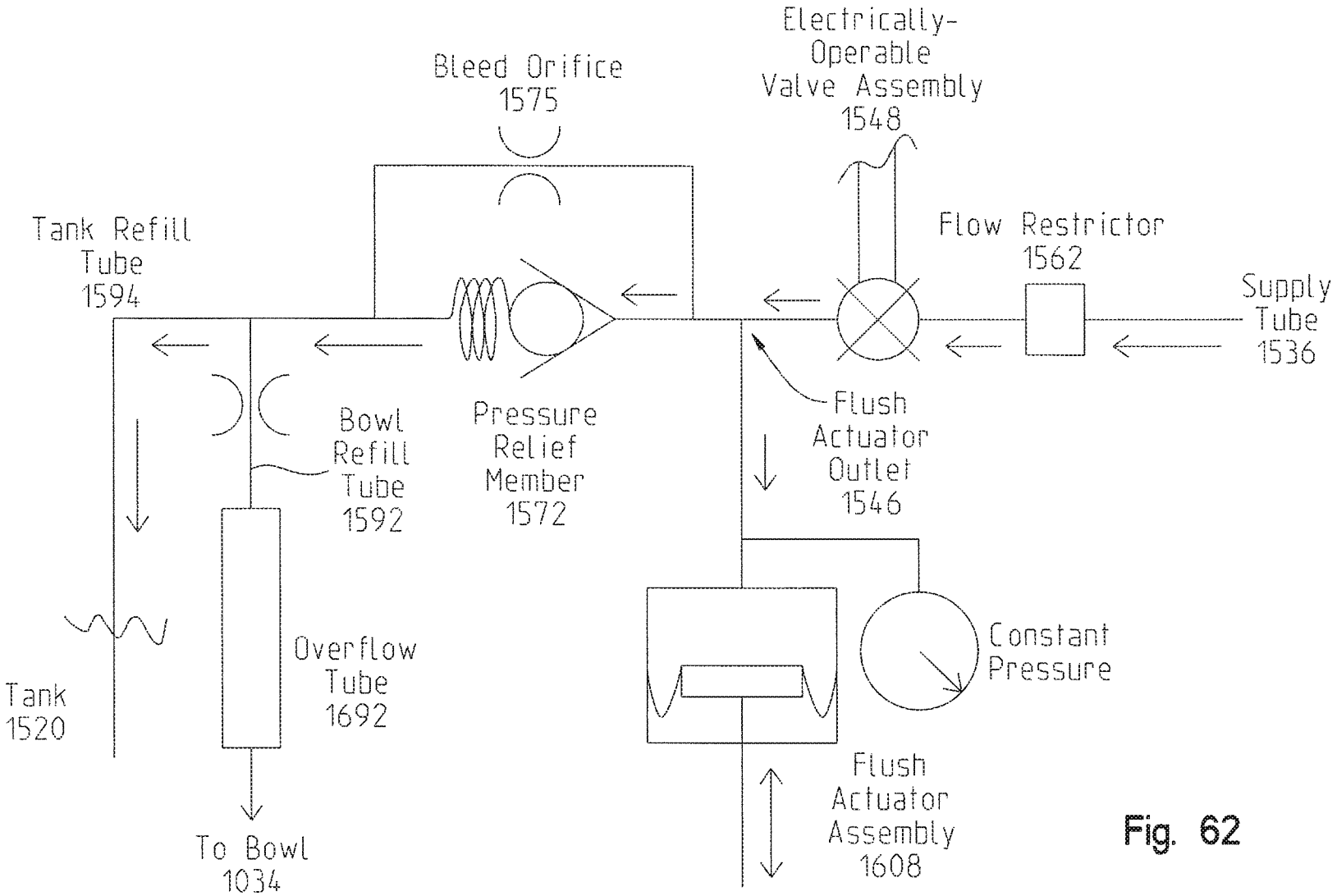
FIG. 62 is a diagrammatic view of the flow path of the water through toilet 1510.

As shown in FIG. 57, fill valve assembly 1540 further includes a pressure relief member 1572 adjacent refill outlet 1544. In particular, pressure relief member 1572 is positioned generally intermediate electrically-operable valve assembly 1548 and refill outlet 1544. Pressure relief member 1572 includes a piston member 1574 and a spring 1576. Piston member 1574 includes a central opening or bleed orifice 1575 (FIG. 62). Piston member 1574 also may include a sealing member, for example an o-ring, in order to selectively seal refill outlet 1544 from flush actuator outlet 1546, as detailed further herein.

In operation, pressure relief member 1572 may be biased toward a closed position in which spring 1576 is not compressed and piston member 1574 seals against refill outlet 1544. As such, when a flush cycle is initiated, pressure relief member 1572 may be closed against refill outlet 1544 such that the water in fill valve assembly 1540 does not initially flow through refill outlet 1544. Due to this restriction at refill outlet 1544, pressure may increase within fill valve assembly 1540, even when the pressure in supply tube 1536 is low. When the pressure in fill valve assembly 1540 increases to a predetermined amount sufficient to overcome the bias of spring 1576, piston member 1574 and spring 1576 move away from refill outlet 1544, thereby opening refill outlet 1544, to allow water to flow into refill outlet 1544. By opening refill outlet 1544 at a predetermined pressure, the pressure in fill valve assembly 1540 may remain constant. For example, the pressure in fill valve assembly 1540 may be constantly maintained at approximately 8 psi.

Figure 61:
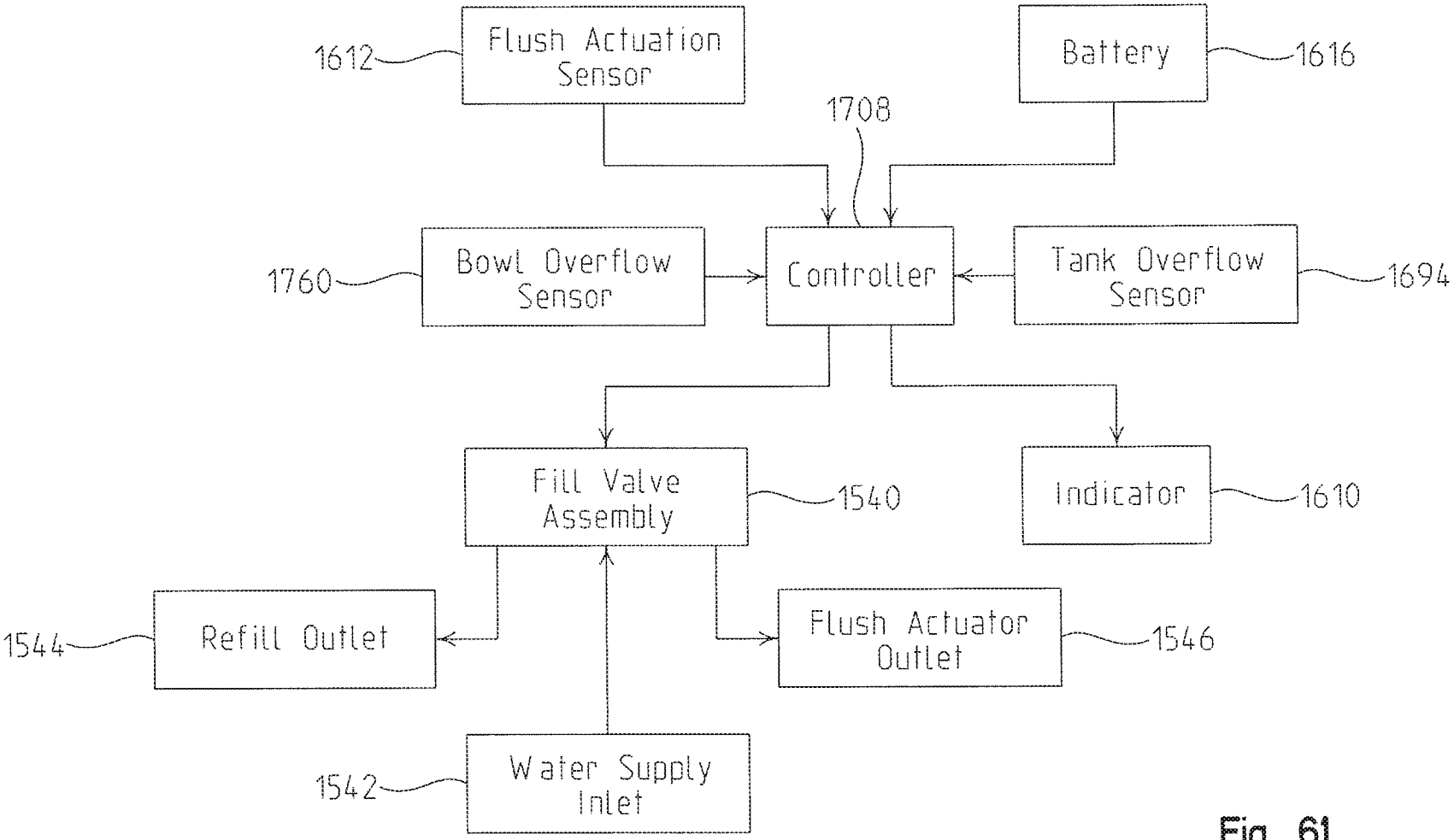
FIG. 61 is a diagrammatic view of various operating components of the toilet of FIG. 54, illustrating a plurality of inputs and outputs relative to a controller.

Referring to FIGS. 54-60, fill valve assembly 1540 is operably coupled to flush valve assembly 1600 through flush actuator outlet 1546. Flush valve assembly 1600 includes a flush tube 1604, flapper 1606, a flush actuator assembly 1608, an indicator 1610, and a flush actuation sensor 1612 (FIG. 61). Flush actuation sensor 1612 cooperates with indicator 1610 (FIGS. 54 and 61) and a controller 1708 (FIG. 61) to initiate a flush cycle. Illustratively, controller 1708 and indicator 1610 may be supported by a waterproof housing or casing 1614 in tank 1520. Casing 1614 and indicator 1610 may be operably coupled to a power source (e.g., a battery 1616) and are structurally and operationally similar to casing 1114 and indicator 1110 in FIG. 22.

The illustrative embodiment of fill valve assembly 1540 is controlled by a controller 1708 (FIG. 61). More particularly, controller 1708 receives a signal from a bowl sensor 1760 (FIG. 61) coupled to bowl 1034 which determines if an overflow condition has occurred in bowl 1034 (FIG. 21). Bowl sensor 1760 is configured to detect an overflow condition, such as when the water level in bowl 1034 rises above a predetermined, critical level. In particular, bowl sensor 1760 may prevent operation of fill valve assembly 1540 when an overflow condition is detected. Therefore, bowl sensor 1760 also may prevent operation of flush actuator assembly 1608 and flush valve assembly 1600 when an overflow condition is detected. Alternatively, when an overflow condition is not signaled by bowl sensor 1760, controller 1708 (FIG. 61) may send a signal to electrically-operable valve assembly 1548 to initiate a flush cycle. Bowl sensor 1760 also may be configured to detect a water leak in bowl 1034 and signal a leak condition to controller 1708. Controller 1708, through an indicator 1610 on tank 1520, may signal a user that bowl 1034 has a leak condition and/or an overflow condition.

Bowl sensor 1760 may be a piezoelectric element, an infrared sensor, a radio frequency ("RF") device, a capacitive sensor, a float device, an ultrasound device, or an electric field, for example. Illustratively, bowl sensor 1760 is a capacitive sensor. Bowl sensor 1760 may be comprised of a metallic plate (e.g., brass) overmolded with a polymeric material (e.g., polyvinylchloride). Bowl sensor 1760 may be adhered to the back of bowl 1034 (as shown in FIG. 21). In one embodiment, a foam material also may be coupled with bowl sensor 1760 on bowl 1034.

Referring to FIG. 60, flush actuator outlet 1546 may be a conduit extending from housing 1550 to flush actuator assembly 1608. Flush actuator assembly 1608 is structural and operationally similar to flush actuator assembly 1108

(FIG. 28) detailed above. For example, flush actuator assembly 1608 may include a piston rod 1620 coupled to a diaphragm 1622, a piston 1638, and a retainer plate 1642 with a screw 1634 or other fastener. A spring 1636 may be positioned around piston rod 1620 and below piston 1638. Flush actuator assembly 1608 is generally contained within a cylinder 1624 defined by housing 1550. Constant water pressure within fill valve assembly 1540 may be used to engage flush actuator assembly 1608 and, more particularly, may be used to overcome the bias of spring 1636. When the pressure in fill valve assembly 1540 overcomes the bias of spring 1636, piston rod 1620, piston 1638, diaphragm 1622, and retainer plate 1642 move downwardly toward the lower surface of cylinder 1624. The lower surface of cylinder 1624 may include at least one aperture (not shown) for releasing or exhausting air from cylinder 1624 during operation of flush actuator assembly 1608.

During operation of flush actuator assembly 1608, diaphragm 1622 provides a long stroke with minimal friction, which reduces the minimum amount of friction needed to operate flush actuator assembly 1608. Because flush actuator assembly 1608 may operate at a reduced pressure, toilet 1510 may continue to operate even when the water pressure in supply tube 1536 decreases. Furthermore, the pressure within fill valve assembly 1540 may be maintained at the minimum pressure required to overcome the spring bias of spring 1636. As such, the amount of pressure within fill valve assembly 1540 is maintained at a predetermined amount and does not increase to an amount that may cause damage to fill valve assembly 1540 and/or other components of toilet 1510.

Piston rod 1620 extends downwardly from cylinder 1624 and is coupled to a pivot assembly 1710 of flush valve assembly 1600. As shown in FIGS. 54-59, a pivot assembly 1710 includes a support member 1712, a lever member 1714, a pivot member 1716, and a guide member 1718. Support member 1712 is coupled to piston rod 1620 and extends generally around overflow tube 1692. Illustratively, the lower portion of piston rod 1620 is integral with support member 1712. More particularly, support member 1712 includes opposing sides 1712*a*, 1712*b* which are coupled to piston rod 1620 and extend generally around overflow tube 1692. Sides 1712*a*, 1712*b* of support member 1712 also extend partially around tank refill tube 1594.

A lower end of support member 1712 is coupled to pivot member 1716. As shown in FIGS. 56 and 57, the lower end of support member 1712 includes brackets 1720 for supporting pivot member 1716. Pivot member 1716 is configured to pivot outwardly from brackets 1720. Illustratively, pivot member 1716 extends around a portion of tank refill tube 1594 and may be configured to pivot outwardly therefrom. Pivot member 1716 also includes pivot feet 1722 for selectively engaging a pair of pivot arms 1750 on flapper 1606, as detailed further herein.

In addition to pivot member 1716, support member 1712 also is coupled to lever member 1714. More particularly, lever member 1714 is positioned above support member 1712 and may be frictionally retained on tank refill tube 1594. Lever member 1714 is configured to slide along tank refill tube 1594. A lower end of lever member 1714 includes projections 1724 which correspond to recesses 1726 in support member 1712. As such, when lever member 1714 slides in a downward direction toward support member 1712, projections 1724 are received within recesses 1726 such that support member 1712 also slides in a downward direction along tank refill tube 1594. A tab 1728 is positioned at the upper end of lever member 1714 and, illustratively, is integrally formed with lever member 1714. Tab 1728 allows a user to manually operate and control the movement of lever member 1714. For example, in the event of a power loss, controller 1708 may not operate. However, a user may continue to operate toilet 1510, at least once, by depressing tab 1728 and manually sliding lever member 1714 and support member 1712 in a downward direction.

As shown in FIGS. 55 and 57, guide member 1718 is coupled to tank refill tube 1594 and includes an upper rail 1718*a* and a lower rail 1718*b*. Rails 1718*a*, 1718*b* are parallel to each other and extend generally perpendicularly to tank refill tube 1594. Illustratively, guide member 1718 is integrally coupled to lower portion 1594*b* of tank refill tube 1594. Because tank refill tube 1594 is not configured to move or slide during operation of toilet 1510, guide member 1718 also is stationary. Guide member 1718 may be in contact with sides 1712*a*, 1712*b* of support member 1712. As is detailed further herein, the downward movement of lever member 1714 may be limited by upper rail 1718*a* of guide member 1718 and the upward movement of pivot member 1716 may be limited by lower rail 1718*b*. Additionally, if pivot assembly 1710 is in close proximity to any of surfaces 1524, 1526 or sides 1528, 1520 of tank 1520, rails 1718*a*, 1718*b* prevent interference with tank 1520 when pivot assembly 1710 moves during operation of toilet 1510.

Referring to FIG. 54, overflow assembly 1690 includes overflow tube 1692 and a tank sensor 1694 (FIGS. 55 and 61). Tank sensor 1694 is configured to detect an overflow condition and is structurally and operationally the same as tank sensor 1194' of FIG. 31. Overflow tube 1692 is coupled to flush actuator assembly 1608 through tank refill tube 1594. Overflow tube 1692 is secured to tank refill tube 1594 with coupling member 1730. Additionally, support member 1712 extends around a portion of overflow tube 1692. Overflow tube 1692 also is fluidly coupled to bowl refill tube 1592 through conduit 1596.

Overflow tube 1692 also is coupled to flush tube 1604 and flapper 1606. In particular, the outlet of overflow tube 1692 is coupled to flush tube 1604 below flapper 1606 such that water in overflow tube 1692 may flow into bowl 1034 (FIG. 20) regardless of whether flapper 1606 is closed against flush tube 1604. By coupling overflow tube 1692 to flush tube 1604, the height of overflow tube 1692 may vary to accommodate various water levels and geometries of tank 1520 without affecting the operation of flush valve assembly 1600.

Additionally, overflow tube 1692 is coupled to flapper 1606 with posts 1736, as shown in FIGS. 55 and 56. Posts 1736 may be integrally coupled with overflow tube 1692 or may be coupled thereto with conventional fasteners. Posts 1736 engage a pair of pivot arms 1750 of flapper 1606 and define the pivot location for flapper 1606. As such, when initiating a flush cycle, flapper 1606 may be lifted or otherwise moved by pivoting flapper 1606 about posts 1736, as detailed further herein. Illustratively, flapper 1606 may be a tilting or hinged type of flapper and, as such, flapper 1606 rotates or pivots to open flush tube 1604, rather than moving axially in a vertical direction. Illustrative flapper 1606 is a chainless flapper that operates by pivoting upwardly.

Referring to FIGS. 54-56, in one embodiment, pivot arms 1750 include a pivot frame 1752. Pivot frame 1752 is positioned inward of pivot arms 1750 and extends over the upper surface of posts 1736. Pivot frame 1752 includes tabs 1754, which are configured to engage pivot feet 1722 of pivot member 1716 during a flush cycle. For example, before a flush cycle, pivot feet 1722 are positioned above tabs 1754 of pivot frame 1752. During a flush cycle, support member 1712 and pivot member 1716 move downwardly with the movement of flush actuator assembly 1608 and pivot feet 1722 contact tabs 1754. Tabs 1754 pivot downwardly and, therefore, pivot frame 1742 and pivot arms 1750 pivot flapper 1606 in an upward direction about posts 1736.

Flapper 1606 may include a seal 1684 (FIG. 58) that engages a frame member 1670 coupled to flush tube 1604. In one embodiment, frame member 1670 is partially positioned within flush tube 1604 and is threadedly coupled thereto. As shown in FIG. 55, a portion of frame member 1670 may be positioned above flush tube 1604 and define a surface for engaging seal 1684 in order to seal the water in tank 1520. Flush tube 1604 is coupled to bowl 1034 (FIG. 21) in the manner detailed above with respect to flush tube 1104.

Referring to FIGS. 61 and 62, in use, toilet 1510 is operated when a flush cycle is initiated. More particularly, when a user desires to flush toilet 1510, the user activates flush actuation sensor 1612 (FIG. 61). For example, a user's hand may be placed in proximity to (e.g., placed in front of) indicator 1610 in order to trigger the flush cycle. As such, toilet 1510 is an automatic and hands-free flush toilet because a user normally initiates a flush cycle through flush actuation sensor 1612, rather than by depressing a manual handle or button on toilet 1510. Flush actuation sensor 1612 receives the user input and sends a signal to controller 1708 to initiate operation of flush valve assembly 1600 and fill valve assembly 1540. Before initiating the flush cycle, controller 1708 receives signals from bowl sensor 1760 to determine if the water level in bowl 1034 (FIG. 21) is above the predetermined critical water level. If the water level in bowl 1034 is at or below the critical level, then controller 1708 will initiate the flush cycle. Conversely, if bowl sensor 1760 signals to controller 1708 that the water level in bowl 1034 is above the critical level, controller 1708 will not actuate fill valve assembly 1540 to initiate a flush cycle. In other words, bowl sensor 1760 is continuously in electric communication with controller 1708 and transmits a baseline capacitance to controller 1708. The baseline capacitance (e.g., zero capacitance) is continuously transmitted to controller 1708 until an overflow condition occurs. When an overflow condition occurs, the capacitance signal from bowl sensor 1706 increases. Controller 1708 processes the increased capacitance from bowl sensor 1706 by comparing the increased capacitance to the baseline capacitance. When controller 1708 determines that the increased capacitance is greater than the baseline capacitance, controller 1708 transmits a signal to fill valve assembly to prevent the initiation of a flush cycle. Additional details of the operation of bowl sensor 1706 and controller 1708 are disclosed in U.S. patent application Ser. No. 13/798,406 filed on Mar. 13, 2013, the complete disclosure of which is expressly incorporated by reference herein.

When an overflow condition is detected, water does not flow into or from tank 1520 during an overflow condition. Illustratively, water does not flow from inlet 1542 to flush actuator outlet 1546 and, therefore, flush actuator assembly 1608 does not lift flapper 1606, which prevents water in tank 1520 from flowing into bowl 1034. Additionally, water does not flow from inlet 1542 to refill outlet 1544 and, therefore water does not flow into tank 1520 through tank refill tube 1594 or into bowl 1034 through bowl refill tube 1592.

However, it may be appreciated that exemplary toilet 1510 is configured to allow a user to flush toilet 1510, at least once, after an overflow condition has been detected. In particular, the user may remove lid 1522 of toilet 1510 and manually depress tab 1728 (FIG. 57) in order to manually lift flapper 1606 and open flush valve assembly 1600. The water in tank 1520 will flow through flush valve assembly 1600, into bowl 1034, and through trapway 1038 to flush toilet 1510. However, because an overflow condition has been signaled to controller 1708, controller 1708 may not actuate fill valve assembly 1540 and, therefore, tank 1520 and bowl 1034 may not be refilled.

When an overflow condition is not detected, controller 1708 sends a signal to fill valve assembly 1540 in response to the signal from flush actuation sensor 1612, to initiate the flush cycle. In particular, electrically-operable valve assembly 1548 is actuated to allow water from supply tube 1536 to flow into fill valve assembly 1540. As the water from supply tube 1536 enters inlet 1542, the water flows through flow restrictor 1562 upstream of electrically-operable valve assembly 1548. In particular, flow restrictor 1562 is configured to adjust the flow of water through inlet 1542 to a predetermined flow rate according to the pressure of the water. Illustratively, flow restrictor 1562 may restrict the flow rate at inlet 1542 to approximately 2.5 gallons/minute. By controlling the flow of water upstream of electrically-operable valve assembly 1548, the pressure within fill valve assembly 1540 may be controlled. Furthermore, because the restriction of flow restrictor 1562 varies with the parameters of the water (e.g., water pressure), flow restrictor 1562 is configured to maintain a constant flow rate, even when the supply pressure is low.

As the water flows through flow restrictor 1562 and electrically-operable valve assembly 1548, the water initially flows only through flush actuator outlet 1546 because pressure relief member 1572 is closed against refill outlet 1544. As such, pressure in fill valve assembly 1540 may increase to a predetermined amount before the pressure within fill valve assembly 1540 overcomes the bias of spring 1576 of pressure relief member 1572. Additionally, as the pressure increases, the bias of spring 1636 of flush actuator assembly 1608 may be overcome such that diaphragm 1622, piston rod 1620, and retainer plate 1642 move downwardly in cylinder 1624.

In one embodiment, fill valve assembly 1540 includes both pressure relief member 1572 and flow restrictor 1562 in order to apply a constant pressure during a flush cycle. More particularly, flow restrictor 1562 controls the flow rate and, therefore, the pressure within fill valve assembly 1540 upstream of electrically-operable valve assembly 1548 while pressure relief member 1572 controls the pressure within fill valve assembly 1540 downstream of electrically-operable valve assembly 1548. For example, without flow restrictor 1562 and pressure relief member 1572, the pressure within fill valve assembly 1540 may increase rapidly due to an uncontrolled flow of water at inlet 1542 and a flow restriction at refill outlet 1544 caused when bowl refill tube 1592 has a smaller inner diameter than tank refill tube 1594. As such, the pressure within fill valve assembly 1540 may increase to amount greater than that necessary to operate fill valve assembly 1540. Additionally, the pressure within fill valve assembly 1540 may vary with the pressure in supply tube 1536. As such, without flow restrictor 1562 and pressure relief member 1572, a constant pressure within fill valve assembly 1540 may not be maintained. However, with flow restrictor 1562, the flow rate and, therefore, the pressure at inlet 1542 may be controlled to minimize any a restriction at refill outlet 1544.

However, illustrative toilet 1510 requires a predetermined pressure within fill valve assembly 1540 in order to operate flush actuator assembly 1608. By closing refill outlet 1544 with pressure relief member 1572 when a flush cycle is initiated, the water entering fill valve assembly 1540 only flows through flush actuator outlet 1546 and pressure increases at flush actuator outlet 1546. When the pressure at flush actuator outlet 1546 increases to the predetermined amount necessary to overcome the bias of spring 1636, flush actuator assembly 1608 moves downwardly. In the same way, when the pressure within fill valve assembly 1540 increases to a predetermined amount necessary to overcome the bias of spring 1576 (e.g., approximately 8-15 psi), pressure relief member 1572 moves away from refill outlet 1544, which allows water to flow into bowl refill tube 1592 and tank refill tube 1594. As such, the pressure within fill valve assembly 1540 remains constant at that predetermined pressure as water flows through refill outlet 1544.

Furthermore, because the pressure in fill valve assembly 1540 is constant, flush actuator assembly 1608, and more particularly piston rod 1620, applies a constant force to pivot assembly 1710 during a flush cycle. The constant force of piston rod 1620 moves support member 1712 downwardly. Pivot member 1716 moves downwardly with support member 1712 and pivot feet 1722 contact tabs 1754 of pivot frame 1752 on flapper 1606. The constant force applied by flush actuator assembly 1608 to pivot assembly 1710 is sufficient to rotate flapper 1606 about posts 1736. In particular, pivot arms 1750 of flapper and pivot frame 1752 pivot about posts 1736 of overflow tube 1692. When flapper 1606 pivots about posts 1736, flush tube 1604 opens to allow the water in tank 1520 to flow into bowl 1034 and flush toilet 1510. Flapper 1606 remains open until the water flows out of tank 1520 because flapper 1606 is buoyant in the water. As the water level in tank 1520 decreases, flapper 1606 pivots about posts 1736 and closes against frame member 1670 of flush tube 1604.

After pivot feet 1722 of pivot member 1716 contact tabs 1754 of pivot frame 1752, pivot member 1716 is configured to pivot outwardly from tank refill tube 1594 and support member 1712 such that pivot feet 1722 do not interfere with the rotation of pivot frame 1752 or flapper 1606. Additionally, pivot member 1716 is configured to over-travel pivot frame 1752 and move downwardly past pivot frame 1752 as flapper 1606 pivots to further ensure that pivot member 1716 does not interfere with the opening or closing of flapper 1606.

After flush valve assembly 1600 closes (i.e., flapper 1606 seals against flush tube 1604), tank 1520 and bowl 1034 may be refilled with water. In order to refill tank 1520 and bowl 1034, electrically-operable valve assembly 1548 remains open to allow water to flow from inlet 1542 to refill outlet 1544 and flush actuator outlet 1546. With electrically-operable valve assembly 1548 open, flush actuator assembly 1608 remains pressurized and, therefore, pivot assembly 1710 remains in a downward position. Water from supply tube 1536 flows through refill outlet 1544, into bowl refill tube 1592, through overflow tube 1692, and into bowl 1034 via flush tube 1604.

While bowl 1034 is being refilled, water also flows into tank refill tube 1594 in order to replenish the water in tank 1520. With flapper 1606 closes against flush tube 1604, the water flowing from tank refill tube 1594 remains in tank 1520. Tank sensor 1694 may indicate to controller 1708 when tank 1520 has been sufficiently replenished with water. In an illustrative embodiment, toilet 1510 may have a capacity of approximately 1.28 gallons/flush and may be refilled in approximately 30 seconds when flow restrictor 1562 controls the flow rate at approximately 2.5 gallons/minute.

After a flush cycle, the pressure in fill valve assembly 1540 may be relieved to reset flush actuator assembly 1608 in preparation for another flush cycle. In order to relieve the pressure in fill valve assembly 1540, electrically-operable valve assembly 1548 closes such that water at inlet 1542 no longer flows into fill valve assembly 1540. With inlet 1542 sealed, the water above piston 1638 may flow upward through flush actuator outlet 1546 and may be released through refill outlet 1544 after tank 1520 and bowl 1034 have been refilled. Additionally, water may flow through bleed orifice 1575 of pressure relief member 1572 in order to relieve the pressure within fill valve assembly 1540. In one embodiment, fill valve assembly 1540 may include an additional bleed hole to accelerate the release of the water from flush actuator assembly 1608.

By reducing the water pressure in flush actuator assembly 1608, diaphragm 1622, piston 1638, spring 1636, and piston rod 1620 move upwardly due to the bias of spring 1636. This upward movement also causes pivot assembly 1710 to move upwardly. In particular, pivot member 1716 moves past tabs 1754 of pivot frame 1752 such that pivot feet 1722 are again positioned above tabs 1754. Because pivot member 1716 may be angled outwardly relative to tank refill tube 1594, pivot member 1716 is able to move past tabs 1754 without interference in order to realign pivot assembly 1710. In one embodiment, lower rail **1718*b* of guide member 1718 may contact pivot member 1716 during the upward movement of pivot assembly 1710 in order to realign pivot feet 1722 above tabs 1754**.

Although the invention has been described in detail with reference to certain preferred embodiments, variations and modifications exist within the spirit and scope of the invention as described and defined in the following claims.

The invention claimed is:

1. A toilet, comprising:

a bowl;

a tank coupled to the bowl;

a flush valve positioned within the tank;

a handle assembly configured to initiate a flush cycle and positioned at least partially outward of the tank, and the handle assembly includes a handle member and a lever arm;

a clutch mechanism configured to operate the handle assembly and positioned inside the tank, the clutch mechanism has a first clutch plate and a second clutch plate operably coupled to the first clutch plate, and the lever arm is positioned adjacent at least one of the first or second clutch plates;

an electronic sensing assembly having a sensing member positioned on the bowl for detecting an overflow condition of the bowl;

an overflow device operably coupled to the flush valve; and a controller in electronic communication with the electronic sensing assembly and the overflow device for controlling the flush valve in response to a condition of the toilet.

2. The toilet of claim 1, wherein the first clutch plate includes detents configured to frictionally mate with detents of the second clutch plate.

3. The toilet of claim 1, wherein the second clutch plate includes a channel angled relative to a rotational axis of the handle assembly.

4. The toilet of claim 3, wherein the channel is perpendicular to the rotational axis.

5. The toilet of claim 3, wherein the lever arm is operably coupled to the flush valve and the lever arm is received within the channel.

6. The toilet of claim 1, wherein the lever arm is operably coupled to the flush valve and configured to be directly coupled to the handle member along an axis of rotation of the handle assembly.

7. The toilet of claim 6, wherein the handle assembly further comprises a blocking assembly configured to prevent rotation of the handle member when an overflow condition is sensed by the electronic sensing assembly.

8. The toilet of claim 1, wherein the flush valve has a flapper configured to move between an open position wherein water flows into the bowl from the tank and a closed position wherein water remains in the tank, the flapper being operably coupled to the handle to move the flapper to the open position.

9. The toilet of claim 1, wherein the lever arm is received within an opening of the at least one of the first or second clutch plates.

10. An automatic flush toilet, comprising:

a bowl;

a tank coupled to the bowl and supporting a quantity of water;

a fill valve assembly positioned in the tank and including at least one electrically-operable valve assembly;

a flush actuator assembly fluidly coupled to the fill valve assembly;

a water supply in fluid communication with the fill valve assembly;

a flush valve assembly having a flapper configured to move between an open position wherein water flows into the bowl from the tank and a closed position wherein water remains in the tank, the flapper being operably coupled to the flush actuator assembly to move the flapper to the open position;

a housing supported by the tank, and the flush actuator assembly and the fill valve assembly are supported by the housing; and an overflow device in communication with the at least one electrically operable valve assembly, wherein the overflow device is configured to prevent water from the water supply from entering the tank, and the overflow device is configured to retain the flapper in the closed position.

11. The toilet of claim 10, wherein a pressure applied to the flush actuator assembly for operating the flush valve assembly is constant.

12. The toilet of claim 10, wherein the fill valve assembly defines an upper portion of the housing and the flush actuator assembly is supported by a lower portion of the housing.

13. The toilet of claim 10, wherein the housing is at least partially vertically aligned with the flapper.

14. The toilet of claim 10, further comprising:

a handle assembly configured to initiate a flush cycle and positioned at least partially outward of the tank; and a clutch mechanism configured to operate the handle assembly and positioned inside the tank.

15. The toilet of claim 14, wherein the clutch mechanism has a first clutch plate and a second clutch plate operably coupled to the first clutch plate.

16. The toilet of claim 15, wherein the first clutch plate includes detents configured to frictionally mate with detents of the second clutch plate.

17. The toilet of claim 15, wherein the second clutch plate includes a channel angled relative to a rotational axis of the handle assembly.

18. The toilet of claim 15, wherein the handle assembly includes a handle member and a lever arm, the lever arm is operably coupled to the flush valve and configured to be directly coupled to the handle member along an axis of rotation of the handle assembly.

* * * * *